US006986564B2

(12) United States Patent
Matsuo et al.

(10) Patent No.: US 6,986,564 B2
(45) Date of Patent: Jan. 17, 2006

(54) INK JET HEAD, METHOD FOR INSPECTING ACTUATOR, METHOD FOR MANUFACTURING INK JET HEAD, AND INK JET RECORDING APPARATUS

(75) Inventors: Hiroyuki Matsuo, Osaka (JP); Takanori Nakano, Osaka (JP); Koji Ikeda, Hyogo (JP); Atsushi Sogami, Hyogo (JP); Masaichiro Tatekawa, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 196 days.

(21) Appl. No.: 10/057,279

(22) Filed: Jan. 25, 2002

(65) Prior Publication Data

US 2004/0080568 A1 Apr. 29, 2004

(30) Foreign Application Priority Data

Jan. 30, 2001 (JP) ..... 2001-021052
Jan. 30, 2001 (JP) ..... 2001-021067
Jan. 31, 2001 (JP) ..... 2001-023018
Jan. 31, 2001 (JP) ..... 2001-023024

(51) Int. Cl.
*B41J 2/045* (2006.01)

(52) U.S. Cl. ..... 347/68; 347/69

(58) Field of Classification Search ..... 347/68, 347/69, 10, 70, 71, 72, 40
See application file for complete search history.

(56) References Cited

U.S. PATENT DOCUMENTS 5,617,127 A * 4/1997 Takeuchi et al. ..... 347/71
6,323,890 B1 11/2001 Muto et al.
6,705,702 B2 3/2004 Gunther et al.
2002/0027579 A1 3/2002 Matsuo et al.

FOREIGN PATENT DOCUMENTS

JP 10286953 A 10/1998

* cited by examiner

*Primary Examiner*—Lamson Nguyen
(74) *Attorney, Agent, or Firm*—Harness, Dickey & Pierce, P.L.C.

(57) ABSTRACT

A first line head 1 and a second line head 2 are arranged in a scanning direction X. In each of the line heads 1 and 2, actuator blocks 40 are arranged at a constant interval in a head longitudinal direction Y so as to be spaced apart from one another. The actuator block 40 of the second line head 2 is located between the actuator blocks 40 and 40 of the first line head 1 with respect to the head longitudinal direction Y. The actuator block 40 of the first line head 1 and the actuator block 40 of the second line head 2 partially overlap with each other with respect to the head longitudinal direction Y.

36 Claims, 38 Drawing Sheets

INK JET HEAD, METHOD FOR INSPECTING ACTUATOR, METHOD FOR MANUFACTURING INK JET HEAD, AND INK JET RECORDING APPARATUS

FIELD OF THE INVENTION

The present invention relates to an ink jet head, a method for inspecting an actuator, a method for manufacturing an ink jet head, and an ink jet recording apparatus.

BACKGROUND OF THE INVENTION

In recent years, high-density ink jet heads that are produced by using a so-called "transfer process" have been proposed in the art, as disclosed in, for example, Japanese Laid-Open Patent Publication No. 10-286953. A transfer process is an advantageous process as a method for producing a high-density head. A method for producing a head using a transfer process is as follows, for example.

First, a separate electrode is formed on a single crystal MgO substrate. Then, a piezoelectric member, being a perovskite-type dielectric thin film made of PZT, is formed on the separate electrode. Furthermore, a vibration plate that functions also as a common electrode is formed on the piezoelectric member by a sputtering method, or the like. Thus, a thin film actuator is produced. Then, the actuator on the substrate is attached to a pressure chamber plate, and the whole or part of the substrate is thereafter removed.

However, it was difficult to produce a line type ink jet head with the transfer process as described above for the following reasons.

In a line type ink jet head, the length of the head in the longitudinal direction needs to be greater than the paper width of the recording paper. For example, in order to record information on A4-size paper, the length of the head in the longitudinal direction needs to be 210 mm or more. Therefore, the length of the single crystal MgO substrate also needs to be 210 mm or more. However, while a single crystal MgO substrate is produced from a rock lump of MgO, the entire rock lump cannot be used, but what can actually be used is only a portion thereof. Therefore, in order to produce a single crystal MgO substrate whose length is 210 mm or more, it is necessary to provide a lump of MgO of such a length, thereby requiring very large equipment. Even if such a single crystal MgO substrate can be produced, the yield will be poor. Therefore, such a substrate will be a very costly material.

Moreover, in a transfer process, it is necessary to deposit, by a sputtering method, or the like, PZT on a single crystal MgO substrate. However, it requires very large equipment to deposit PZT over a large area. In addition, the yield lowers when one attempts to obtain a film that is uniform in properties such as the piezoelectric property and the thickness and that has no crack therein. Therefore, the manufacturing cost becomes very high.

For the reasons as described above, it was difficult to use a transfer process for a conventional line type ink jet head in view of the quality and the cost.

Moreover, along with the increase in the density of ink jet heads, there is an increasing demand for improving the reliability thereof. In the prior art, inspection of an ink jet head including actuators is performed after transferring the actuators onto a pressure chamber block.

With the conventional method, however, when a defect was included in an actuator, it was necessary to waste the pressure chamber block along with the actuator even if the pressure chamber block itself had no problem. In other words, it was not possible to waste only the actuator while using the non-defective pressure chamber block.

The present inventors have devised a way of effectively using a transfer process for a line type ink jet head, in which a plurality of actuators are provided for each pressure chamber block by dividing an actuator, which was a single component in the prior art, into a plurality of actuators. In such an ink jet head using a plurality of actuators, even if a defect is included in one actuator, the other actuators may be non-defective. If inspection is performed after transferring the actuators onto the pressure chamber block as in the prior art, the actuators cannot be wasted individually, whereby it is necessary to waste non-defective actuators along with defective actuators. However, this leads to an increase in the material cost and the manufacturing cost. It also lowers the yield. In view of this, it is preferred to perform an early inspection on individual actuators before they are transferred onto the pressure chamber block, and to waste the defective actuators individually.

Moreover, an ink jet head including a plurality of nozzles, a plurality of pressure chambers respectively communicated to the nozzles, and an actuator for pressurizing or depressurizing an ink in each pressure chamber so as to discharge the ink through each nozzle, has been widely used in the prior art in a recording apparatus such as a printer. In such an ink jet head, the nozzles are arranged in a direction perpendicular to the scanning direction at a minute pitch that corresponds to a predetermined dot density.

In recent years, however, the recording image quality has been improved, and the actuators and the nozzles are arranged with an increasing density. For example, in an ink jet head for recording information at 600 dpi, the nozzles are arranged at a minute pitch of 42.3 $\mu$m.

However, as the density of actuators and nozzles increases, it becomes more difficult to ensure uniformity in the properties of the actuators and to process the nozzles properly. If the properties are not uniform among the actuators or if the nozzles are misshaped, it is no longer possible to discharge a predetermined amount of ink droplets through the nozzles and to stably form ink dots of a predetermined size on the recording medium. Therefore, along with the increase in the density, there is a higher possibility that some of the large number of actuators and nozzles may be incapable of forming an ink dot of the predetermined size.

For example, where some actuators have an inferior performance, such actuators can only form ink dots that are slightly smaller than the predetermined size. Such small dots, if dispersed, cannot be distinguished by human eyes. However, if small dots D2 are aligned in a continuous single row, as illustrated in FIG. 45, the difference thereof with respect to normal dots D1 becomes conspicuous. Specifically, if the small dots D2 are aligned in a single row, a linear space that is larger than normal appears between the small dots D2 and the dots D1 of the normal size, resulting in a white streak L1. The so-called "white streak" L1 may lower the quality of character-printing or image-printing.

SUMMARY OF THE INVENTION

The present invention has been made in view of the above, and has an object to provide a line type ink jet head that can be produced by a transfer process, and to realize an improved uniformity of thin film actuators in terms of properties such as the piezoelectric property and the thickness, prevention of a crack occurring in the film, improvement in the manufacturing yield, downsizing of the manufacturing equipment, a cost reduction, etc., for a line type ink jet head and a recording apparatus having the same.

Moreover, another object of the present invention is to provide an inspection method for inspecting an actuator before it is attached to a pressure chamber block, a method for manufacturing an ink jet head that effectively utilizes the inspection method, and an ink jet recording apparatus utilizing the manufacturing method.

Moreover, still another object of the present invention is to improve the quality of character-printing or image-printing by preventing a white streak as described above from occurring.

An ink jet head of the present invention is an ink jet head, including a plurality of line heads arranged in a scanning direction, wherein: each line head includes: a pressure chamber block including a common liquid chamber for storing an ink, a plurality of pressure chambers communicated to the common liquid chamber, and a plurality of nozzles respectively communicated to the pressure chambers; and a plurality of actuator blocks each including a piezoelectric element, a first electrode and a second electrode for applying a voltage across the piezoelectric element, and a vibration plate, the plurality of actuator blocks being arranged on one surface of the pressure chamber block so that more than one of the pressure chambers of the pressure chamber block are covered by the vibration plate; and the actuator blocks of each line head are arranged in a head longitudinal direction with adjacent ones of the actuator blocks being spaced apart from each other, and the actuator blocks of the line head are shifted from the actuator blocks of another line head in the head longitudinal direction while partially overlapping with the actuator blocks of the other line head in the head longitudinal direction.

In this way, a plurality of actuator blocks are provided for each pressure chamber block, whereby the size of each actuator block can be reduced. Therefore, it is possible to realize an improved uniformity in properties such as the piezoelectric property and the thickness, prevention of a crack occurring in the film, improvement in the manufacturing yield, downsizing of the manufacturing equipment, a cost reduction, etc.

Moreover, in each line head, the actuator blocks are spaced apart from one another, whereby the actuator blocks will not physically overlap with each other even if the error in the shape of the actuator blocks is large or if the positional precision of the actuator blocks is somewhat low. Thus, it is possible to improve the yield.

Since the actuator blocks of each line head are shifted in the head longitudinal direction from the actuator blocks of another line head, the actuator blocks are arranged at intervals in the head longitudinal direction for each line head alone. However, for the plurality of line heads as a whole, the actuator blocks are arranged with no gap therebetween in the head longitudinal direction. Particularly, the actuator blocks of each line head are arranged so as to partially overlap with the actuator blocks of another line head, whereby the actuator blocks as a whole are arranged with no gap therebetween in the head longitudinal direction. Therefore, actuators can be arranged at a predetermined interval in the head longitudinal direction.

In one embodiment, the line heads include a plurality of line heads of a same shape; and the line heads of the same shape are shifted from one another in the head longitudinal direction.

In one embodiment, in each of the line heads of the same shape, a plurality of actuator blocks are arranged at a predetermined interval that is shorter than a length of each actuator block in the head longitudinal direction; and the line heads of the same shape are shifted from each other in the head longitudinal direction so that the actuator block of one line head is located between the actuator blocks of the other line head with respect to the head longitudinal direction.

Thus, by arranging the line heads of the same shape so as to be shifted from each other in the head longitudinal direction, the actuator blocks as a whole are arranged with no gap therebetween in the head longitudinal direction. Since the line heads are of the same shape, it is not necessary to separately manufacture a plurality of types of line heads of different shapes, thus reducing the cost by employing a uniform line head shape.

In one embodiment, the line heads include at least a pair of line heads of a same shape; and the pair of line heads are arranged in point symmetry with each other.

In one embodiment, in each of the line heads of the same shape, a plurality of actuator blocks are arranged at a predetermined interval that is shorter than a length of each actuator block in the head longitudinal direction; and the line heads of the same shape are arranged in point symmetry with each other so that the line heads are aligned with each other at both ends in the head longitudinal direction and so that the actuator block of one line head is located between the actuator blocks of the other line heads with respect to the head longitudinal direction.

Thus, a pair of line heads of the same shape are arranged in point symmetry with each other, whereby the actuator blocks as a whole are arranged with no gap therebetween in the head longitudinal direction. Since the line heads are of the same shape, it is not necessary to separately manufacture a plurality of types of line heads of different shapes, thus reducing the cost by employing a uniform line head shape.

Since the line heads are aligned with each other at both ends thereof in the head longitudinal direction, the length of the head in the longitudinal direction is reduced as compared to a case where they are shifted from each other at both ends thereof.

In one embodiment, the actuator blocks of the plurality of line heads as a whole are arranged in a staggered pattern.

Thus, the actuator blocks are arranged in a staggered pattern, and the actuator blocks are arranged with no gap therebetween in the head longitudinal direction.

In one embodiment, the line heads discharge an ink of a same type.

In this way, it is possible to obtain an ink jet head that discharges an ink of a single color.

In one embodiment, the line heads form line head groups each including a plurality of line heads that discharge an ink of a same type; a plurality of such line head groups are provided in the scanning direction so as to discharge inks of different types.

Thus, a plurality of line heads each discharging an ink of the same type are arranged in the scanning direction, thereby forming a line head group. In the line head group, the actuator blocks as a whole are arranged with no gap therebetween in the head longitudinal direction. A plurality of such line head groups are arranged in the scanning direction, thereby obtaining an ink jet head that discharges inks of different types. Note that the inks of different types may be either different types of inks of the same color or inks of different colors. If inks of different colors are used, a color image can be formed.

In one embodiment, the line heads discharge inks of different types.

Thus, the line heads discharge inks of different types, thereby obtaining an ink jet head that discharges inks of different types.

Another ink jet head of the present invention is an ink jet head, including: a pressure chamber block including a common liquid chamber for storing an ink, a plurality of pressure chambers communicated to the common liquid chamber, and a plurality of nozzles respectively communicated to the pressure chambers; and a plurality of actuator 1 blocks each including a piezoelectric element, a first electrode and a second electrode for applying a voltage across the piezoelectric element, and a vibration plate, the plurality of actuator blocks being arranged on one surface of the pressure chamber block so that more than one of the pressure chambers of the pressure chamber block are covered by the vibration plate, wherein: the pressure chambers of the pressure chamber block form a plurality of pressure chamber rows arranged in a head longitudinal direction, each pressure chamber row including more than one of the pressure chambers that are arranged in a direction inclined from the head longitudinal direction; the pressure chamber rows are arranged parallel to one another; each of the actuator blocks is formed in a parallelogram shape having a side that is parallel to a row direction of each pressure chamber row; and the actuator blocks are arranged in the head longitudinal direction so as to be spaced apart from one another.

In this way, a plurality of actuator blocks are provided for each pressure chamber block, whereby the size of each actuator block can be reduced. Thus, a transfer process can be effectively utilized. Therefore, it is possible to realize an improved uniformity of piezoelectric elements of actuator blocks in terms of properties such as the piezoelectric property and the thickness, prevention of a crack occurring in the film, improvement in the manufacturing yield, downsizing of the manufacturing equipment, a cost reduction, etc.

Moreover, in the pressure chamber block, the pressure chamber rows are arranged parallel to one another, and the row direction of the pressure chamber rows is inclined from the head longitudinal direction, with the pressure chambers being shifted from one another in the scanning direction (i.e., the direction perpendicular to the head longitudinal direction). Therefore, although the pressure chambers are arranged at a minute interval in the head longitudinal direction for the head as a whole, the interval between adjacent pressure chambers is increased in each pressure chamber row by the shift between pressure chambers in the scanning direction. Similarly, although the interval between pressure chamber rows is a minute interval with respect to the head longitudinal direction, it is relatively large with respect to the direction perpendicular to the row direction of the pressure chamber rows.

Herein, each actuator block is formed in a parallelogram shape having a side that is parallel to the row direction of the pressure chamber rows. Therefore, even if the actuator blocks are arranged in the head longitudinal direction so as to be spaced apart from one another, the actuator blocks will cover all the pressure chambers, with no pressure chamber being left uncovered, for the head as a whole because of the large interval between the pressure chamber rows in the direction perpendicular to the row direction thereof. Thus, although the actuator blocks are arranged at intervals, a plurality of actuators are arranged at a minute interval in the head longitudinal direction so as to correspond to the respective pressure chambers for the head as a whole.

Thus, the actuator blocks can be arranged so as to be spaced apart from one another, whereby the actuator blocks will not physically overlap with each other even if there is an error in the shape or arrangement of the actuator blocks. Therefore, an error in the shape or arrangement of the actuator blocks can be tolerated to a considerable degree, thereby improving the yield.

One possible arrangement pattern for arranging the actuator blocks so as to be spaced apart from one another is one where the actuator blocks are arranged in a staggered pattern. However, with such an arrangement pattern, it is necessary to provide two rows of actuator blocks, thereby increasing the length of the head in the scanning direction. In contrast, with an ink jet head as described above, it is not necessary to provide two rows of actuator blocks, thereby reducing the length of the head in the scanning direction. Therefore, it is possible to downsize the head. Moreover, if the head is long in the scanning direction, the recording medium is likely to be bent, whereby the recording operation is likely to be unstable. However, with an ink jet head as described above, the length of the head in the scanning direction is reduced, whereby the recording medium is less likely to be bent. Therefore, a stable recording operation can be performed.

In one embodiment, the pressure chambers of the pressure chamber block are arranged at a predetermined interval with respect to the head longitudinal direction so that a longitudinal direction of each pressure chamber is perpendicular to the head longitudinal direction; the pressure chambers of each pressure chamber row are arranged at the predetermined interval; and the pressure chamber at one end of a pressure chamber row and the pressure chamber at one end of an adjacent pressure chamber row are arranged at the predetermined interval.

In one embodiment, the pressure chambers of the pressure chamber block are arranged at a predetermined interval with respect to the head longitudinal direction so that a longitudinal direction of each pressure chamber is perpendicular to the head longitudinal direction; at least two pressure chambers included in each pressure chamber row are arranged at an interval that is a multiple of the predetermined interval; and at least one of the pressure chambers included in each pressure chamber row is provided between two pressure chambers included in an adjacent pressure chamber row with respect to the head longitudinal direction.

In one embodiment, the pressure chambers of the pressure chamber block are arranged at a predetermined interval with respect to the head longitudinal direction so that a longitudinal direction of each pressure chamber is inclined from the head longitudinal direction; the pressure chambers of each pressure chamber row are arranged at the predetermined interval; and the pressure chamber at one end of a pressure chamber row and the pressure chamber at one end of an adjacent pressure chamber row are arranged at the predetermined interval.

In one embodiment, the pressure chambers of the pressure chamber block are arranged at a predetermined interval with respect to the head longitudinal direction so that a longitudinal direction of each pressure chamber and a row direction of each pressure chamber row are parallel to each other; at least two pressure chambers included in each pressure chamber row are arranged at an interval that is a multiple of the predetermined interval; and at least one of the pressure chambers included in each pressure chamber row is provided between two pressure chambers included in an adjacent pressure chamber row with respect to the head longitudinal direction.

In this way, at least two pressure chambers of each pressure chamber row are arranged at an interval that is a multiple of the predetermined interval (see FIG. 19), the interval between these pressure chambers is increased. Therefore, interference is less likely to occur between the actuators corresponding to these pressure chambers. In other words, crosstalk is less likely to occur. Therefore, the ink discharging performance is improved.

Moreover, since the longitudinal direction of each pressure chamber and the row direction of the pressure chamber rows are parallel to each other (see FIG. 21), each actuator block has a side that is parallel to the longitudinal direction of each pressure chamber. Therefore, the length of another side of the actuator block can be reduced, thereby further reducing the size of the actuator block. Moreover, the interval between the actuator blocks can be further increased.

In one embodiment, the pressure chamber block includes a plurality of sets of the common liquid chamber, the nozzles, the pressure chamber rows and the actuator blocks, the plurality of sets being arranged in a scanning direction.

In this way, a plurality of sets of the common liquid chamber, the nozzles, the pressure chamber rows and the actuator blocks are arranged in the scanning direction (see FIG. 23), whereby effects as those described above can be obtained with a head that discharges inks of different types, similarly to the case described above where a plurality of line type ink jet heads are provided in the scanning direction. If inks of different colors are used, a color image can be formed.

In one embodiment, the actuator block includes a conductive vibration plate that functions also as the second electrode, instead of including the second electrode and the vibration plate.

In this way, it is possible to reduce the number of components of each actuator block.

Still another ink jet head of the present invention includes: a head body including two or more nozzle rows each including a plurality of nozzles, wherein one or more of the nozzles of at least one nozzle row is located along a same line in a scanning direction with one or more of the nozzles of another nozzle row; and an actuator for causing an ink to be discharged from the nozzles, wherein the actuator causes an ink of a same type to be discharged, alternately by one shot or by a number of shots, from the nozzles that are located along the same line in the scanning direction.

Still another ink jet head of the present invention includes at least two head blocks arranged in a scanning direction, each head block including a head body in which one or more nozzle row including a plurality of nozzles is formed, and an actuator for causing an ink to be discharged from the nozzles, wherein: the head blocks are arranged so that one or more of the nozzles of at least one head block is located along a same line in a scanning direction with one or more of the nozzles of another head block; and the actuators of the head blocks cause an ink of a same type to be discharged, alternately by one shot or by a number of shots, from the nozzles that are located along the same line in the scanning direction.

In an ink jet head as described above, an ink of the same type is discharged alternately from nozzles that are located on the same line in the scanning direction, whereby the ink discharged from the nozzles alternately forms ink dots on the recording medium. If one of the nozzles (or the actuators, etc., corresponding to the nozzles) is incapable of discharge a predetermined amount of ink, the ink discharged from the nozzle forms an ink dot of a size different from that of a normal ink dot. However, since the ink dots are formed alternately as described above, ink dots of the different size will not be aligned in a continuous row in the scanning direction. Therefore, a white streak is prevented from occurring.

Still another ink jet head of the present invention is an ink jet head, including: a pressure chamber block including a common liquid chamber for storing an ink, a plurality of pressure chambers communicated to the common liquid chamber, and a plurality of nozzles respectively communicated to the pressure chambers; and an actuator including a piezoelectric element, a first electrode and a second electrode for applying a voltage across the piezoelectric element, and a vibration plate, the actuator being arranged on the pressure chamber block so that the pressure chambers of the pressure chamber block are covered by the vibration plate, wherein: the pressure chambers of the pressure chamber block form a plurality of pressure chamber rows arranged in a head longitudinal direction and in a scanning direction, each pressure chamber row including more than one of the pressure chambers arranged in a direction that is inclined from the head longitudinal direction; at least one pressure chamber of a pressure chamber row is located along a same line in the scanning direction with at least one pressure chamber of another pressure chamber row, and nozzles that correspond to the pressure chambers located along the same line in the scanning direction are also located along a same line in the scanning direction; and the actuator causes an ink of a same type to be discharged, alternately by one shot or by a number of shots, from the nozzles that are located along the same line in the scanning direction.

In this way, an ink of the same type is discharged alternately from nozzles that are located on the same line in the scanning direction, whereby a white streak is prevented from occurring.

In one embodiment, the actuator includes a plurality of actuator blocks each having an area that is smaller than the pressure chamber block; the actuator blocks are arranged in the head longitudinal direction and in the scanning direction; and adjacent ones of the actuator blocks are spaced apart from each other in the scanning direction while partially overlapping with each other with respect to the head longitudinal direction.

In this way, an actuator includes a plurality of actuator blocks, whereby the size of each actuator block can be small even if the pressure chamber block is of a relatively large size such as those in a line type head. Therefore, the actuator blocks can be produced by a so-called "transfer process", whereby it is possible to realize an improved uniformity of thin film actuators in terms of properties such as the piezoelectric property and the thickness, prevention of a crack occurring in the film, improvement in the manufacturing yield, downsizing of the manufacturing equipment, a cost reduction, etc.

Moreover, adjacent actuator blocks are spaced apart from each other, whereby the actuator blocks will not physically overlap with each other even if the positional precision of the actuator blocks is somewhat low or if the error in the shape of the actuator blocks is somewhat large. On the other hand, since adjacent actuator blocks are arranged so as to partially overlap with each other with respect to the head longitudinal direction, all the pressure chambers arranged in the head longitudinal direction are reliably covered by the actuator blocks with no pressure chamber being left uncovered. Therefore, although a plurality of actuator blocks are used, the production error and the positioning error thereof can be tolerated to a considerable degree, thereby improving the yield.

Still another ink jet head of the present invention is an ink jet head, including: a pressure chamber block including a common liquid chamber for storing an ink, a plurality of pressure chambers communicated to the common liquid chamber, and a plurality of nozzles respectively communicated to the pressure chambers; and an actuator including a piezoelectric element, a first electrode and a second electrode for applying a voltage across the piezoelectric element, and a vibration plate, the actuator being arranged on the pressure chamber block so that the pressure chambers of the pressure chamber block are covered by the vibration plate, wherein: the pressure chambers of the pressure chamber block form a plurality of pressure chamber rows arranged in a head longitudinal direction, each pressure chamber row including more than one of the pressure chambers arranged in a direction that is inclined from the head longitudinal direction; at least one pressure chamber of a pressure chamber row is located along a same line in the scanning direction with at least one pressure chamber of another pressure chamber row, and nozzles that correspond to the pressure chambers located along the same line in the scanning direction are also located along a same line in the scanning direction; and the actuator causes an ink of a same type to be discharged, alternately by one shot or by a number of shots, from the nozzles that are located along the same line in the scanning direction.

In this way, an ink of the same type is discharged alternately from nozzles that are located on the same line in the scanning direction, whereby a white streak is prevented from occurring.

In one embodiment, the actuator includes a plurality of actuator blocks each in a parallelogram shape having an area that is smaller than the pressure chamber block and having a side that is parallel to a row direction of the pressure chamber rows; the actuator blocks are arranged in the head longitudinal direction; and adjacent ones of the actuator blocks are spaced apart from each other.

In this way, even if the pressure chamber block is of a relatively large size, the actuator blocks can be produced by a so-called "transfer process", whereby it is possible to realize an improved uniformity of thin film actuators in terms of properties such as the piezoelectric property and the thickness.

Moreover, the row direction of the pressure chamber rows is inclined from the head longitudinal direction, and the pressure chambers are shifted from one another in the scanning direction. Therefore, although the pressure chambers are arranged at a minute interval in the head longitudinal direction for the head as a whole, the interval between adjacent pressure chambers is increased in each pressure chamber row by the shift between pressure chambers in the scanning direction. Similarly, although the interval between pressure chamber rows is a minute interval with respect to the head longitudinal direction, it is relatively large with respect to the direction perpendicular to the row direction of the pressure chamber rows.

Herein, each actuator block is formed in a parallelogram shape having a side that is parallel to the row direction of the pressure chamber rows. Therefore, even if the actuator blocks are arranged in the head longitudinal direction so as to be spaced apart from one another, the actuator blocks will cover all the pressure chambers, with no pressure chamber being left uncovered, for the head as a whole because of the large interval between the pressure chamber rows in the direction perpendicular to the row direction thereof. Thus, although the actuator blocks are arranged at intervals, a plurality of actuators are arranged at a minute interval in the head longitudinal direction so as to correspond to the respective pressure chambers for the head as a whole.

Thus, the actuator blocks can be arranged so as to be spaced apart from one another, whereby the actuator blocks will not physically overlap with each other even if there is an error in the shape or arrangement of the actuator blocks. Therefore, an error in the shape or arrangement of the actuator blocks can be tolerated to a considerable degree, thereby improving the yield.

In addition, it is not necessary to provide two rows of actuator blocks, thereby reducing the length of the head in the scanning direction. Therefore, it is possible to downsize the head. Moreover, if the head is long in the scanning direction, the recording medium is likely to be bent, whereby the recording operation is likely to be unstable. However, with an ink jet head as described above, the length of the head in the scanning direction is reduced, whereby the recording medium is less likely to be bent. Therefore, a stable recording operation can be performed.

Still another ink jet head of the present invention is an ink jet head, including a plurality of line heads arranged in a scanning direction, wherein: each line head includes: a pressure chamber block including a common liquid chamber for storing an ink, a plurality of pressure chambers communicated to the common liquid chamber, and a plurality of nozzles respectively communicated to the pressure chambers; and an actuator including a piezoelectric element, a first electrode and a second electrode for applying a voltage across the piezoelectric element, and a vibration plate, the actuator being arranged on the pressure chamber block so that the pressure chambers of the pressure chamber block are covered by the vibration plate, wherein the pressure chambers of the pressure chamber block form a plurality of pressure chamber rows arranged in a head longitudinal direction, each pressure chamber row including more than one of the pressure chambers arranged in a direction that is inclined from the head longitudinal direction; the line heads are arranged so that one or more pressure chamber of at least one line head is located along a same line in the scanning direction with one or more pressure chamber of another line head, and the nozzles that correspond to the pressure chambers located along the same line in the scanning direction are also located along a same line in the scanning direction; and the actuators of the line heads cause an ink of a same type to be discharged, alternately by one shot or by a number of shots, from the nozzles that are located along the same line in the scanning direction.

In this way, an ink of the same type is discharged alternately from nozzles that are located on the same line in the scanning direction, whereby a white streak is prevented from occurring.

In one embodiment, the actuator of each line head includes a plurality of actuator blocks each having an area that is smaller than the pressure chamber block; the actuator blocks of each line head are arranged in the head longitudinal direction so that adjacent ones of the actuator blocks are spaced apart from each other; and the line heads are arranged so that the actuator block of each line head partially overlaps with the actuator block of another line head with respect to the head longitudinal direction.

In this way, the production of an actuator block by a transfer process is facilitated, whereby it is possible to realize an improved uniformity of thin film actuators in terms of properties such as the piezoelectric property and the thickness.

In one embodiment, the actuator blocks are arranged in a staggered pattern.

Thus, the actuator blocks are arranged in a staggered pattern, whereby the actuator blocks as a whole are arranged with no gap therebetween in the head longitudinal direction.

In one embodiment, the actuator includes a conductive vibration plate that functions also as the second electrode, instead of including the second electrode and the vibration plate.

In this way, the number of components of each actuator block is reduced.

In one embodiment, a plurality of ink jet heads as described above are provided for inks of different types and are arranged in the scanning direction.

In this way, effects as those described above can be obtained with an ink jet head that discharges inks of different types. If inks of different colors are used, effects as those described above can be obtained with an ink jet head that forms a color image.

A method for inspecting an actuator of the present invention is a method for inspecting an actuator including a piezoelectric element, and a first electrode and a second electrode that are provided on opposite sides of the piezoelectric element, the method including: a step of producing an actuator forming member in which the first electrode, the piezoelectric element and the second electrode are deposited in this order on a substrate, with a portion of the first electrode being exposed; and an inspection step of inspecting a property of the piezoelectric element by contacting inspection probes to the exposed portion of the first electrode and the second electrode.

With an inspection method as described above, the exposed portion is formed in the first electrode with the first electrode, the piezoelectric element and the second electrode being deposited on the substrate, whereby it is easy to contact the inspection probes to the first electrode and the second electrode. Then, a property of the actuator is inspected by, for example, contacting the inspection probes to the exposed portion of the first electrode and the second electrode by pressing the inspection probes thereonto, and supplying a predetermined voltage or current between the first electrode and the second electrode. Therefore, before attaching the actuator to the pressure chamber block, the property thereof can be easily inspected.

In one embodiment, the step of producing an actuator forming member includes: a step of depositing the first electrode on the substrate; and a step of depositing the piezoelectric element and the second electrode on the first electrode while blocking a portion of the first electrode using a mask so that the portion becomes an exposed portion.

In one embodiment, the step of producing an actuator forming member includes: a step of depositing the first electrode, the piezoelectric element and the second electrode in this order on the substrate; and a step of etching a portion of the second electrode and the piezoelectric element so that a portion of the first electrode becomes an exposed portion.

In one embodiment, the step of producing an actuator forming member includes: a step of depositing the first electrode and the piezoelectric element in this order on the substrate; a step of depositing the second electrode on the piezoelectric element while blocking a portion of the piezoelectric element using a mask so that the portion of the piezoelectric element becomes an exposed portion; and a step of etching the exposed portion of the piezoelectric element so that a portion of the first electrode becomes an exposed portion.

In this way, the actuator forming member can be easily produced.

In one embodiment, the inspection step includes a step of attaching a conductive paste material to one or both of the exposed portion of the first electrode and the second electrode, and contacting the inspection probes to the first electrode or the second electrode via the paste material.

In an inspection method as described above, the inspection probes are contacted to the exposed portion of the first electrode and the second electrode via the paste material. Then, a predetermined voltage or current, etc., is supplied between the first electrode and the second electrode to inspect the property of the actuator. The inspection probes are firmly fixed to the electrodes by the paste material, whereby the electrical contact between the inspection probes and the electrodes is ensured without pressing the inspection probes thereonto with a strong force. Therefore, an adverse influence in the property inspection due to the inspection probe pressing force is minimized.

In one embodiment, the inspection step includes a step of measuring one or both of a relative dielectric constant and a dielectric loss of the piezoelectric element.

In this way, the relative dielectric constant or the dielectric loss of the piezoelectric element is measured, and the property of the actuator is evaluated based on the measured value.

In one embodiment, the inspection step includes a step of measuring a piezoelectric constant of the piezoelectric element.

In this way, the piezoelectric constant of the piezoelectric element is measured, and the property of the actuator is evaluated based on the measured value.

A method for manufacturing an ink jet head of the present invention is a method for manufacturing an ink jet head, the ink jet head including: a pressure chamber block including a common liquid chamber for storing an ink, a plurality of pressure chambers communicated to the common liquid chamber, and a plurality of nozzles respectively communicated to the pressure chambers; and a plurality of actuator blocks each including at least a piezoelectric element, and a first electrode and a second electrode for applying a voltage across the piezoelectric element, the plurality of actuator blocks being arranged on one surface of the pressure chamber block, wherein before attaching the actuator blocks to the pressure chamber block, each of the actuator blocks is inspected by the inspection method as described above.

Another method for manufacturing an ink jet head of the present invention includes: a step of producing a plurality of actuator forming members in each of which a first electrode, a piezoelectric element and a second electrode are deposited in this order on a substrate whose area is smaller than a pressure chamber plate, with a portion of the first electrode being exposed; an inspection step of inspecting a property of each piezoelectric element by contacting inspection probes to the exposed portion of the first electrode and the second electrode of each actuator forming member; a step of producing an actuator block on the substrate by depositing a vibration plate on the second electrode of each actuator forming member having undergone the inspection; a step of attaching each actuator block, together with the substrate, on one surface of the pressure chamber plate so that more than one of the pressure chambers provided in the pressure chamber plate are covered by the vibration plate of the actuator block; a step of removing each substrate; a step of patterning the first electrode of each actuator block; a step of attaching a channel plate on the other surface of the pressure chamber plate, the channel plate including therein an ink channel for guiding an ink from the pressure chambers to nozzles and a common liquid chamber; and attaching a nozzle plate including the nozzles therein to the channel plate.

Another method for manufacturing an ink jet head of the present invention includes: a step of producing a plurality of actuator forming members in each of which a first electrode, a piezoelectric element and a second electrode are deposited in this order on a substrate whose area is smaller than a pressure chamber plate, with a portion of the first electrode being exposed; an inspection step of inspecting a property of each piezoelectric element by contacting inspection probes to the exposed portion of the first electrode and the second electrode of each actuator forming member; a step of attaching each actuator forming member having undergone the inspection on one surface of the pressure chamber plate so that more than one of the pressure chambers provided in the pressure chamber plate are covered by the second electrode of the actuator forming member; a step of removing each substrate; a step of patterning the first electrode of each actuator forming member; a step of attaching a channel plate on the other surface of the pressure chamber plate, the channel plate including therein an ink channel for guiding an ink from the pressure chambers to nozzles and a common liquid chamber; and attaching a nozzle plate including the nozzles therein to the channel plate.

With a manufacturing method as described above, each actuator block is inspected before attaching a plurality of actuator blocks to the pressure chamber block by a transfer process, whereby it is possible to attach only the non-defective actuator blocks to the pressure chamber block by removing defectives in advance. Therefore, it is not necessary to waste some defectives along with non-defective actuator blocks after the attachment, thereby eliminating the waste of actuator blocks.

If the second electrode functions also as the vibration plate, it is possible to realize a cost reduction by reducing the number of components.

An ink jet recording apparatus of the present invention includes: an ink jet head as described above; and movement means for relatively moving the ink jet head and a recording medium with respect to each other in a scanning direction.

Another ink jet recording apparatus of the present invention includes: an ink jet head manufactured by a manufacturing method as described above; and movement means for relatively moving the ink jet head and a recording medium with respect to each other.

DESCRIPTION OF THE PREFERRED EMBODIMENTS

Preferred embodiments of the present invention will now be described with reference to the drawings.

<Embodiment 1>

Figure 1:
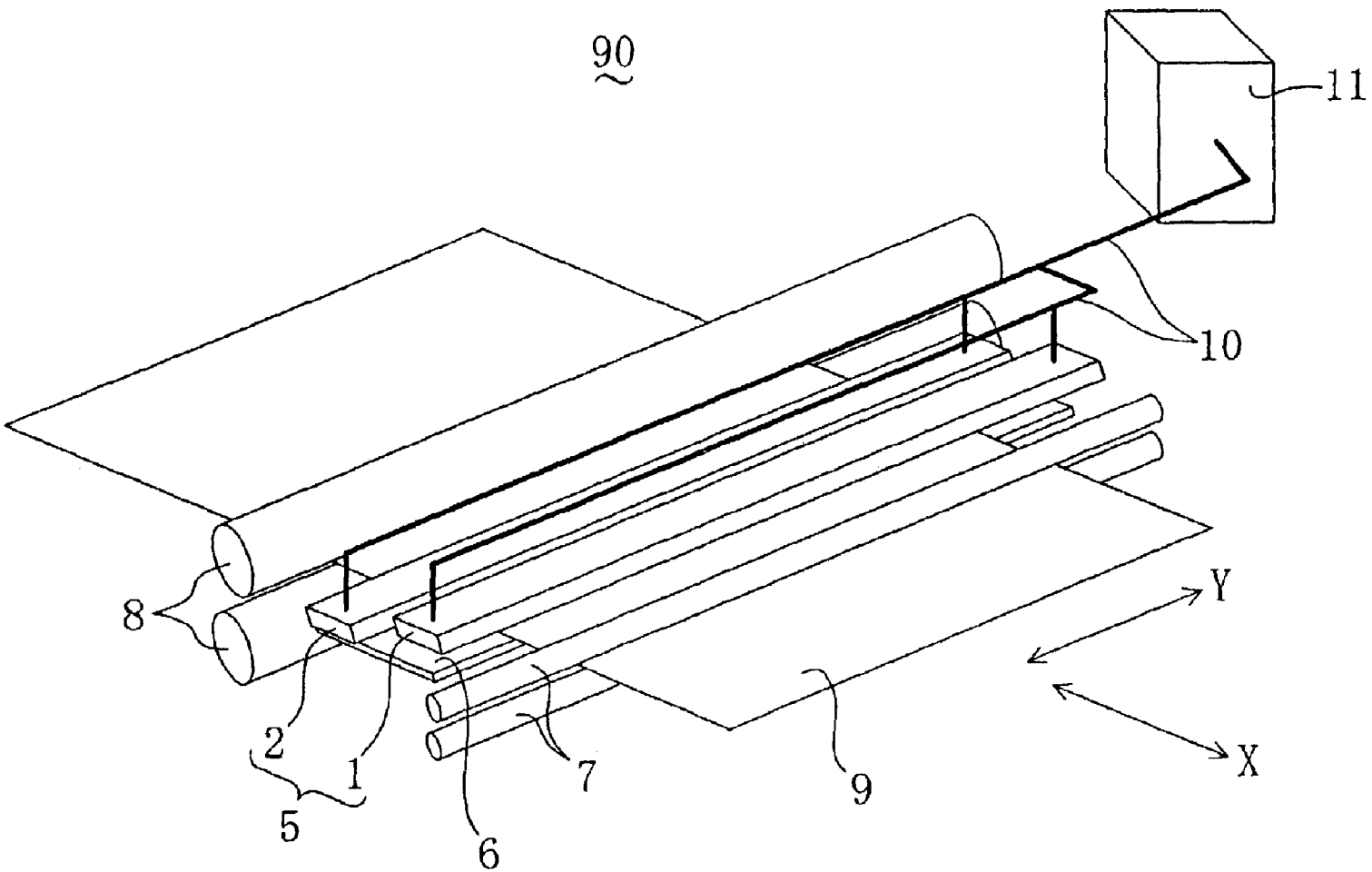
FIG. 1 is a perspective view illustrating an important part of an ink jet recording apparatus according to Embodiment 1.

As illustrated in FIG. 1, an ink jet recording apparatus 90 according to Embodiment 1 is a so-called "line head type" recording apparatus. An ink jet head 5 extends in the width direction of a recording medium 9, and a longitudinal direction Y of the head 5 is perpendicular to a scanning direction X. The ink jet head 5 is configured to discharge a black ink. The ink jet head 5 is connected to an ink tank 11 storing an ink via an ink tube 10.

The ink jet head 5 includes two line heads arranged next to each other in the scanning direction X, i.e., a first line head 1 and a second line head 2. The configuration of the line heads 1 and 2 will be described later.

The ink jet recording apparatus 90 includes a pair of carrier rollers 8 and 8 and a pair of feeding rollers 7 and 7, with the recording medium 9 being sandwiched between the feeding rollers 7 and 7 and between the carrier rollers 8 and 8. The carrier rollers 8 and 8 form movement means for relatively moving the ink jet head 5 and the recording medium 9 with respect to each other. The recording medium 9 is carried in the scanning direction X by the rotation of the carrier rollers 8 and 8.

A recording medium holding member 6 in the form of a flat plate is provided below the ink jet head 5. Note that the recording medium holding member 6 is not limited to a flat plate member but may alternatively be a cylindrical member, for example, as long as it keeps the recording medium 9 and the ink jet head 5 opposing each other with a constant interval therebetween. The recording medium 9 passes through between the ink jet head 5 and the recording medium holding member 6. The recording medium 9 is carried by the carrier rollers 8 and 8 while being sandwiched between the feeding rollers 7 and 7, and thus is placed under a tension by the rollers 7 and 8. In this way, the recording medium 9 forms a flat surface on the recording medium holding member 6 without being bent. Thus, ink droplets discharged from the ink jet head 5 land on the recording medium 9 with a high precision.

Note that although not shown, the recording medium 9 on the recording medium holding member 6 can be made even flatter by electrically attracting the recording medium 9 by giving an electrostatic charge to the recording medium holding member 6. Therefore, means for giving an electrostatic charge to the recording medium holding member 6 may be provided.

Figure 2:
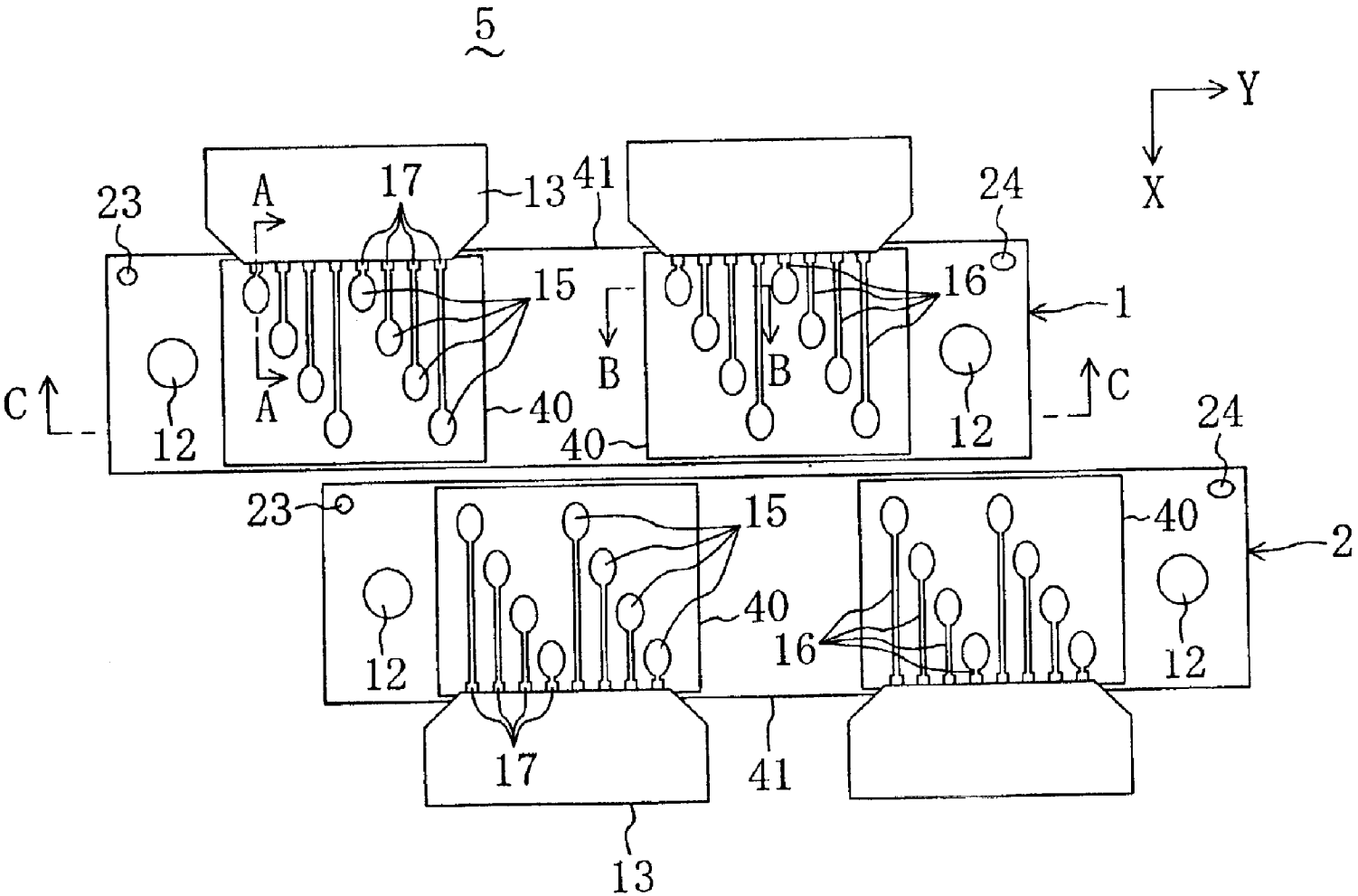
FIG. 2 is a plan view illustrating an ink jet head according to Embodiment 1.

Next, the general configuration of the first line head 1 and the second line head 2 will be described with reference to FIG. 2 to FIG. 6. As illustrated in FIG. 2, each of the line heads 1 and 2 includes a pressure chamber block 41, and a plurality of actuator blocks 40 attached to the pressure chamber block 41. The actuator blocks 40 of each of the line heads 1 and 2 are arranged at a predetermined interval in the head longitudinal direction Y. Adjacent actuator blocks 40 and 40 are spaced apart from each other. The first line head 1 and the second line head 2 are shifted from each other in the head longitudinal direction Y so that the actuator block 40 of one line head is located between the actuator blocks 40 and 40 of the other line head with respect to the head longitudinal direction Y. The actuator blocks 40 of the first line head 1 and the second line head 2 as a whole are arranged in a staggered pattern. Each actuator block 40 of the first line head 1 and an adjacent actuator block 40 of the second line head 2 are spaced apart from each other with respect to the scanning direction X, but partially overlap with each other with respect to the head longitudinal direction Y. As a result of such an arrangement pattern, the actuator blocks 40 are as a whole in a continuous arrangement with no gap therebetween in the head longitudinal direction Y.

Figure 4:
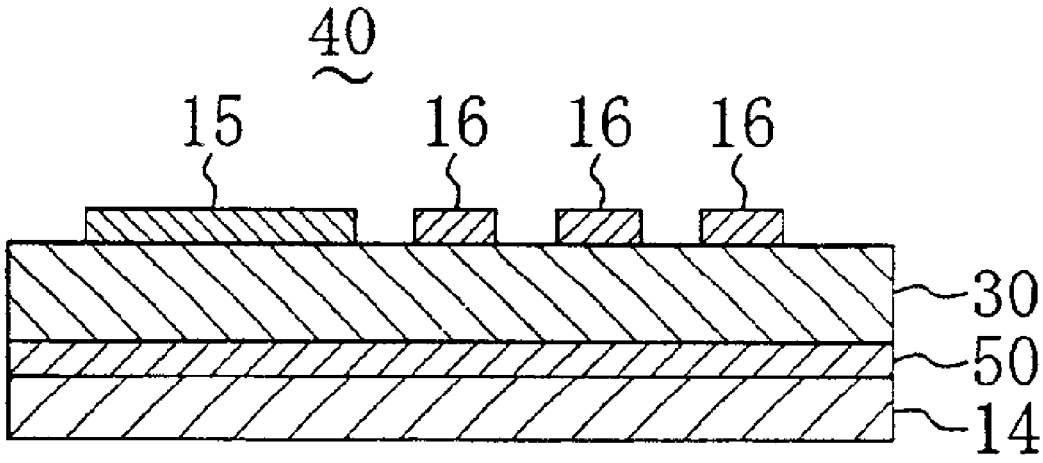
FIG. 4 is a cross-sectional view taken along line B—B of FIG. 2.

The actuator block 40 is provided with a piezoelectric element 30, being a perovskite-type dielectric thin film having a thickness of 0.5 $\mu$m to 8 $\mu$m and made of PZT (see FIG. 4). First electrodes 15 for providing potentials individually, lead sections 16 for supplying a voltage to the first electrodes 15, and input terminals 17 connected to an FPC 13 as a control plate, are arranged on the surface of each piezoelectric element 30. The first electrodes 15 and the lead sections 16 are made of a conductive material (e.g., Pt) having a thickness of about 0.1 $\mu$m.

Figure 3:
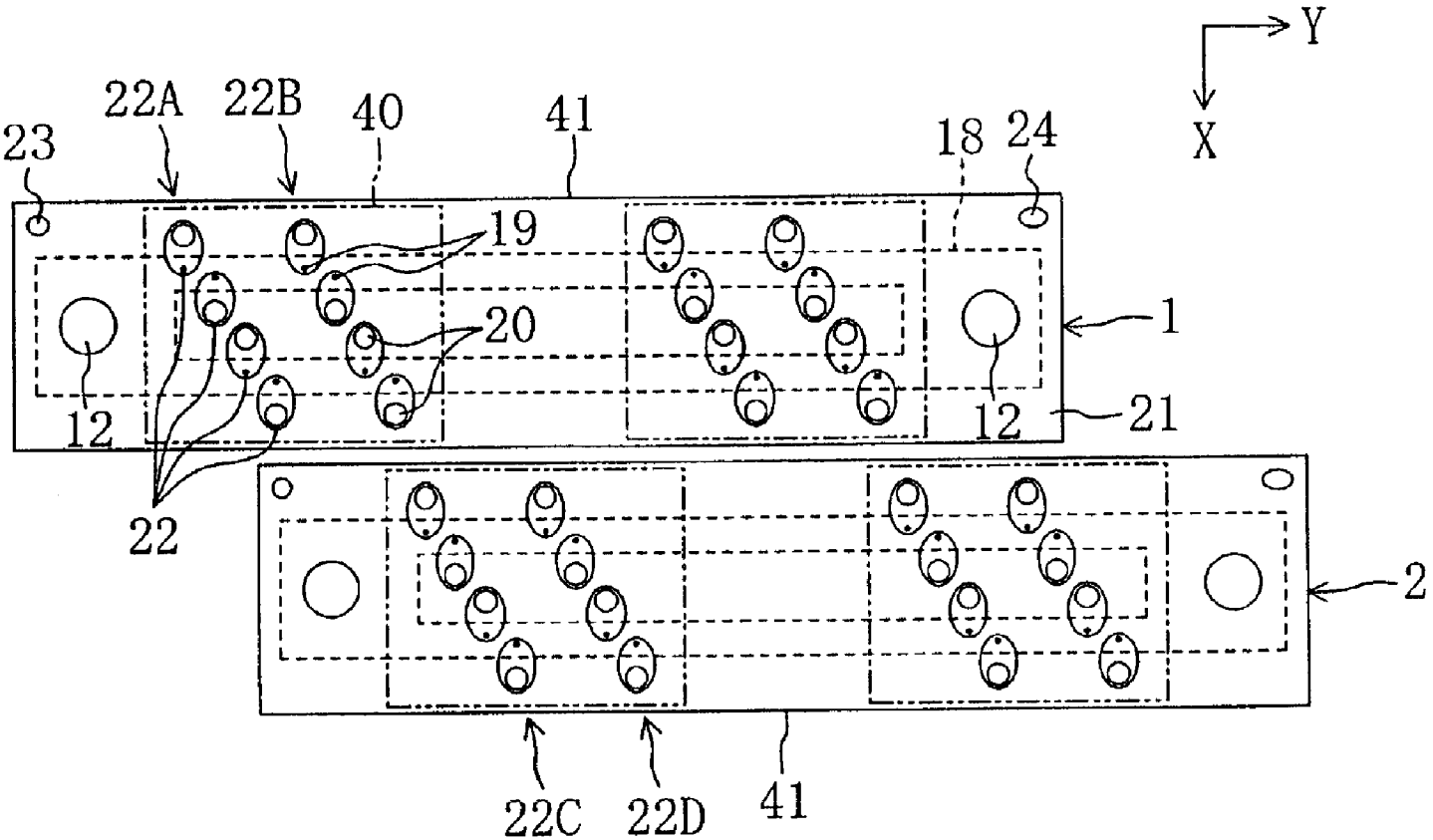
FIG. 3 is a plan view illustrating a pressure chamber block of an ink jet head according to Embodiment 1.
Figure 5:
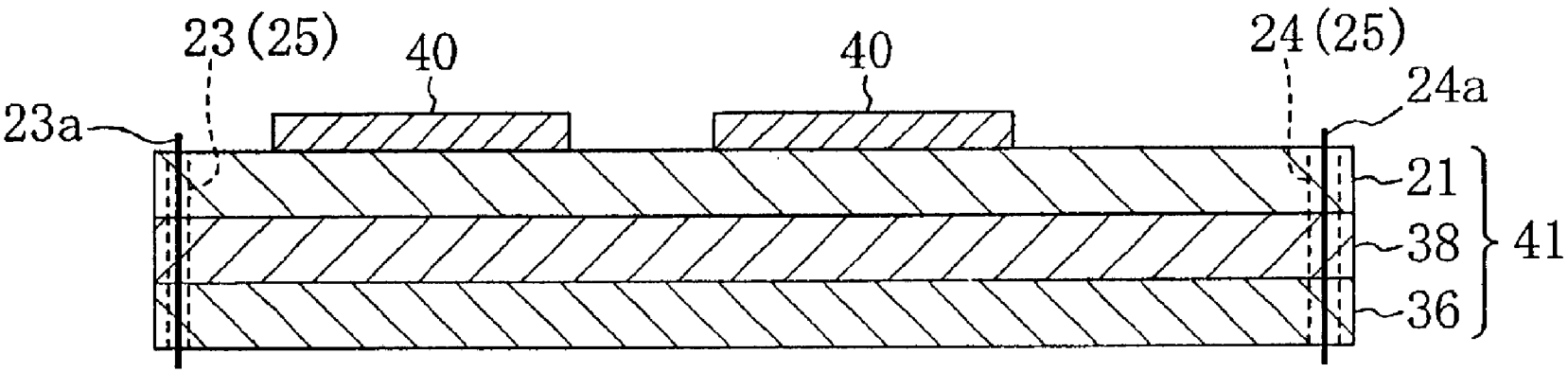
FIG. 5 is a cross-sectional view taken along line C—C of FIG. 2.
Figure 6:
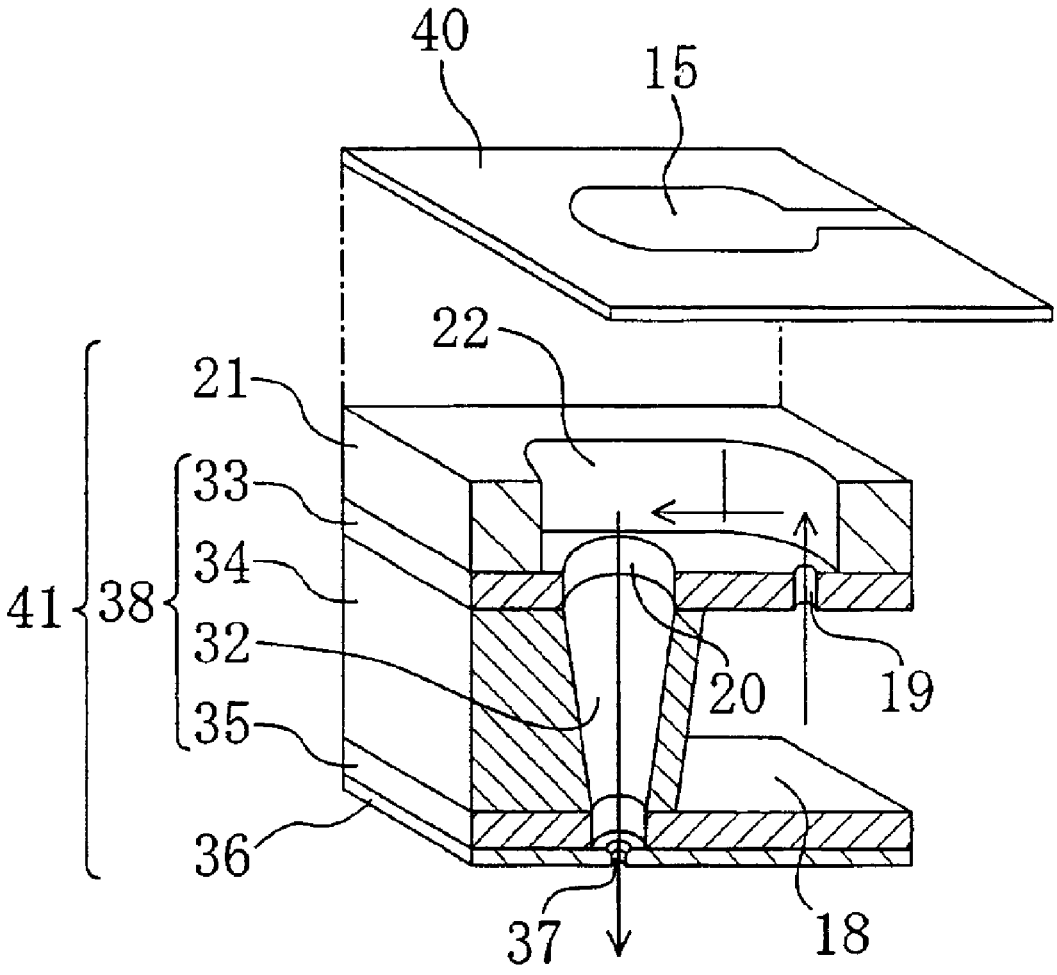
FIG. 6 is a perspective view illustrating an important part of a head including a cross section along line A—A of FIG. 2.

As illustrated in FIG. 5 and FIG. 6, the pressure chamber block 41 includes a pressure chamber plate 21, a channel plate 38 and a nozzle plate 36 layered on one another. As illustrated in FIG. 3, the pressure chamber plate 21 is provided with an ink introduction port 12 for introducing an ink therethrough from the ink tube 10, and the ink tube 10 is fitted into the ink introduction port 12.

As illustrated in FIG. 4, in the actuator block 40, a second electrode 50 made of a conductive material such as Pt, Cu or Ti is layered on a vibration plate 14 made of nickel, chrome, an oxide of silicon, or ceramics, etc. The second electrode 50 is a common electrode for giving a common potential to each piezoelectric element 30 in the actuator block 40. The piezoelectric element 30 is layered on the second electrode 50, and the first electrodes 15 and the lead sections 16 are layered on the piezoelectric element 30. As illustrated in FIG. 2, each actuator block 40 covers a plurality of pressure chambers 22, 22, . . . , of the pressure chamber block 41. Each portion of the actuator block 40 above each pressure chamber 22 is an actuator section for increasing or decreasing the volume of the pressure chamber 22 through flexural deformation. Therefore, each actuator block 40 includes a number of actuator sections for the pressure chambers 22, 22, . . . Note that in order to allow for a high density arrangement, it is preferred that the thickness of the actuator block 40 is 8 $\mu$m or less.

Next, the configuration of the line heads 1 and 2 will be described in detail. Note however that since the first line head 1 and the second line head 2 are line heads of the same shape, only the first line head 1 will be described below, and the description of the second line head 2 will be omitted.

FIG. 5 is a cross-sectional view taken along line C—C of FIG. 2. As illustrated in FIG. 5, the first line head 1 includes one pressure chamber plate 21, one channel plate 38 and one nozzle plate 36 attached together. The pressure chamber plate 21, the channel plate 38 and the nozzle plate 36 are precisely aligned with one another by alignment means 25. In the present embodiment, the alignment means 25 includes through holes 23 and 24 through which positioning pins 23*a* and 24*a* are passed, respectively. Thus, the nozzle plate 36, the channel plate 38 and the pressure chamber plate 21 are precisely aligned with one another, by laying them on one another so that the positioning pins 23*a* and 24*a* pass through the through holes 23 and 24, respectively, in the plates. Note that the through hole 23 is a circular hole and the through hole 24 is an elliptical hole.

Note however that the alignment means 25 is not limited to physical means, but may be other means. For example, an alignment marker may be provided on each plate, and the plates may be aligned with one another using optical means.

FIG. 6 is a perspective view illustrating an important part including a cross section along line A—A of FIG. 2. As illustrated in FIG. 6, the pressure chamber plate 21 is provided with the pressure chamber 22. The channel plate 38 includes a first plate 33 in which an ink channel inlet 20 and an ink supply port 19 are provided, a second plate 34 in which an ink channel 32 and a common liquid chamber 18 are formed, and a third plate 35 in which a hole for introducing the ink from the ink channel 32 to a nozzle 37 is formed. The channel plate 38 is made of a metal material such as SUS, a photosensitive glass, a resin material, etc. The nozzle plate 36 is made of a metal material such as SUS, or a resin material such as PI (polyimide) having a thickness of 20 $\mu$m to 150 $\mu$m. The nozzle 37 is provided in the nozzle plate 36. The ink flows through the head as follows: the common liquid chamber 18→the ink supply port 19→the pressure chamber 22→the ink channel inlet 20→the ink channel 32→the nozzle 37, and flies out of the nozzle 37, after which it lands on the recording medium 9.

As illustrated in FIG. 3, the pressure chambers 22 are arranged at an interval of 600 dpi (42.3 $\mu$m) in the head longitudinal direction Y. Note however that the pressure chambers 22 are not arranged in a single row in the head longitudinal direction Y, but are appropriately shifted from one another in the scanning direction X in order to increase the head density. Specifically, pressure chamber rows 22A and 22B are formed in the pressure chamber plate 21, each pressure chamber row including four pressure chambers 22 arranged in a direction that is inclined with respect to the head longitudinal direction Y. In other words, each of the pressure chamber rows 22A and 22B includes four pressure chambers 22 arranged in an upper left to lower right direction in FIG. 3. The pressure chamber rows 22A are adjacent to the pressure chamber rows 22B in the head longitudinal direction Y. A plurality of such pressure chamber rows 22A and 22B are arranged at a predetermined interval in the head longitudinal direction Y. Note that although only two sets of pressure chamber rows 22A and 22B are shown in FIG. 2 and FIG. 3 for the sake of simplicity, a large number of pressure chamber rows 22A and 22B are actually formed in the head longitudinal direction Y.

The ink supply port 19 and the ink channel inlet 20 are provided on the bottom surface of each pressure chamber 22. The ink supply port 19 communicates the common liquid chamber 18 and the pressure chamber 22 to each other. The inside of the common liquid chamber 18 is filled with an ink. The common liquid chamber 18, in its central portion thereof, diverges into two liquid chamber rows extending in the head longitudinal direction Y, and the two liquid chamber rows merge together at both ends thereof. The ink tube port 12 is provided in the end portions so that the ink is supplied through the ink tube ports 12 to the common liquid chamber 18.

FIG. 7A to FIG. 7I are process diagrams illustrating a method for manufacturing the line heads 1 and 2, each showing a cross section taken along line B—B of FIG. 2. Next, a method for manufacturing a line head using a transfer process will be described with reference to FIG. 7A to FIG. 7I.

First, a substrate 60 having a size of 20 mm×25 mm and made of MgO, Si, SUS, etc., is provided. In the present embodiment, an MgO substrate is used.

Figure 7F:
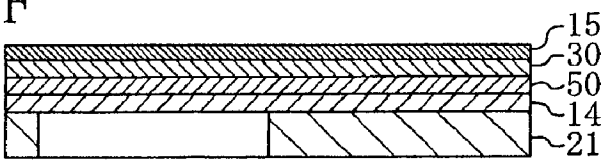
FIG. 7A to FIG. 7I are process diagrams illustrating a method for manufacturing a line head.
Figure 7G:
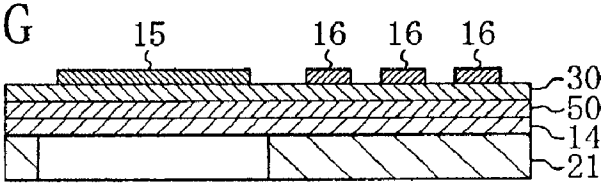
Figure 7H:
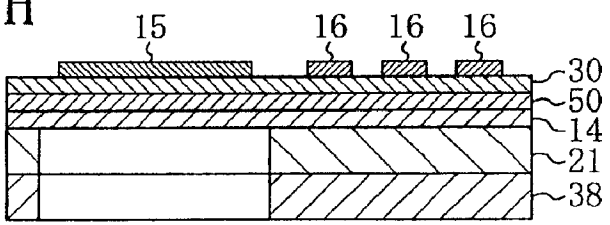
Figure 7I:
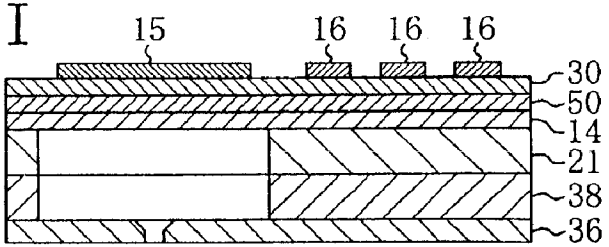
Figure 7A:
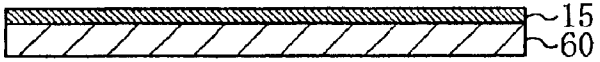

Then, as illustrated in FIG. 7A, the first electrode 15 made of platinum is formed on the substrate 60 by an RF sputtering (radio frequency sputtering) method.

Figure 7B:
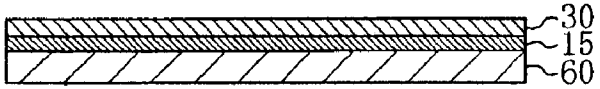

Then, as illustrated in FIG. 7B, the piezoelectric element 30 made of a PZT thin film is formed on the first electrode 15 by an RF sputtering method. Particularly, when a single crystal substrate of MgO is used as the substrate 60, and the piezoelectric element 30 is produced after the first electrode 15 made of platinum is formed on the (100) plane of the MgO substrate 60, the piezoelectric element 30 has stable properties with a high piezoelectric property.

Figure 7C:
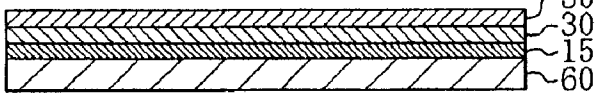

Then, as illustrated in FIG. 7C, the second electrode 50 made of platinum is formed on the piezoelectric element 30 by an RF sputtering method.

Figure 7D:
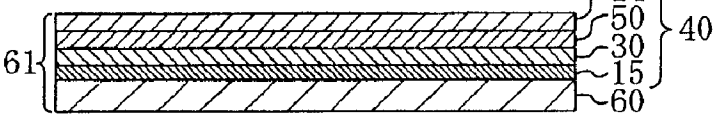

Then, as illustrated in FIG. 7D, the vibration plate 14 made of chrome is formed on the second electrode 50 by an RF sputtering method. At this stage, a substrate block 61 is completed. Note that the substrate block 61 is a member used for transferring the actuator block 40 from the substrate 60 onto the pressure chamber plate 21, and includes the substrate 60 and the actuator block 40.

Figure 7E:
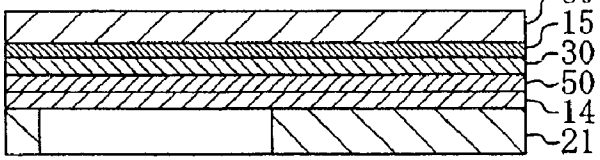

Then, as illustrated in FIG. 7E, a uniform electrodeposition resin layer (not shown) is formed on the pressure chamber plate 21 by using an electrodeposition process, after which a plurality of substrate blocks 61 are attached to the pressure chamber plate 21 so that the vibration plate 14 and the pressure chamber plate 21 contact each other via the electrodeposition resin layer being sandwiched therebetween. In the attachment of the substrate blocks 61, it is ensured that the substrate blocks 61 and 61 do not contact each other so as to uniformly and reliably attach the vibration plate 14 to the pressure chamber plate 21. Specifically, the substrate blocks 61 and 61 are spaced apart from each other so as to provide a gap between adjacent substrate blocks 61 and 61 (see FIG. 2).

In the line heads 1 and 2 of the present embodiment, the nozzles 37, 37, . . . , are arranged at a small pitch for a high density in the head longitudinal direction Y. Therefore, when one attempts to arrange the substrate blocks 61 in a single row with no gap therebetween, even a slight error in the size or shape among the substrate blocks 61 or a slight error in the arrangement may result in the substrate blocks 61 and 61 overlapping each other. If such a contact between the substrate blocks 61 and 61 occurs, the yield lowers. In view of this, in the present embodiment, the two line heads 1 and 2 are shifted from each other in the head longitudinal direction by a distance that is one half of the pitch of the substrate blocks 61 so as to accommodate densely arranged nozzles. In this way, for the line heads 1 and 2 as a whole, the nozzles 37, 37, . . . , are arranged with a high density at a predetermined pitch in the head longitudinal direction Y, and the pressure chambers 22, 22, . . . , are also arranged with a high density in the head longitudinal direction Y. Moreover, the substrate blocks 61 are also arranged with no gap therebetween in the head longitudinal direction Y.

After the attachment of the substrate blocks 61 as described above, the substrate 60 is etched away by using an acidic solution, as illustrated in FIG. 7F.

Then, a mask (not shown) produced by an aligner with a high precision is positioned by using the alignment means 25 provided in the pressure chamber plate 21, after which the first electrode 15 is patterned so as to form the first electrodes 15 and the lead sections 16 in a predetermined shape, as illustrated in FIG. 7G. Thus, the first electrodes 15 and the lead sections 16 can be formed with a high precision by aligning the pressure chamber plate 21 and the mask with each other by using the alignment means 25.

Then, as illustrated in FIG. 7H, the pressure chamber plate 21 and the channel plate 38 are positioned with respect to each other by using the alignment means 25 provided in the pressure chamber plate 21, and then attached to each other.

Then, as illustrated in FIG. 7I, the channel plate 38 and the nozzle plate 36 are positioned with respect to each other by using the alignment means 25 provided in the pressure chamber plate 21 or the channel plate 38, and then attached to each other. In this way, a line head, in which the various plates are precisely aligned with one another, is completed.

Note that, in the present embodiment, the attachment process is performed in the following order: the pressure chamber plate 21→the channel plate 38→the nozzle plate 36. Alternatively, the pressure chamber plate 21 and the channel plate 38 may be attached to each other after attaching the channel plate 38 and the nozzle plate 36 to each other.

Figure 8:
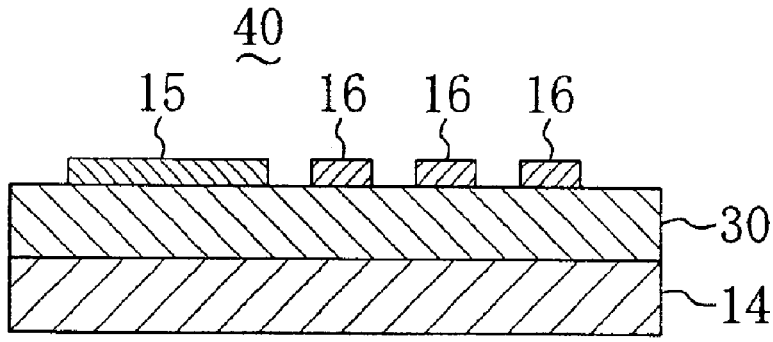
FIG. 8 is a view corresponding to FIG. 4 according to a variation of Embodiment 1.

Moreover, in the present embodiment, the vibration plate 14 and the second electrode 50 are formed separately (see FIG. 4). However, in a case where the vibration plate 14 is made of a conductive material such as chrome, the vibration plate 14 may function also as the second electrode 50. Therefore, a second electrode and vibration plate 14 may be provided, as illustrated in FIG. 8, without separately providing the vibration plate 14 and the second electrode 50.

Moreover, a conductive material such as Cu or Ti may be provided as an intermediate layer between the piezoelectric element 30 and the vibration plate 14 for the purpose of improving the voltage endurance and increasing the attachment strength.

Figure 9:
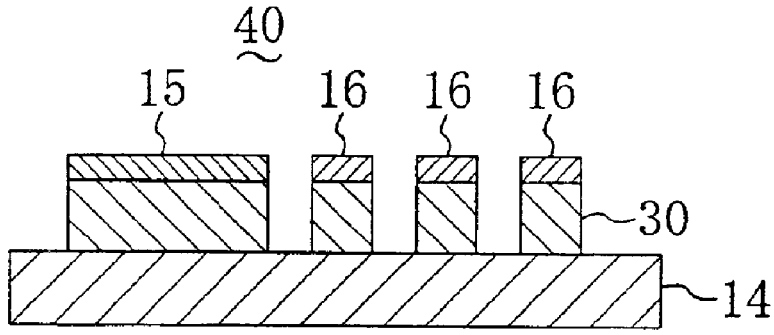
FIG. 9 is a view corresponding to FIG. 4 according to a variation of Embodiment 1.

Moreover, the piezoelectric element 30 may be patterned and divided along with the first electrode 15, as illustrated in FIG. 9. In this way, the vibration plate 14 is more flexible so that a greater displacement can be obtained with the same voltage being applied.

Figure 10:
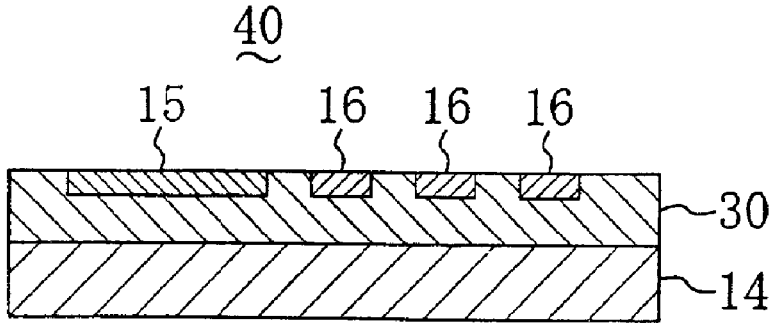
FIG. 10 is a view corresponding to FIG. 4 according to a variation of Embodiment 1.

Moreover, by patterning the first electrode 15 immediately after the formation of the first electrode 15 on the substrate 60 as illustrated in FIG. 7A, the piezoelectric element 30 can be provided around the first electrodes 15 and the lead sections 16, as illustrated in FIG. 10. In this way, the voltage endurance of the first electrodes 15, the lead sections 16 and the vibration plate 14 can be improved.

Moreover, while the first electrode and the second electrode are the separate electrode and the common electrode, respectively, in the present embodiment, they may be reversed. That is, the first electrode and the second electrode may alternatively be the common electrode and the separate electrode, respectively.

Figure 11:
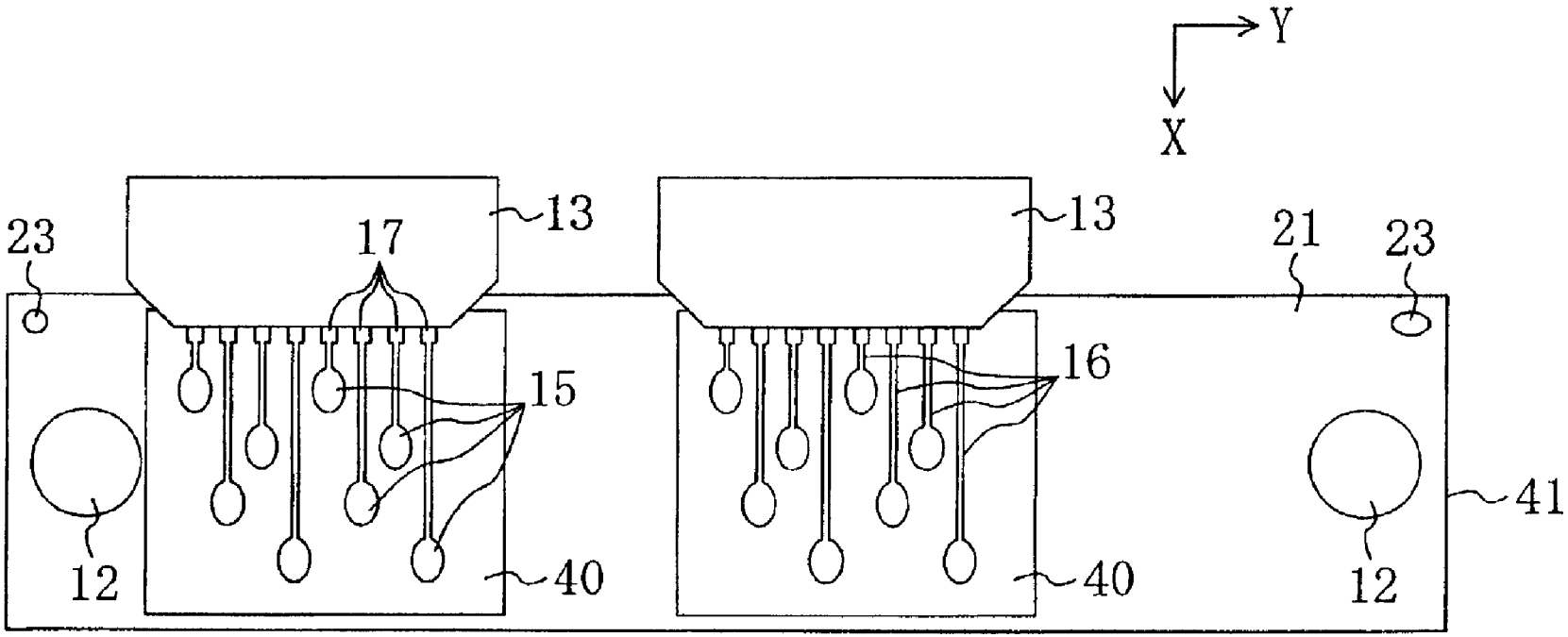
FIG. 11 is a plan view illustrating a line head according to a variation of Embodiment 1.

Moreover, in the present embodiment, the pressure chambers 22, 22, . . . , of the pressure chamber rows 22A and 22B are arranged in a single row, as illustrated in FIG. 3. Alternatively, the pressure chambers 22, 22, . . . , may be arranged alternately in the head longitudinal direction Y, as illustrated in FIG. 11, for example. In other words, the pressure chambers 22, 22, . . . , may be arranged in a zigzag pattern. In this way, the distance between adjacent pressure chambers 22 and 22 increases, whereby crosstalk is less likely to occur. Thus, it is possible to further reduce the interval of the pressure chambers in the head longitudinal direction Y and thus to arrange the pressure chambers 22 with an even higher density.

According to the present embodiment, each actuator includes a plurality of actuator blocks 40, with a plurality of actuator blocks 40 being arranged for each pressure chamber block 41, whereby it is possible to reduce the size of each actuator block 40. Therefore, a transfer process can be effectively utilized.

Moreover, the ink jet head 5 includes the two line heads 1 and 2, in each of which the actuator blocks 40 are arranged so as to be spaced apart from one another, whereby it is possible to prevent the actuator blocks 40 and 40 from overlapping each other. On the other hand, for the line heads 1 and 2 as a whole, the actuator blocks 40 are arranged with no gap therebetween in the head longitudinal direction Y, whereby the actuators can be formed for all of the nozzles 37 and the pressure chambers 22.

Moreover, in the present embodiment, the first line head 1 and the second line head 2 are line heads of the same shape. Thus, the ink jet head 5 is provided by combining together a plurality of line heads of the same type. Therefore, it is not necessary to manufacture two types of line heads separately, whereby it is possible to suppress the manufacturing cost.

Moreover, if one of the line heads breaks down, only the line head can be replaced so that it is possible to continue to use the other line head, thereby reducing the maintenance cost as compared to a conventional head in which the entire head is replaced when a portion thereof breaks down.

As described above, according to the present embodiment, it is possible to achieve an improved uniformity of thin film actuators in terms of properties such as the piezoelectric property and the thickness, prevention of a crack occurring in the film, improvement in the manufacturing yield, downsizing of the manufacturing equipment, a cost reduction, etc.

<Embodiment 2>

Figure 12:
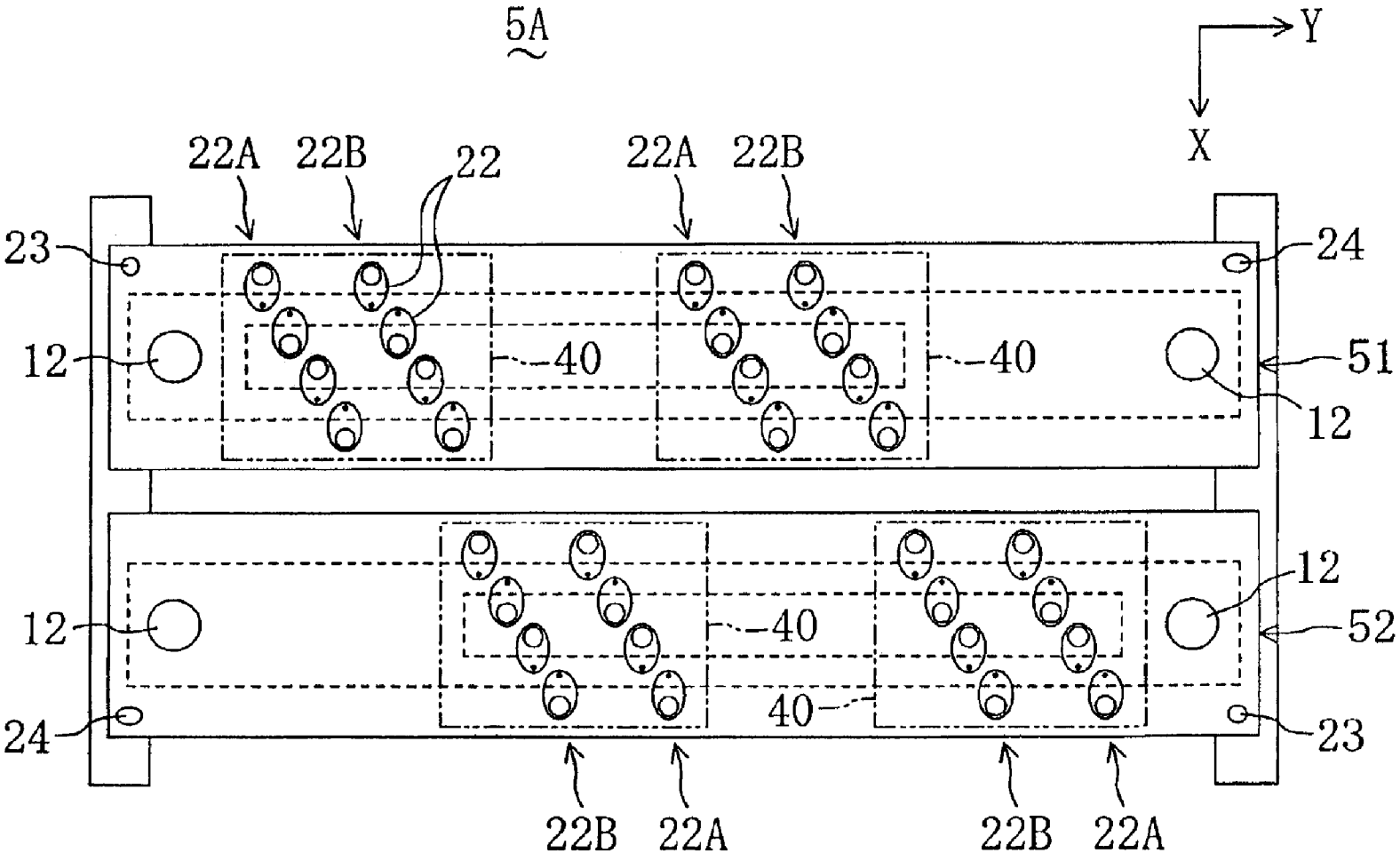
FIG. 12 is a plan view illustrating an ink jet head according to Embodiment 2.

FIG. 12 illustrates a configuration of an ink jet head 5A according to Embodiment 2. Also in Embodiment 2, a first line head 51 and a second line head 52 are heads of the same shape. However, in contrast to Embodiment 1, the line heads 51 and 52 are not shifted from each other, but are arranged in point symmetry with each other. Specifically, in the ink jet head 5A of the present embodiment, one (the first line head 51) of the two line heads 51 and 52 of the same shape is placed in its normal orientation while the other (the second line head 52) is rotated by 180° with respect to the center of the head. Note that only two sets of actuator blocks 40 are shown also in FIG. 12 for the sake of simplicity, a large number of actuator blocks 40 are actually arranged in the head longitudinal direction Y.

The arrangement pattern of the actuator blocks 40, the pressure chambers 22, the nozzles 37, etc., in the line heads 51 and 52 is the same as that of Embodiment 1. In the present embodiment, one end of each of the line heads 51 and 52 is slightly extended in the head longitudinal direction Y, and the line heads 51 and 52 are aligned with each other in the scanning direction X at both ends thereof. Due to the symmetric arrangement of the first line head 51 and the second line head 52, the actuator block 40 of one line head is located between the actuator blocks 40 and 40 of the other line head with respect to the head longitudinal direction Y. Moreover, the actuator block 40 of one line head partially overlaps with the actuator block 40 of the other line head with respect to the head longitudinal direction Y. Also in the present embodiment, the actuator blocks 40 are arranged in a staggered pattern for the ink jet head 5A as a whole.

Therefore, the present embodiment also provides effects as those of Embodiment 1. Furthermore, according to the present embodiment, the first line head 51 and the second line head 52 are aligned with each other at both ends thereof, thereby facilitating the attachment of the line heads 51 and 52.

<Embodiment 3>

Figure 13:
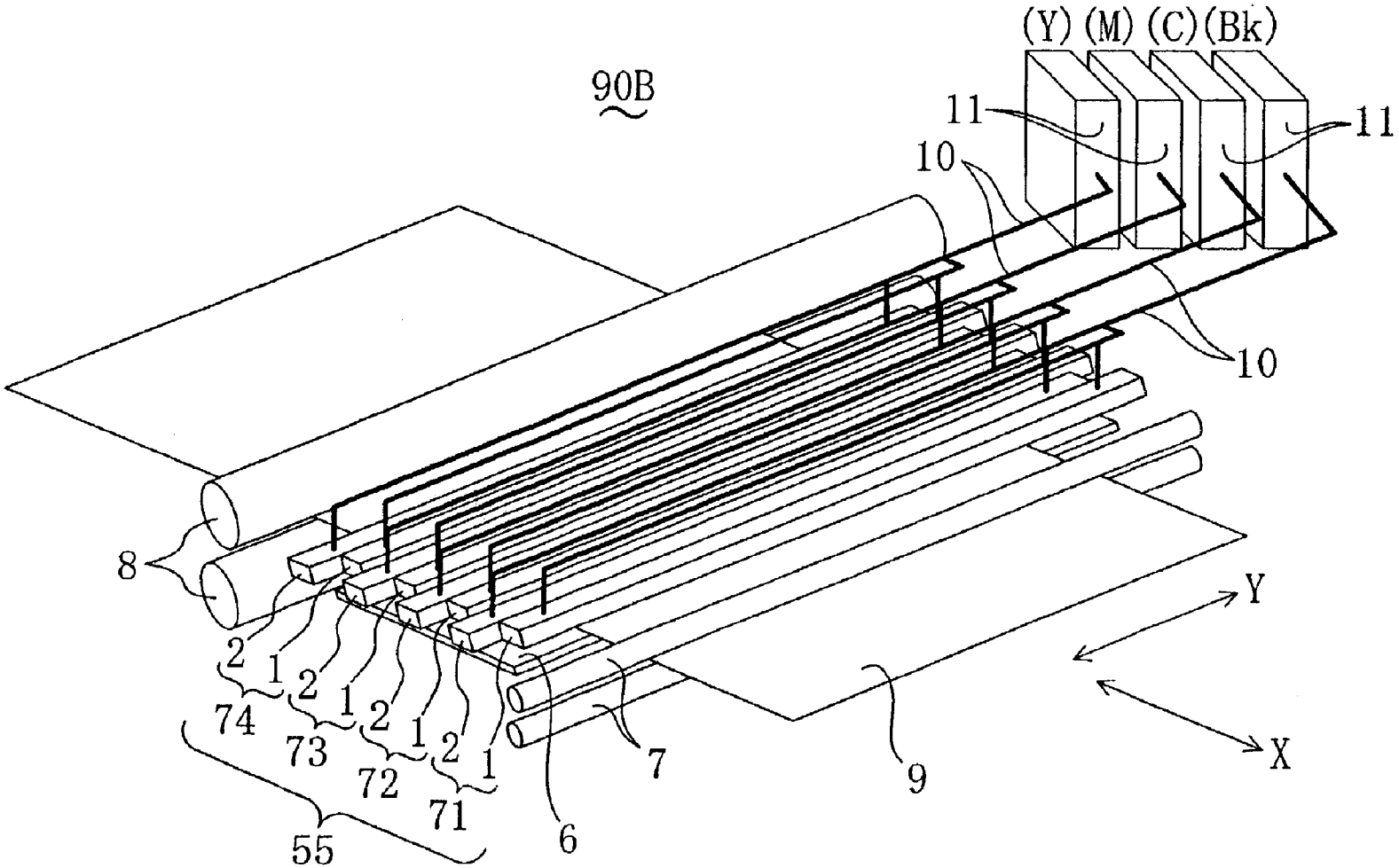
FIG. 13 is a perspective view illustrating an important part of an ink jet recording apparatus according to Embodiment 3.

As illustrated in FIG. 13, an ink jet recording apparatus 90B according to Embodiment 3 includes four sets of the first line head 1 and the second line head 2 of Embodiment 1 for forming a color image.

An ink jet head 55 includes a first head group 71 for discharging a black ink, a second head group 72 for discharging a cyan ink, a third head group 73 for discharging a magenta ink, and a fourth head group 74 for discharging a yellow ink. The first head group 71, the second head group 72, the third head group 73 and the fourth head group 74 are arranged in this order in the scanning direction X. Each of the first to fourth head groups 71 to 74 includes the first line head 1 and the second line head 2 and has a configuration as that of the ink jet head 5 of Embodiment 1. The ink tanks 11 storing a black ink, a cyan ink, a magenta ink and a yellow ink are connected to the first to fourth head groups 71 to 74, respectively, via the ink tubes 10.

The ink jet head 55 according to the present embodiment includes the plurality of head groups 71 to 74 for discharging inks of different colors, whereby effects as those of Embodiment 1 can be obtained with an ink jet recording apparatus that forms a color image.

Note that one or more of the first to fourth head groups 71 to 74 may be provided by using the first line head 51 and the second line head 52 of Embodiment 2. In such a case, effects as those of Embodiment 2 can be obtained with an ink jet recording apparatus that forms a color image.

<Embodiment 4>

Figure 14:
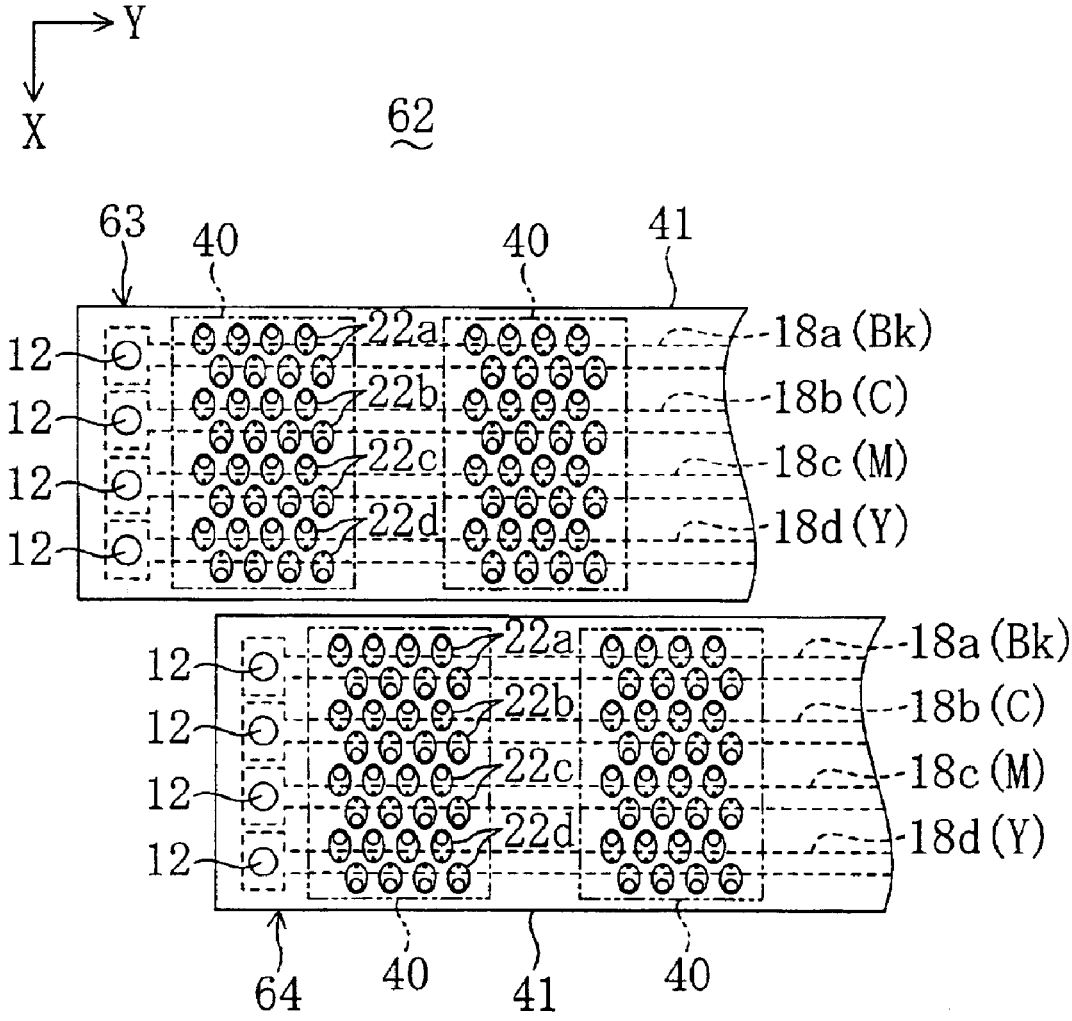
FIG. 14 is a plan view illustrating an ink jet head according to Embodiment 4.

As illustrated in FIG. 14, an ink jet head 62 according to Embodiment 4 is configured so that each of line heads 63 and 64 discharges inks of four colors.

The ink jet head 62 of the present embodiment includes the first line head 63 and the second line head 64 having the same shape. The first line head 63 and the second line head 64 are arranged in the scanning direction X while being shifted from each other in the head longitudinal direction Y.

Each of the line heads 63 and 64 includes pressure chambers 22*a* for a black ink, pressure chambers 22*b* for a cyan ink, pressure chambers 22*c* for a magenta ink, and pressure chambers 22*d* for a yellow ink. For each color of ink, the pressure chambers 22*a* to 22*d* are arranged in a staggered pattern, and are arranged in the head longitudinal direction Y at a pitch of 600 dpi. The pressure chambers 22*a* to 22*d* for different color inks are arranged so as to be aligned with one another in the scanning direction X.

A common liquid chamber 18*a* for a black ink, a common liquid chamber 18*b* for a cyan ink, a common liquid chamber 18*c* for a magenta ink, and a common liquid chamber 18*d* for a yellow ink, are arranged in the scanning direction X. Each of the common liquid chambers 18*a* to 18*d* extends in the head longitudinal direction Y, and is provided with the ink tube port 12 at both ends thereof.

Each actuator block 40 covers a plurality of pressure chambers 22*a* to 22*d*. Specifically, the pressure chambers 22*a* to 22*d* for four colors are covered together by a single actuator block 40. Note that the arrangement pattern of the actuator blocks 40 is as that of Embodiment 1.

In the ink jet head 62 of the present embodiment, the pressure chambers 22*a* to 22*d* for four colors are covered by a single actuator block 40, whereby the pressure chambers can be arranged at a higher density. Moreover, it is possible to increase the number of actuators included in each actuator block 40. Therefore, it is possible to downsize the head, reduce the number of manufacturing steps, and reduce the cost.

Note that while the first line head 63 and the second line head 64 are shifted from each other in the head longitudinal direction Y in the present embodiment as in Embodiment 1, it is needless to say that the first line head 63 and the second line head 64 may alternatively be arranged in point symmetry with each other as in Embodiment 2.

<Embodiment 5>

In Embodiment 3, four sets of first and second line heads are provided, and inks of four colors of black, cyan, magenta and yellow are used. Alternatively, two, three, five or more sets of first and second line heads may be provided, and inks of two, three, five or more colors may be used.

Moreover, in Embodiment 4, pressure chambers for two, three, five or more colors may alternatively be provided for each line head, instead of providing pressure chambers for four colors.

Moreover, different types of inks of the same color may alternatively be used.

<Embodiment 6>

Figure 15:
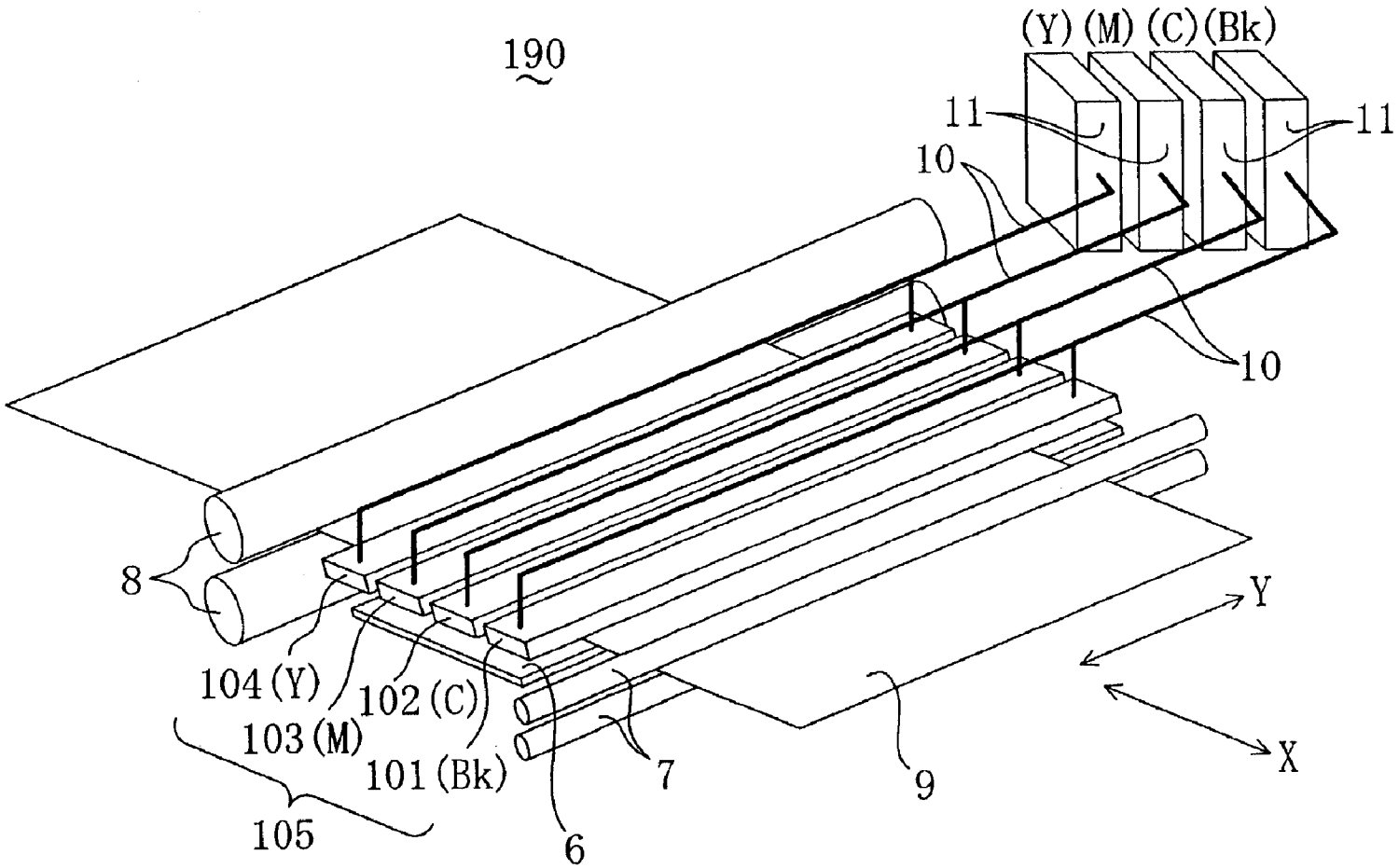
FIG. 15 is a perspective view illustrating an important part of an ink jet recording apparatus according to Embodiment 6.

As illustrated in FIG. 15, an ink jet recording apparatus 190 according to Embodiment 6 is a line head type recording apparatus that discharges inks of four colors, and includes an ink jet head 105 including four independent line heads 101 to 104. Reference numeral 101 is a first line head for discharging a black ink (Bk), 102 is a second line head for discharging a cyan ink (C), 103 is a third line head for discharging a magenta ink (M), and 104 is a fourth line head for discharging a yellow ink (Y). The ink jet head 105 of the present embodiment is obtained by assembling the first to fourth line heads 101 to 104 together so that black, cyan, magenta and yellow inks are discharged in this order. The line heads 101 to 104 extend in the width direction of the recording medium 9, and the head longitudinal direction Y is perpendicular to the scanning direction X. The line heads 101 to 104 are connected to the ink tanks 11 storing the respective color inks via the ink tubes 10.

Figure 16:
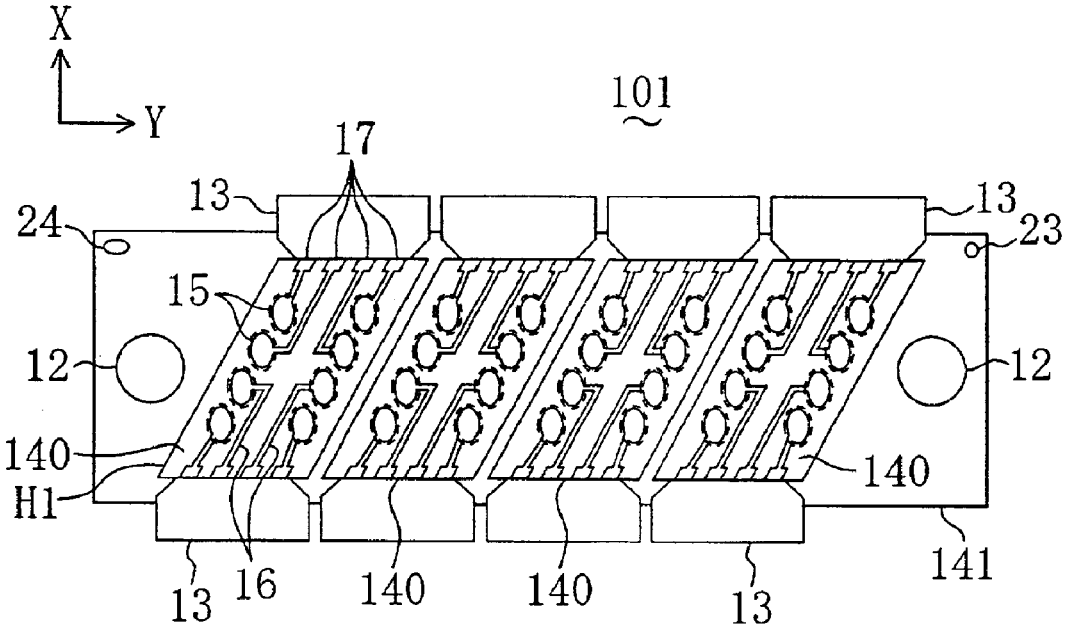
FIG. 16 is a plan view illustrating a line head according to Embodiment 6.
Figure 17:
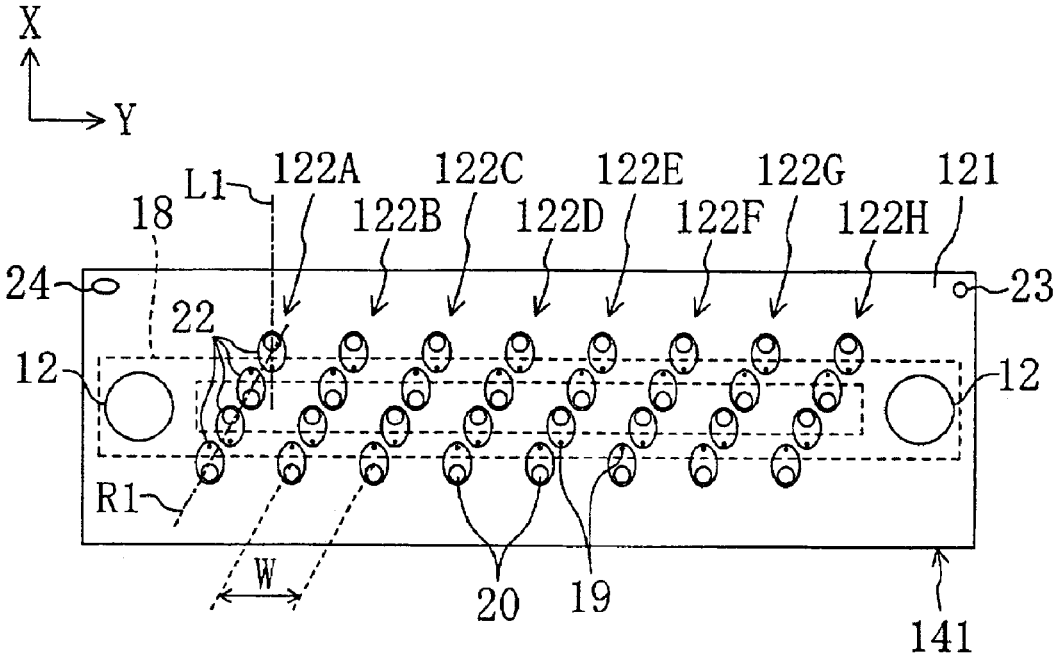
FIG. 17 is a plan view illustrating a pressure chamber block according to Embodiment 6.

Referring to FIG. 16 and FIG. 17, the configuration of the line heads will be described. Note however that since the first to fourth line heads 101 to 104 are heads of the same shape, only the first line head 101 will be described below, and the description of the other line heads 102 to 104 will be omitted.

As illustrated in FIG. 16, the line head 101 includes one pressure chamber block 141, and a plurality of actuator blocks 140 attached to the pressure chamber block 141. Each actuator block 140 is formed in a parallelogram shape having a side that is parallel to the longitudinal direction of the pressure chamber block 141, i.e., the head longitudinal direction Y, and another side that is inclined from the head longitudinal direction Y. The actuator blocks 140 are arranged at a predetermined interval in the head longitudinal direction Y, and adjacent actuator blocks 140 and 140 are spaced apart from each other.

The configuration of the actuator block 140 is substantially the same as that of the actuator block 40 of Embodiment 1, and therefore only the difference therebetween will be described below. Moreover, the configuration of the pressure chamber block 141 is substantially the same as that of the pressure chamber block 41 of Embodiment 1, and therefore only the difference therebetween will be described below.

As illustrated in FIG. 17, each pressure chamber 22 is formed to have an elliptical shape in plan view, and a longitudinal direction L1 thereof is perpendicular to the head longitudinal direction Y. In other words, the longitudinal direction L1 of the pressure chamber 22 is parallel to the scanning direction X. The pressure chambers 22 are arranged at an interval of 600 dpi (42.3 $\mu$m) in the head longitudinal direction Y. Note however that the pressure chambers 22 are not arranged in a single row in the head longitudinal direction Y, but are appropriately shifted from one another in the scanning direction X in order to increase the head density.

Specifically, a plurality of pressure chamber rows 122A to 122H are formed in the pressure chamber plate 121, each pressure chamber row including four pressure chambers 22 arranged in a direction that is inclined with respect to the head longitudinal direction Y. In other words, each of the pressure chamber rows 122A to 122H includes four pressure chambers 22 arranged in an upper right to lower left direction in FIG. 17. The pressure chamber rows 122A to 122H are arranged at a constant interval in the head longitudinal direction Y. Note that although only eight sets of pressure chamber rows 122A to 122H are shown in FIG. 16 and FIG. 17 for the sake of simplicity, a large number of pressure chamber rows are actually formed in the head longitudinal direction Y.

A row direction R1 of each of the pressure chamber rows 122A to 122H is parallel to an inclined side H1 (see FIG. 16) of each actuator block 140. As illustrated in FIG. 16, each actuator block 140 covers two pressure chamber rows.

The line heads 101 to 104 can be manufactured in a manner similar to that for the line head of Embodiment 1.

Also in the present embodiment, each actuator includes a plurality of actuator blocks 140, and a plurality of actuator blocks 140 are arranged for each pressure chamber block 141, whereby the size of each actuator block 140 can be reduced. Therefore, a transfer process can be effectively utilized. Thus, it is possible to achieve an improved uniformity of thin film actuators in terms of properties such as the piezoelectric property and the thickness, prevention of a crack occurring in the film, improvement in the manufacturing yield, downsizing of the manufacturing equipment, a cost reduction, etc.

Moreover, in the line heads 101 to 104 of the present embodiment, the nozzles 37, 37, . . . , are arranged at a small pitch for a high density in the head longitudinal direction Y, and the pressure chambers 22 are arranged at a minute interval in the head longitudinal direction Y so as to correspond to the nozzles 37. However, the pressure chambers 22 are not arranged in a single row in the head longitudinal direction Y, but are appropriately shifted from one another in the scanning direction X. Therefore, a large gap is ensured between the pressure chambers 22 next to each other along the same line in the head longitudinal direction Y according to the number of pressure chambers 22 that are shifted in the scanning direction X (three in the present embodiment).

The pressure chamber rows 122A to 122H are formed to be parallel to one another, thereby keeping an interval W (see FIG. 17) between the adjacent ones of the pressure chamber rows 122A to 122H, the interval W corresponding to the total width of a number of pressure chambers. Thus, the pressure chamber rows 122A to 122H are arranged at a relatively wide interval W. Herein, the actuator blocks 140 are formed in a parallelogram shape having a side H1 that is parallel to the row direction R1 of each of the pressure chamber rows 122A to 122H. Therefore, it is possible to cover all the pressure chambers 22 of the pressure chamber block 141 by a plurality of actuator blocks 140 without arranging the actuator blocks 140 with no gap therebetween. Thus, due to the wide interval between the pressure chamber rows 122A to 122H, the pressure chambers 22 of the pressure chamber rows 122A to 122H are reliably covered by the actuator block 140 even if some gap is provided between the actuator blocks 140 and 140.

Therefore, it is not necessary to provide two rows of the actuator blocks 140 in the scanning direction, and it is possible to arrange the actuator blocks 140 in a single row for the pressure chamber block 141. Therefore, the length of the ink jet head 105 in the scanning direction X is reduced, and it is possible to downsize the head. Moreover, since the length in the scanning direction is short, the recording medium 9 is less likely to be bent. Therefore, the interval between the ink jet head 5 and the recording medium 9 is stabilized, and a stable recording operation can be performed.

<Embodiment 7>

Figure 18:
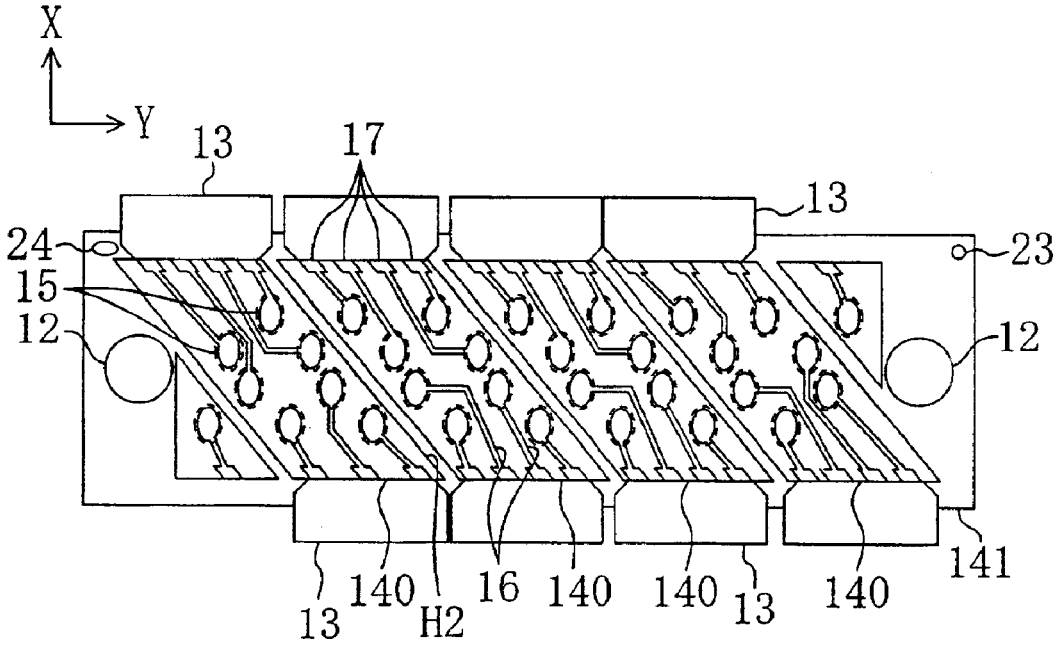
FIG. 18 is a plan view illustrating a line head according to Embodiment 7.
Figure 19:
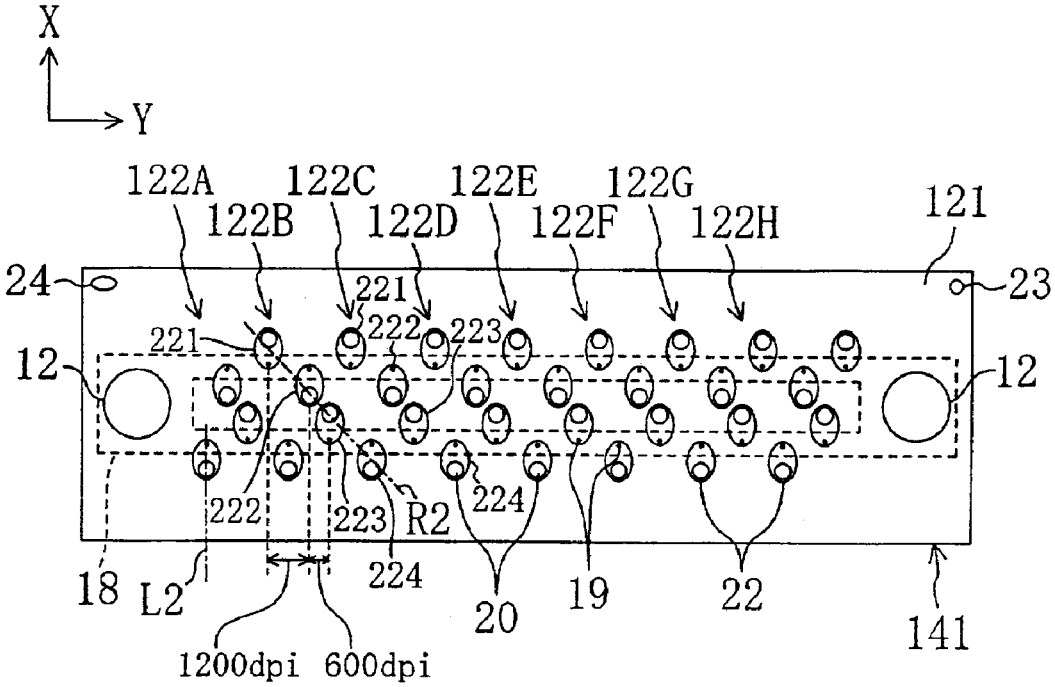
FIG. 19 is a plan view illustrating a pressure chamber block according to Embodiment 7.

As illustrated in FIG. 18 and FIG. 19, a line head of an ink jet head according to Embodiment 7 is similar to the line head of Embodiment 6, but with a modification to the arrangement pattern of the pressure chambers 22 and the actuator blocks 140.

Also in the present embodiment, each pressure chamber 22 is formed in an elliptical shape, and the longitudinal direction L1 is perpendicular to the head longitudinal direction Y. The pressure chambers 22 are arranged while being appropriately shifted from one another in the scanning direction X, and as a whole arranged at a constant interval of 600 dpi (42.3 $\mu$m) in the head longitudinal direction Y.

Also in the present embodiment, a plurality of pressure chamber rows 122A to 122H are formed. In each of the pressure chamber rows 122A to 122H, the pressure chambers 22 are arranged in an upper left to lower right direction in FIG. 19. A row direction R2 of the pressure chamber rows 122A to 122H is parallel to an inclined side H2 (see FIG. 18) of the actuator block 140. Each actuator block 140 covers two pressure chamber rows.

In the pressure chamber rows 122A to 122H of the present embodiment, at least two pressure chambers 22 included in each pressure chamber row are arranged at an interval (1200 dpi) twice as much as the constant interval (600 dpi). Specifically, where the pressure chambers included in each of the pressure chamber rows 122A to 122H are denoted as a first pressure chamber 221, a second pressure chamber 222, a third pressure chamber 223 and a fourth pressure chamber 224, the interval is 600 dpi between the second pressure chamber 222 and the third pressure chamber 223, while the interval is 1200 dpi between the first pressure chamber 221 and the second pressure chamber 222 and between the third pressure chamber 223 and the fourth pressure chamber 224 as illustrated in FIG. 19.

Moreover, at least one pressure chamber included in each pressure chamber row is provided between two pressure chambers included in another adjacent pressure chamber row with respect to the head longitudinal direction Y. For example, the fourth pressure chamber 224 of the pressure chamber row 122B is arranged between the first pressure chamber 221 and the second pressure chamber 222 of the pressure chamber row 122C with respect to the head longitudinal direction Y. Therefore, although there are pressure chambers arranged at an interval of 1200 dpi in each of the pressure chamber rows 122A to 122H, a pressure chamber of another pressure chamber row is located between such pressure chambers, whereby the pressure chambers are arranged at a constant interval of 600 dpi for the head as a whole.

Embodiment 7 provides the following effects in addition to those of Embodiment 6. In the present embodiment, the interval between the first pressure chamber 221 and the second pressure chamber 222 and between the third pressure chamber 223 and the fourth pressure chamber 224 in each pressure chamber row is 1200 dpi, which is twice as much as 600 dpi. Therefore, interference is less likely to occur between actuator sections for these pressure chambers, and crosstalk is less likely to occur. Thus, it is possible to improve the ink discharging performance.

<Embodiment 8>

Figure 20:
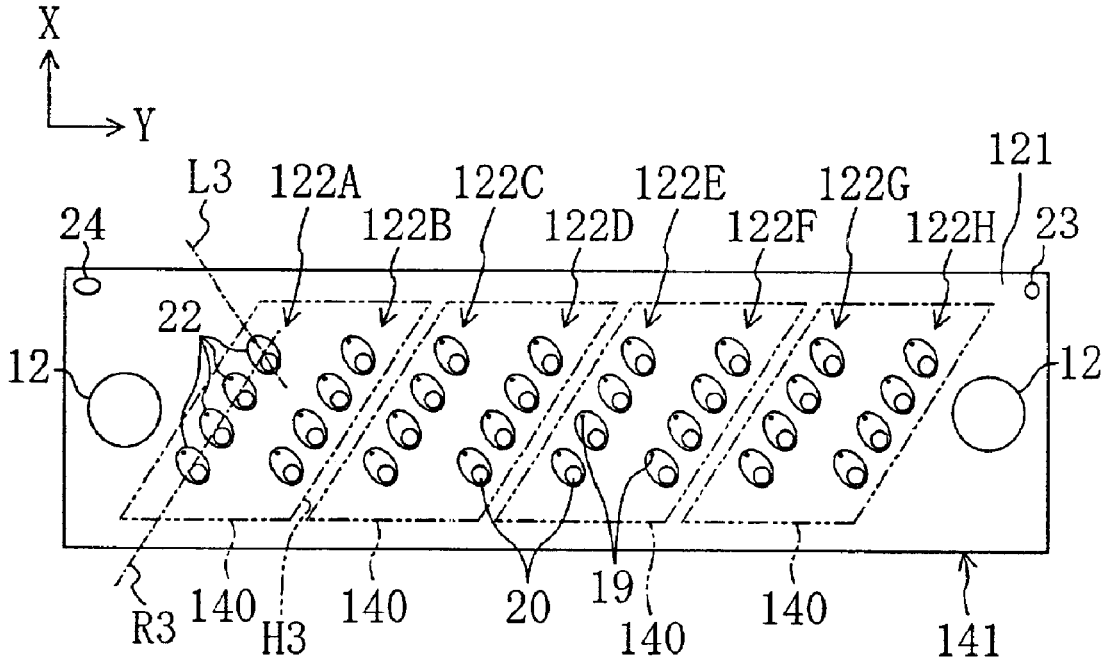
FIG. 20 is a plan view illustrating a pressure chamber block according to Embodiment 8.

As illustrated in FIG. 20, a line head of an ink jet head according to Embodiment 8 is also similar to the line head of Embodiment 6, but with a modification to the arrangement pattern of the pressure chambers 22 and the actuator blocks 140.

Also in the present embodiment, each pressure chamber 22 is formed in an elliptical shape. However, in the present embodiment, a longitudinal direction L3 of the pressure chamber 22 is not perpendicular to the head longitudinal direction Y and is inclined with respect to the scanning direction X.

As in Embodiment 6, the pressure chambers 22 are arranged while being appropriately shifted from one another in the scanning direction X, and arranged at a constant interval of 600 dpi in the head longitudinal direction Y.

Also in the present embodiment, a plurality of pressure chamber rows 122A to 122H are formed. In each of the pressure chamber rows 122A to 122H, the pressure chambers 22 are arranged at the constant interval. Moreover, the pressure chambers 22 and 22 located at ends of adjacent pressure chamber rows are also arranged at the constant interval.

A row direction R3 of the pressure chamber rows 122A to 122H is parallel to an inclined side H3 of the actuator block 140. Each actuator block 140 covers two pressure chamber rows.

Embodiment 8 provides the following effects in addition to those of Embodiment 6. In the present embodiment, the longitudinal direction L3 of the pressure chamber 22 is inclined with respect to the scanning direction X, whereby the interval between the pressure chambers 22 and 22 in the direction perpendicular to the longitudinal direction L3 is greater than that in Embodiment 6. Therefore, crosstalk is even less likely to occur. Conversely, if the interval between the pressure chambers 22 and 22 of Embodiment 8 is set to be substantially equal to the interval between the pressure chambers 22 and 22 of Embodiment 6, the pressure chambers 22 can be arranged at a higher density, thereby facilitating the downsizing of the head.

<Embodiment 9>

Figure 21:
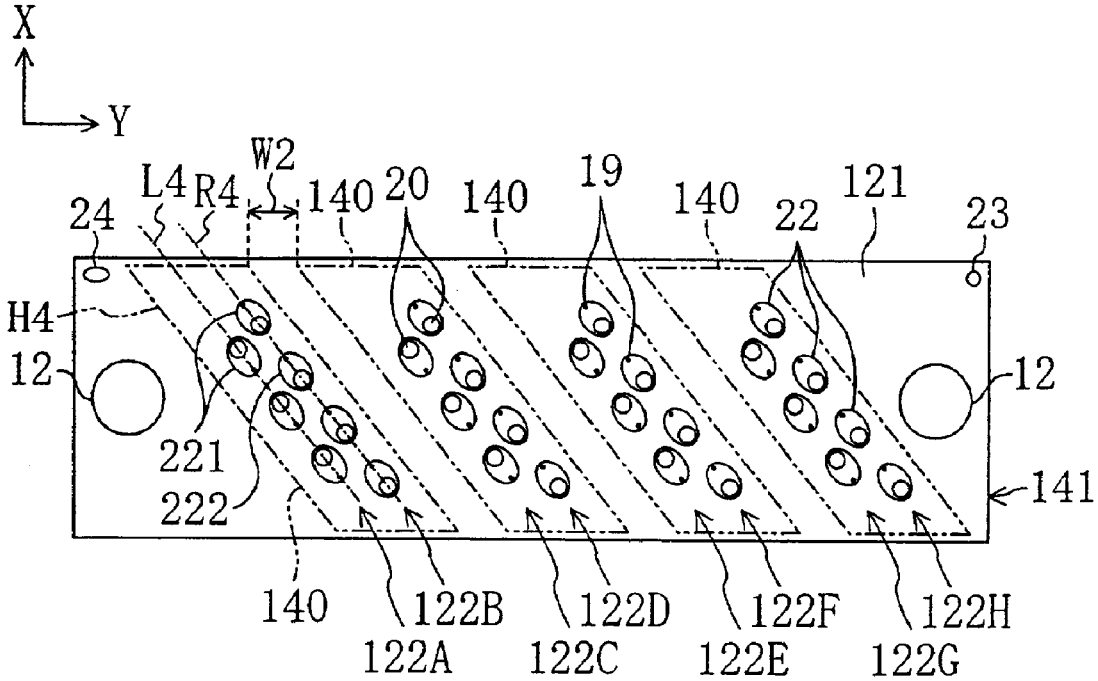
FIG. 21 is a plan view illustrating a pressure chamber block according to Embodiment 9.

As illustrated in FIG. 21, a line head of an ink jet head according to Embodiment 9 is similar to the line head of Embodiment 8, but with a modification to the arrangement pattern of the pressure chambers 22 and the actuator blocks 140.

Also in the present embodiment, each pressure chamber 22 is formed in an elliptical shape, and a longitudinal direction L4 thereof is inclined with respect to the scanning direction X. The pressure chambers 22 are arranged while being appropriately shifted from one another in the scanning direction X, and as a whole arranged at a constant interval of 600 dpi in the head longitudinal direction.

Also in the present embodiment, a plurality of pressure chamber rows 122A to 122H are formed. Note however that one of two adjacent pressure chamber rows includes three pressure chambers arranged therein while the other pressure chamber row includes four pressure chamber rows arranged therein. Specifically, each of the pressure chamber rows 122A, 122C, 122E and 122G includes three pressure chambers 22 arranged therein, while each of the pressure chamber rows 122B, 122D, 122F and 122H includes four pressure chambers 22 arranged therein.

In each of the pressure chamber rows 122A to 122H, the pressure chambers 22 are arranged in an upper left to lower right direction in FIG. 21. A row direction R4 of the pressure chamber rows 122A to 122H is parallel to the longitudinal direction L4 of each pressure chamber 22 and an inclined side H4 of the actuator block 140. Thus, in the present embodiment, the longitudinal direction L4 of the pressure chamber 22, the row direction R4 of the pressure chamber rows and the inclined side H4 of the actuator block 140 are parallel to one another. Each actuator block 140 covers two pressure chamber rows.

In the present embodiment, the pressure chambers of each pressure chamber row are arranged at an interval (1200 dpi) twice as much as the constant interval (600 dpi). Moreover, for adjacent pressure chamber rows, i.e., 122A and 122B, 122C and 122D, 122E and 122F, and 122G and 122H, a pressure chamber of one of the pressure chamber rows is arranged between pressure chambers of the other pressure chamber row. For example, the first pressure chamber 221 of the pressure chamber row 122A is located between the first pressure chamber 221 and the second pressure chamber 222 of the pressure chamber row 122B. With such an arrangement pattern, the pressure chambers 22 are arranged at a constant interval of 600 dpi for the head as a whole, despite that the pressure chambers are arranged at an interval of 1200 dpi in each pressure chamber row.

Moreover, since the longitudinal direction L4 of the pressure chambers 22 and the row direction R4 of the pressure chamber rows are parallel to each other in the present embodiment, the pressure chamber rows can be arranged closely with one another. In view of this, the pressure chamber rows 122A and 122B, 122C and 122D, 122E and 122F, and 122G and 122H, are arranged closely with each other. Conversely, as the pressure chamber rows in each pair are arranged closely with each other, the pressure chamber rows 122B and 122C, 122D and 122E, and 122F and 122G, are arranged relatively away from each other. In other words, in these pairs, the interval between the pressure chamber rows is greater than that of Embodiments 6 to 8.

Thus, in the present embodiment, two pressure chamber rows covered by each actuator block 140 are arranged closely with each other, whereby a side of the actuator block 140 (the side parallel to the head longitudinal direction Y) can be shortened. Therefore, it is possible to further downsize the actuator block 140. Moreover, the interval between the actuator blocks 140 and 140 (an interval W2 in FIG. 21) can be increased. Thus, it is possible to further improve the yield.

<Embodiment 10>

Figure 22:
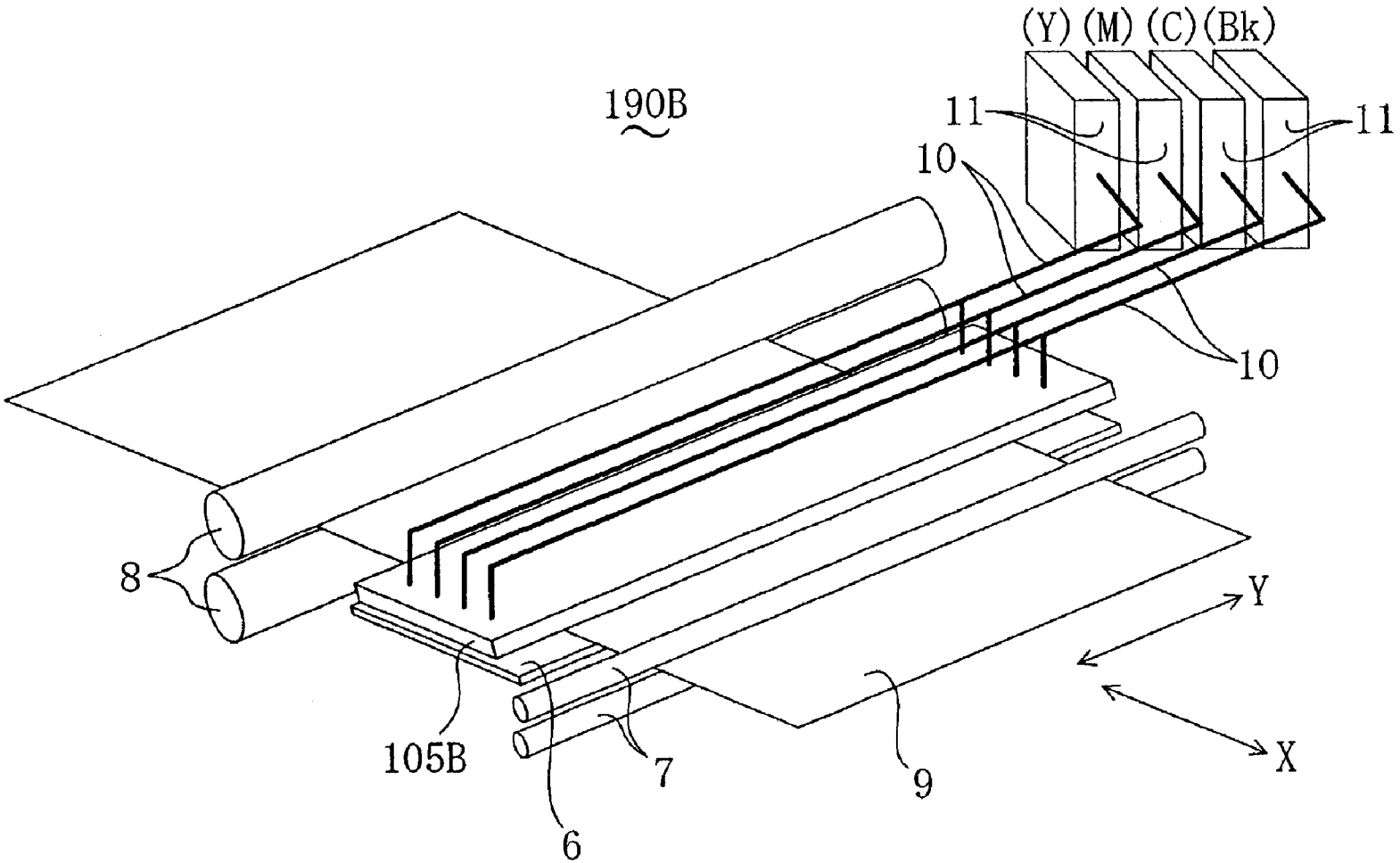
FIG. 22 is a perspective view illustrating an important part of an ink jet recording apparatus according to Embodiment 10.
Figure 23:
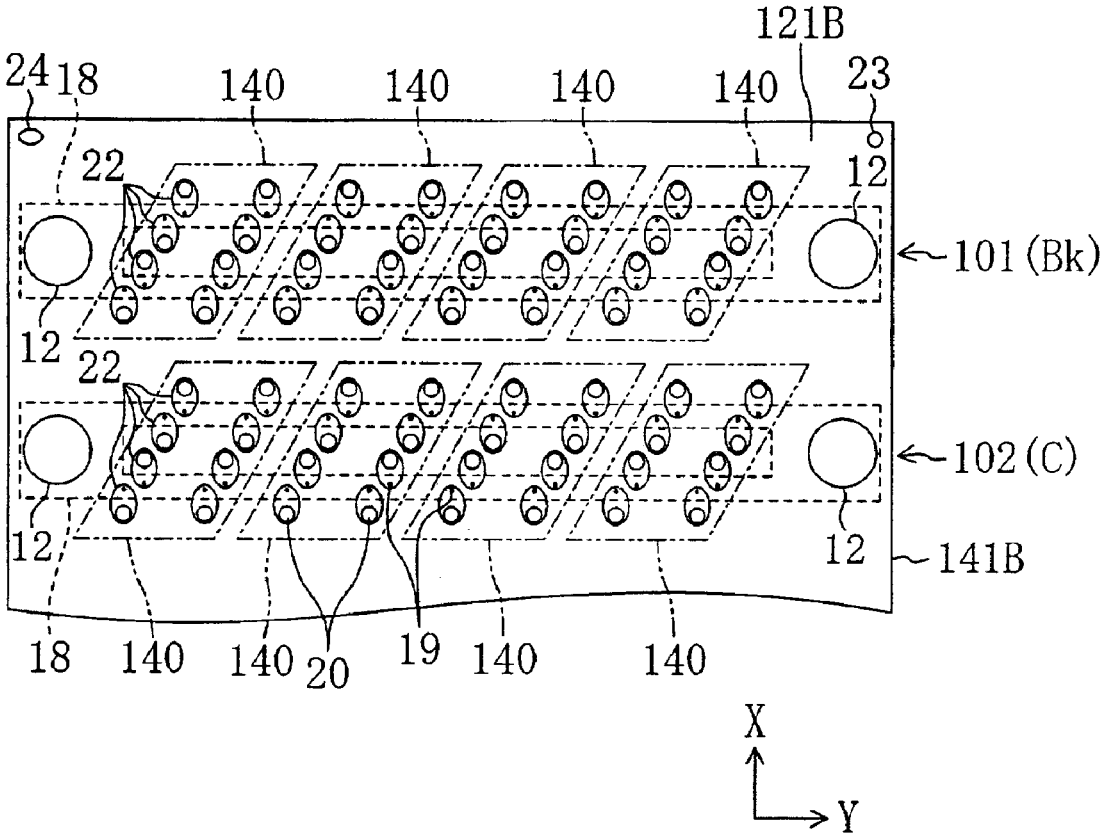
FIG. 23 is a plan view illustrating a pressure chamber block according to Embodiment 10.

In the ink jet heads 105 of Embodiments 6 to 9, the independent line heads 101 to 104 for different colors are assembled together after alignment in the head longitudinal direction Y so as to align the landing positions of the different color inks with one another. In contrast, in an ink jet recording apparatus 190B according to the present embodiment, the line heads for different colors are integrated into an ink jet head 105B, as illustrated in FIG. 22 and FIG. 23. The pressure chambers 22 of different color inks are arranged on the pressure chamber plate 121B, and the different color inks are supplied to the same ink jet head 105B via the ink tubes 10.

As illustrated in FIG. 23, the pressure chambers 22, the common liquid chambers 18, etc., for a black ink (Bk), a cyan ink (C), a magenta ink (M) and a yellow ink (Y) are arranged in a pressure chamber block 141B in this order in the scanning direction X (the pressure chambers, etc., for a magenta ink and a yellow ink are now shown in FIG. 23). For each color, the nozzles and the pressure chambers 22 are arranged at an interval of 600 dpi, and the arrangement pattern of the pressure chambers 22 and the actuator blocks 140 is as that of Embodiment 6. The pressure chambers for a black ink, the pressure chambers for a cyan ink, the pressure chambers for a magenta ink, and the pressure chambers for a yellow ink, are aligned with one another in the scanning direction X. In other words, a pressure chamber of each color ink is arranged along the same line in the scanning direction X with the corresponding pressure chamber of any other color ink. Moreover, the pressure chambers 22 of each color are communicated to the common liquid chamber 18 of that color, and the inks are supplied to the common liquid chambers 18 from the respective ink introduction ports 12.

Where an ink jet head is formed by assembling the independent line heads 101 to 104, it is necessary to precisely align the line heads 101 to 104 with one another. However, according to the present embodiment, it is not necessary to assemble the line heads together. Thus, it is possible to reduce the number of manufacturing steps. Moreover, since a positional shift between the line heads will not occur, a shift in the landing position between different color inks is unlikely to occur.

Note that while the arrangement pattern of the pressure chambers 22 and the actuator blocks 140 in the present embodiment is as that of Embodiment 6, it is needless to say that any of the arrangement patterns of Embodiments 7 to 9 may alternatively be employed. Moreover, two or more of the arrangement patterns of Embodiments 6 to 9 may alternatively be combined together.

<Embodiment 11>

Figure 24:
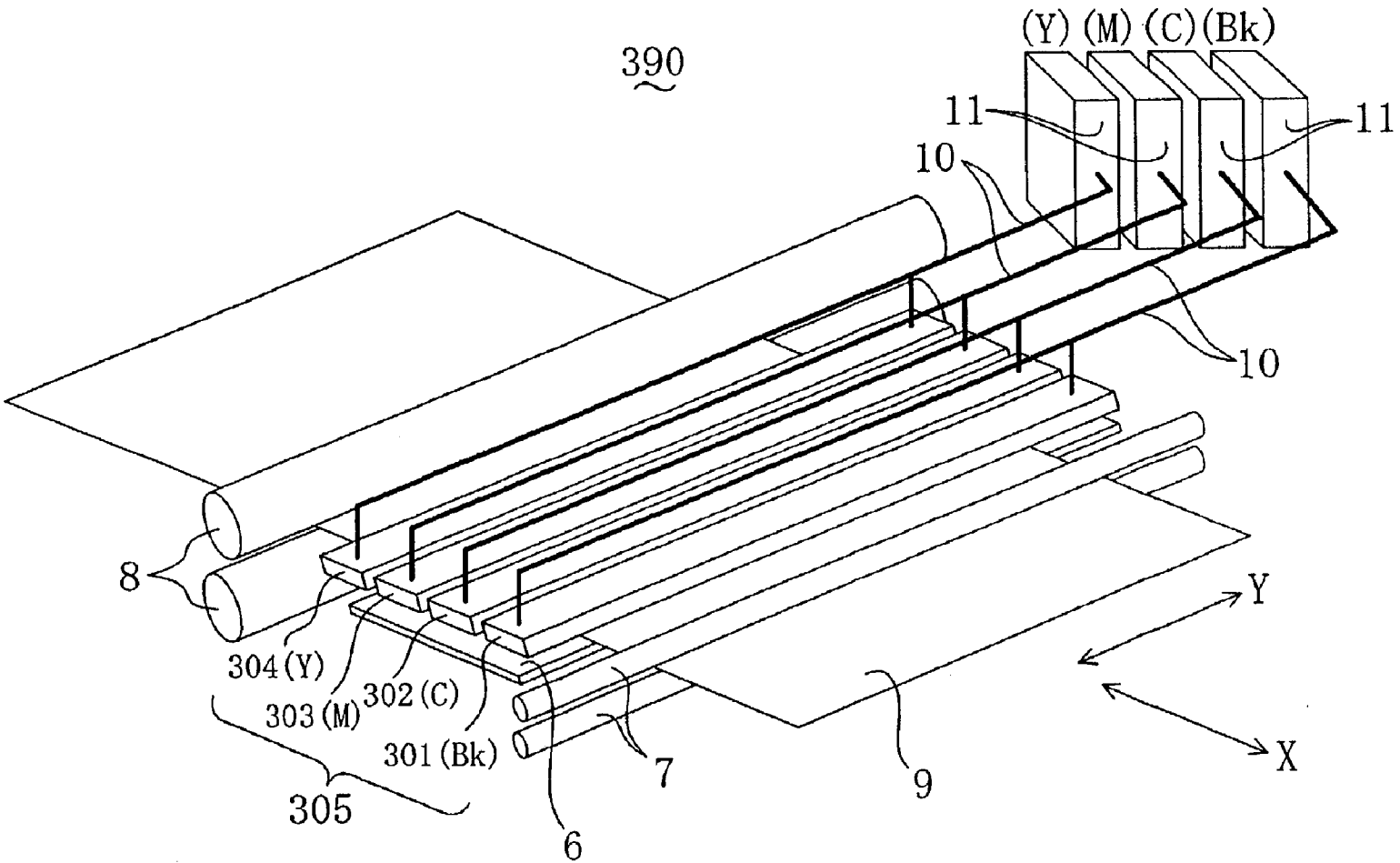
FIG. 24 is a perspective view illustrating an important part of an ink jet recording apparatus according to Embodiment 11.

As illustrated in FIG. 24, an ink jet recording apparatus 390 is a line head type recording apparatus that discharges inks of four colors and includes an ink jet head 305 including four independent line heads 301 to 304. Reference numeral 301 is a first line head for discharging a black ink (Bk), 302 is a second line head for discharging a cyan ink (C), 303 is a third line head for discharging a magenta ink (M), and 304 is a fourth line head for discharging a yellow ink (Y). The ink jet head 305 is obtained by assembling the first to fourth line heads 301 to 304 together so that black, cyan, magenta and yellow inks are discharged in this order. The line heads 301 to 304 extend in the width direction of the recording medium 9, and the head longitudinal direction Y is perpendicular to the scanning direction X. The line heads 301 to 304 are connected to the ink tanks 11 storing the respective color inks via the ink tubes 10.

Figure 25:
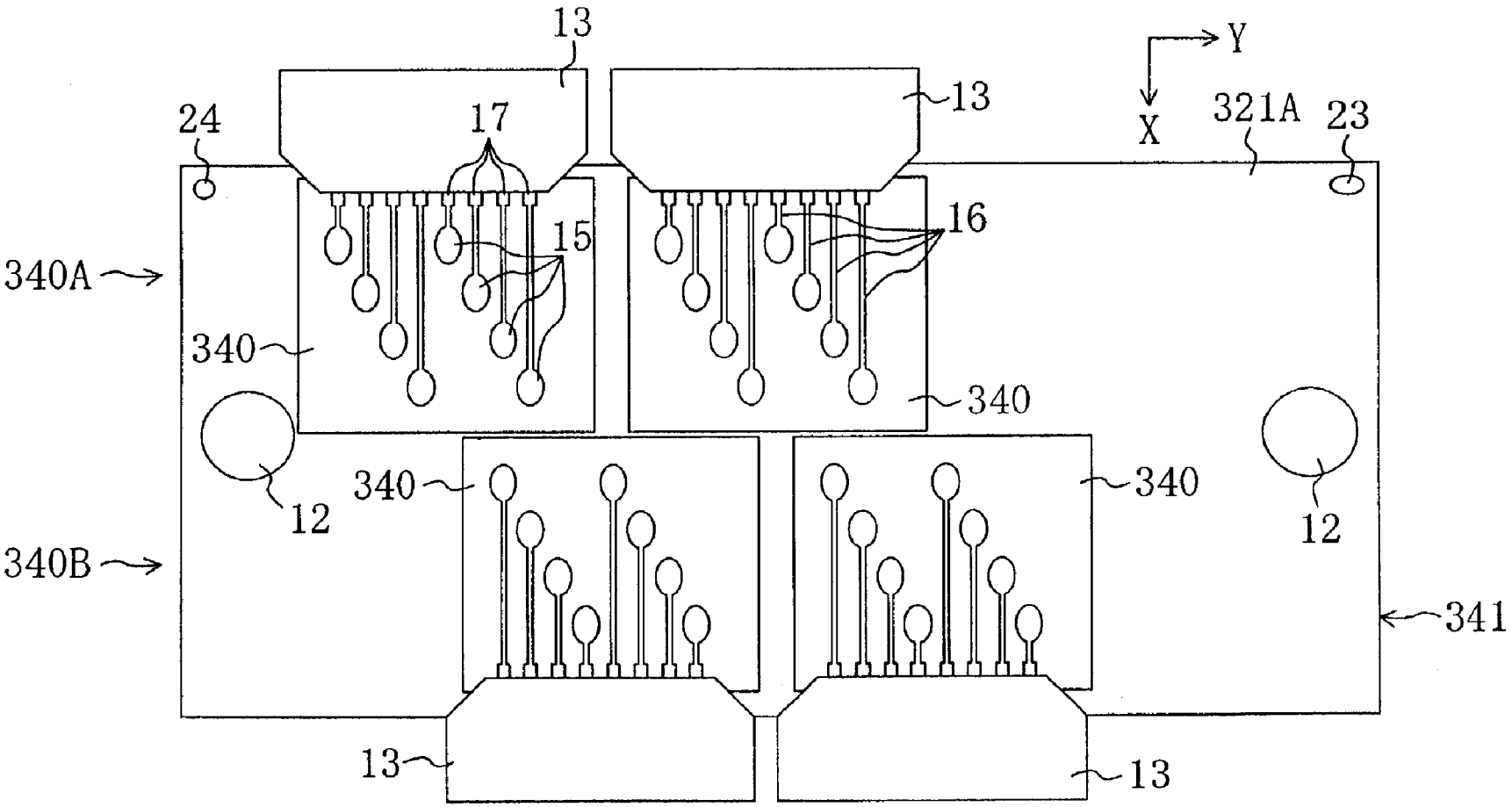
FIG. 25 is a plan view illustrating a line head according to Embodiment 11.
Figure 26:
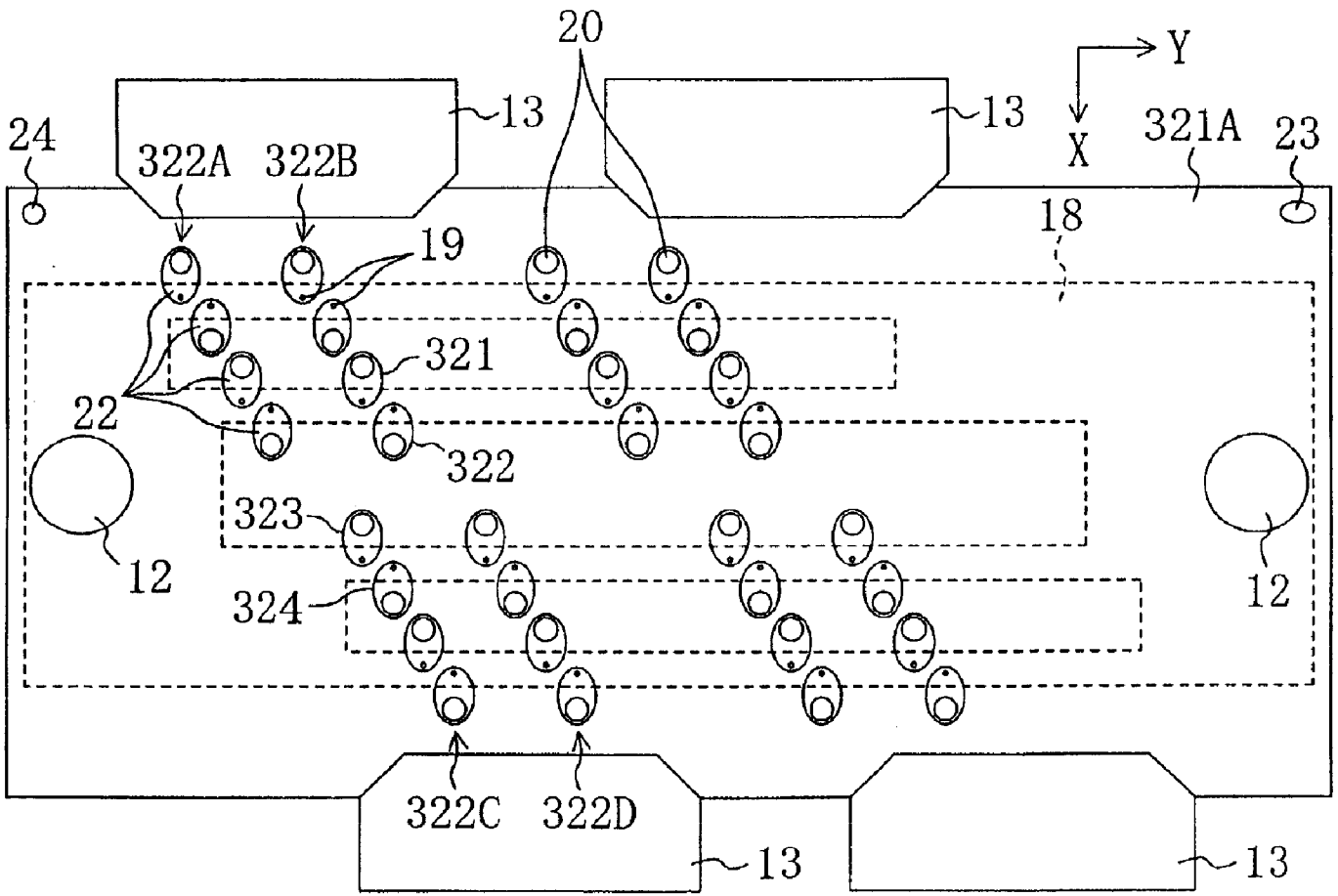
FIG. 26 is a plan view illustrating a pressure chamber block according to Embodiment 11.

Referring to FIG. 25 and FIG. 26, the configuration of the line heads will be described. Note however that since the first to fourth line heads 301 to 304 are heads of the same shape, only the first line head 301 will be described below, and the description of the other line heads 302 to 304 will be omitted.

As illustrated in FIG. 25, the line head 301 includes one pressure chamber block 341, and a plurality of actuator blocks 340 attached to the pressure chamber block 341. Each actuator block 340 is formed in a rectangular shape having a side that is parallel to the longitudinal direction of the actuator block 340, i.e., the head longitudinal direction Y, and another side that is perpendicular to the head longitudinal direction Y. Note however that the shape of the actuator block 340 is not limited to a rectangular shape, but may alternatively be another shape such as a parallelogram shape. The actuator blocks 340, 340, . . . , are arranged in a staggered pattern so that they do not contact with one another but partially overlap with one another with respect to the head longitudinal direction Y.

More specifically, a first block row 340A and a second block row 340B are formed on the pressure chamber block 341. Each of the first block row 340A and the second block row 340B includes a plurality of actuator blocks 340, 340, . . . , arranged at a constant interval in the head longitudinal direction Y. The first block row 340A and the second block row 340B are arranged in the recording medium carrying direction (i.e., the scanning direction X). The actuator blocks 340 and 340 belonging to the same block row are spaced apart from one another in the head longitudinal direction Y. The actuator block 340 belonging to the first block row 340A and the actuator block 340 belonging to the second block row 340B are spaced apart from each other in the scanning direction X and are shifted from each other with respect to the head longitudinal direction Y. For example, the actuator block 340 of the first block row 340A is positioned between the actuator blocks 340 and 340 of the second block row 340B with respect to the head width direction Y.

The configuration of the actuator block 340 is substantially the same as that of the actuator block 40 of Embodiment 1, and therefore only the difference therebetween will be described below. Moreover, the configuration of the pressure chamber block 341 is substantially the same as that of the pressure chamber block 41 of Embodiment 1, and therefore only the difference therebetween will be described below.

As illustrated in FIG. 26, each pressure chamber 22 is formed to have an elliptical shape in plan view, and the pressure chambers 22 are arranged at an interval of 600 dpi (42.3 $\mu$m) in the head longitudinal direction Y. Note however that the pressure chambers 22 are not arranged in a single row in the head longitudinal direction Y, but are appropriately shifted from one another in the scanning direction X in order to increase the head density.

Specifically, a plurality of pressure chamber rows 322A, 322B, 322C and 322D are formed in the pressure chamber plate 321A, each pressure chamber row including four pressure chambers 22 arranged in a direction that is inclined with respect to the head longitudinal direction Y. In other words, each of the pressure chamber rows 322A to 322D includes four pressure chambers 22 arranged in an upper left to lower right direction in FIG. 26. The pressure chamber rows 322A and 322C are adjacent to the pressure chamber rows 322B and 322D, respectively, in the head longitudinal direction Y. On the other hand, the pressure chamber row 322B and the pressure chamber row 322C are shifted from each other in the scanning direction X. Next to the four pressure chamber rows 322A to 322D in the head longitudinal direction Y, another set of the pressure chamber rows 322A to 322D is arranged in a similar pattern. Note that although only two sets of pressure chamber rows 322A to 322D are shown in FIG. 25 and FIG. 26 for the sake of simplicity, a large number of pressure chamber rows 322A to 322D are actually formed in the head longitudinal direction Y.

The pressure chamber row 322B and the pressure chamber row 322C partially overlap with each other with respect to the head longitudinal direction Y. Specifically, one or more of the pressure chambers belonging to the pressure chamber row 322B and one or more of the pressure chambers belonging to the pressure chamber row 322C are located along the same line extending in the scanning direction X. For example, a pressure chamber 321 belonging to the pressure chamber row 322B and a pressure chamber 323 belonging to the pressure chamber row 322C are located along the same line in the scanning direction X. Moreover, a pressure chamber 322 belonging to the pressure chamber row 322B and a pressure chamber 324 belonging to the pressure chamber row 322C are also located along the same line in the scanning direction X.

Note that the pressure chamber row 322D and the pressure chamber row 322A also partially overlap with each other with respect to the head longitudinal direction Y.

The ink supply port 19 and the ink channel inlet 20 are provided on the bottom surface of each pressure chamber 22. The ink supply port 19 communicates the common liquid chamber 18 and the pressure chamber 22 to each other. The inside of the common liquid chamber 18 is filled with an ink. The common liquid chamber 18, in its central portion thereof, diverges into four liquid chamber rows extending in the head longitudinal direction Y, and the four liquid chamber rows merge together at both ends thereof. The ink tube port 12 is provided in the end portions so that the ink is supplied through the ink tube ports 12 to the common liquid chamber 18.

The ink channel inlet 20 is connected to the nozzle 37 via the ink channel 32 (not shown in FIG. 26). Therefore, the nozzles 37 are formed in the same pattern as the pressure chambers 22. As a result, although not shown, the nozzles 37 form a plurality of nozzle rows corresponding respectively to the pressure chamber rows 322A to 322D, and one or more of the nozzles of each nozzle row and one or more of the nozzles of another nozzle row are located along the same line in the scanning direction X.

Ink Discharging Method

Figure 27:
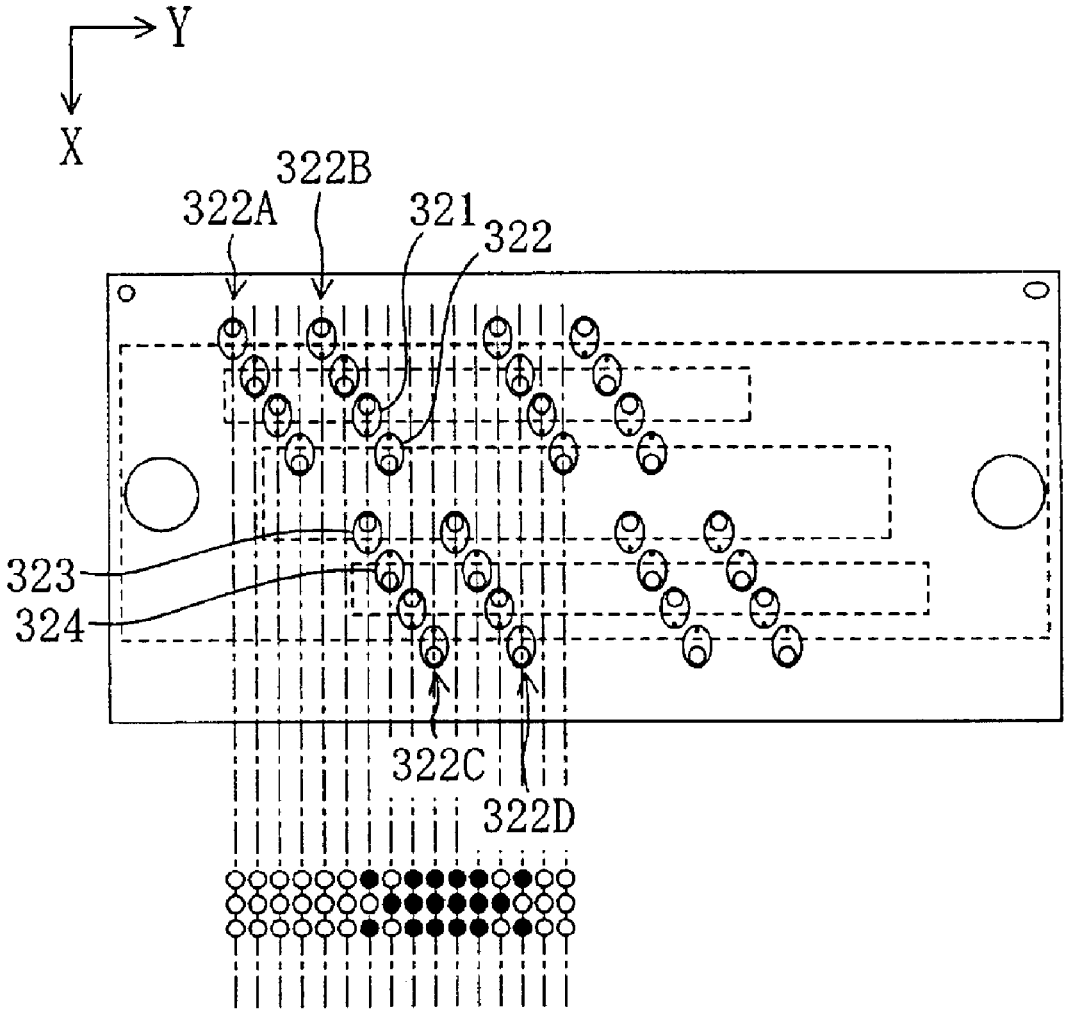
FIG. 27 is a schematic diagram illustrating an ink discharging method.

Next, an ink discharging method will be described with reference to FIG. 27. In FIG. 27, "○" and "●" each represent an ink dot. Specifically, "○" is a dot formed by an ink that is discharged from a nozzle corresponding to one of the pressure chambers of the pressure chamber rows 322A and 322B, and "●" is a dot formed by an ink that is discharged from a nozzle corresponding to one of the pressure chambers of the pressure chamber rows 322C and 322D. In the ink jet head 305 of the present embodiment, an ink is discharged alternately from nozzles that are located along the same line in the scanning direction X. For example, an ink is discharged alternately from nozzles corresponding to the pressure chamber 321 and the pressure chamber 323. Moreover, an ink is discharged alternately also from nozzles corresponding to the pressure chamber 322 and the pressure chamber 324. Note that while a particularly preferred way of discharging an ink is to discharge an ink alternately by one shot, an ink may be discharged alternately by a number of shots as long as a conspicuous white streak does not occur.

Method for Manufacturing Ink Jet Head

The line heads 301 to 304 of the present embodiment can be manufactured in a manner similar to that for the line head of Embodiment 1. Then, the ink jet head 305 of the present embodiment is manufactured by assembling together the manufactured line heads 301 to 304.

Effects of the Embodiment

According to the present embodiment, one or more of the nozzles belonging to a nozzle row and one or more of the nozzles belonging to a different nozzle row are located along the same line in the scanning direction X, and ink droplets are discharged alternately from those nozzles, whereby it is possible to prevent a white streak from occurring even when there are some variations in size among ink dots.

Figure 28:
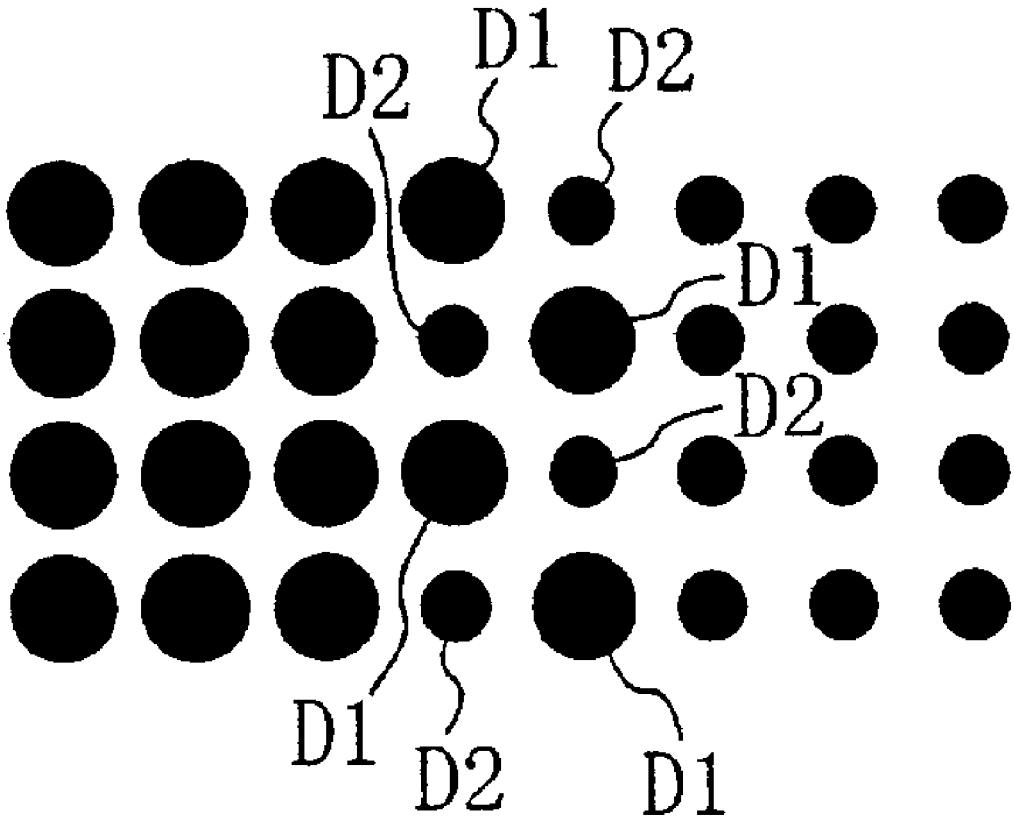
FIG. 28 is a diagram illustrating a pattern in which ink dots are formed by an ink jet head according to Embodiment 11.

As illustrated in FIG. 28, when the properties are not uniform among the actuator blocks, for example, ink dots D1 formed by one actuator block are relatively large while ink dots D2 formed by the other actuator block are relatively small. However, the large ink dots D1 and the small ink dots D2 are formed alternately at the end of each of the dot groups, whereby the boundary will not be conspicuous and a white streak does not occur. Therefore, it is possible to improve the quality of character-printing or image-printing.

Moreover, according to the present embodiment, each actuator includes a plurality of actuator blocks 340, with a plurality of actuator blocks 340 being arranged for each pressure chamber block 341, whereby it is possible to reduce the size of each actuator block 340. Therefore, a transfer process can be effectively utilized, and it is possible to realize an improved uniformity of thin film actuators in terms of properties such as the piezoelectric property and the thickness, prevention of a crack occurring in the film, improvement in the manufacturing yield, downsizing of the manufacturing equipment, a cost reduction, etc.

<Embodiment 12>

Figure 29:
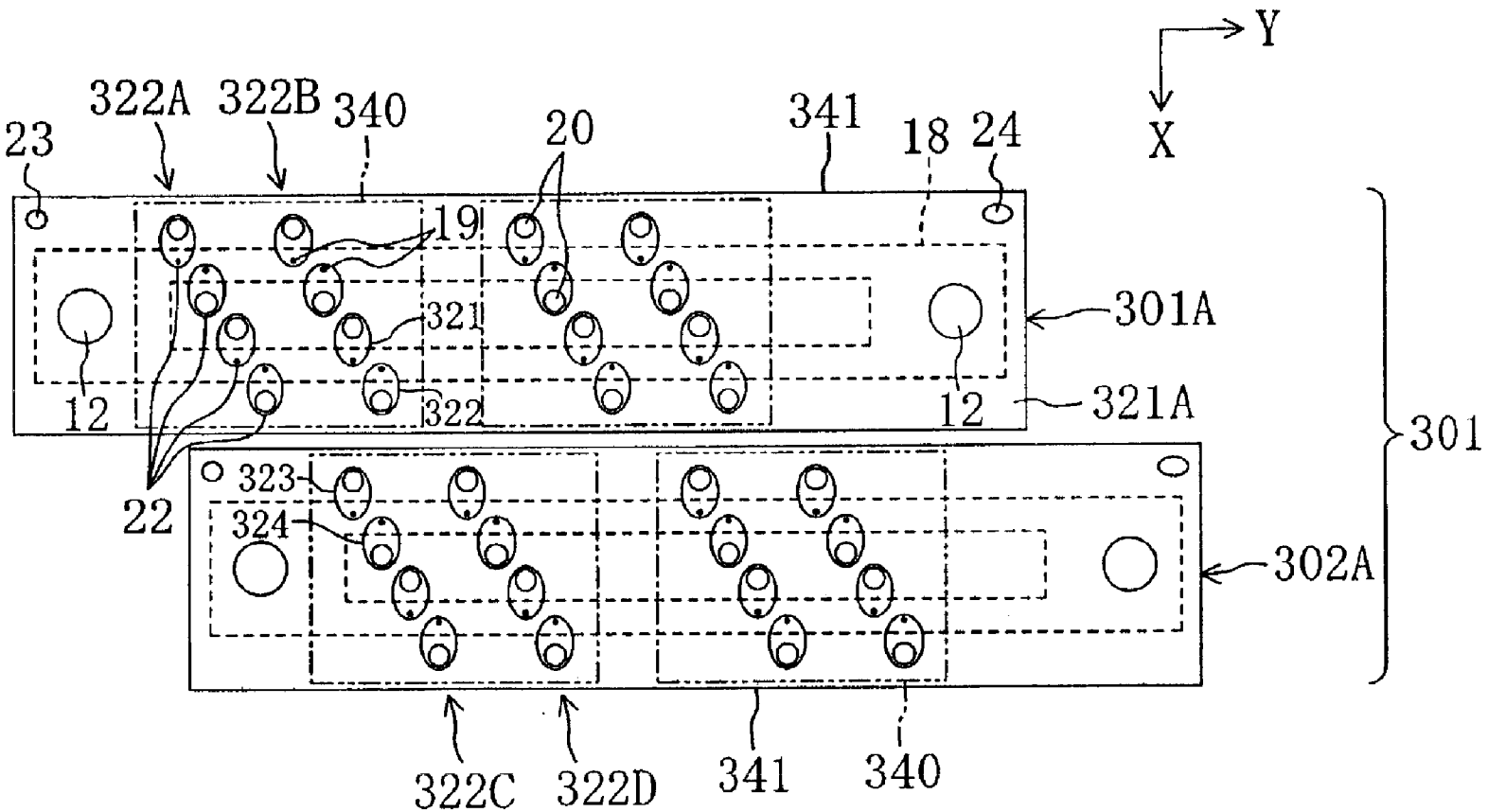
FIG. 29 is a plan view illustrating a pressure chamber block according to Embodiment 12.

As illustrated in FIG. 29, each line head of an ink jet head according to Embodiment 12 includes two head blocks that are arranged in the scanning direction X, i.e., a first head block 301A and a second head block 302A.

Each of the head blocks 301A and 302A includes one pressure chamber block 341, and a plurality of actuator blocks 340 attached to the pressure chamber block 341. In each of the head blocks 301A and 302A, the actuator blocks 340 are arranged at a predetermined interval in the head longitudinal direction Y, and the adjacent actuator blocks 340 are spaced apart from each other. The first head block 301A and the second head block 302A are shifted from each other in the head longitudinal direction Y so that the actuator block 340 of one head block is located between the actuator blocks 340 and 340 of the other head block with respect to the head longitudinal direction Y. The actuator blocks 340, 340, . . . , of the first head block 301A and the second head block 302A as a whole are arranged in a staggered pattern.

The actuator block 340 of the first head block 301A and the actuator block 340 of the second head block 302A are spaced apart from each other with respect to the scanning direction X, but partially overlap with each other with respect to the head longitudinal direction Y. As a result of such an arrangement pattern, the actuator blocks 340 are as a whole in a continuous arrangement with no gap therebetween in the head longitudinal direction Y.

Also in the present embodiment, one or more of the pressure chambers of each of the pressure chamber rows 322A to 322D and one or more of the pressure chambers of another one of the pressure chamber rows 322A to 322D are located along the same line in the scanning direction X. An ink is discharged alternately from the nozzles corresponding to the pressure chamber 321 and the pressure chamber 323 located along the same line in the scanning direction X. Similarly, an ink is discharged alternately from the nozzles corresponding to the pressure chamber 322 and the pressure chamber 324.

Therefore, Embodiment 12 also provides effects as those of Embodiment 11. Moreover, in the present embodiment, if one of the first head block 301A and the second head block 302A breaks down, only the broken head block can be replaced so that it is possible to continue to use the other head block that is not broken. Therefore, it is not necessary to replace the entire line head, whereby it is possible to reduce the running cost and the maintenance cost.

<Embodiment 13>

Figure 30:
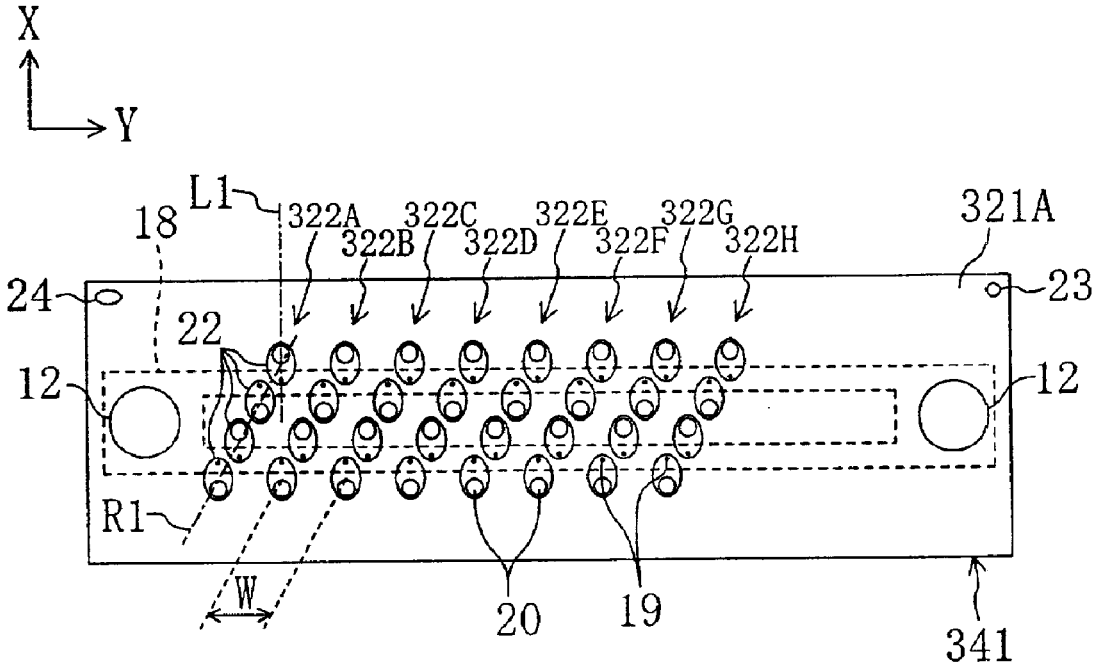
FIG. 30 is a plan view illustrating a pressure chamber block according to Embodiment 13.
Figure 31:
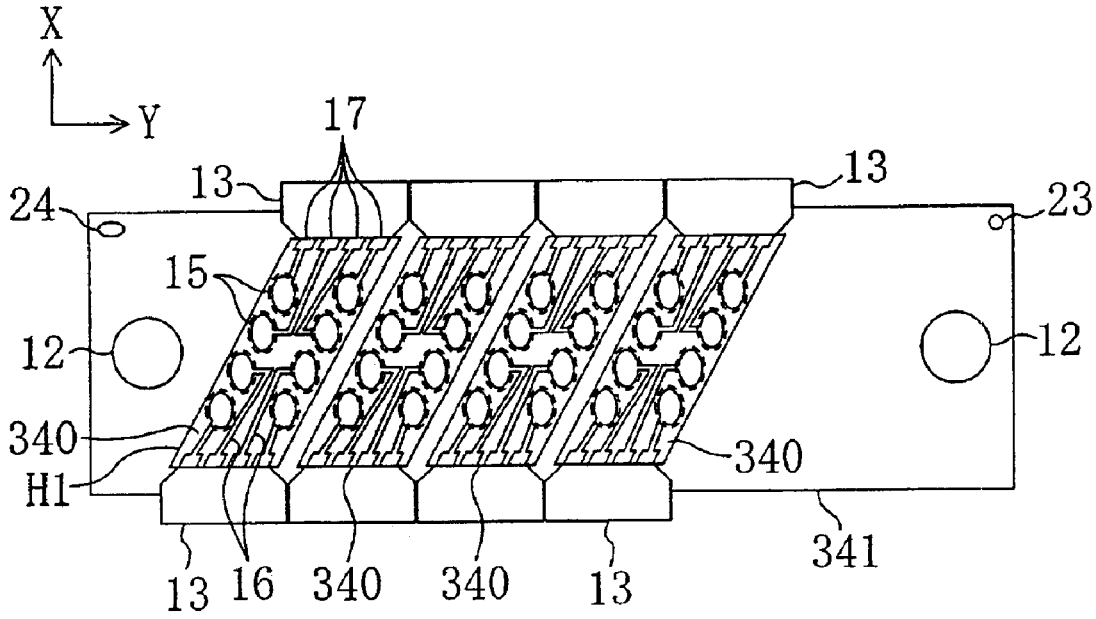
FIG. 31 is a plan view illustrating a pressure chamber block according to Embodiment 13.

As illustrated in FIG. 30 and FIG. 31, each line head of an ink jet head according to Embodiment 13 includes parallelogram-shaped actuator blocks 340 that are arranged in a single row in the head longitudinal direction Y.

As illustrated in FIG. 30, in Embodiment 13, a plurality of pressure chamber rows 322A to 322H each including four pressure chambers 22 are formed. The pressure chamber rows 322A to 322H are formed at a constant interval in the head longitudinal direction Y. Note that although only eight sets of pressure chamber rows are shown in FIG. 30 and FIG. 31 for the sake of simplicity, a large number of pressure chamber rows are actually formed in the head longitudinal direction Y.

Each actuator block 340 is formed in a parallelogram shape having a side that is parallel to the longitudinal direction of the pressure chamber block 341 (the same direction as the head longitudinal direction Y) and another side H1 that is inclined from the head longitudinal direction Y. The actuator blocks 340 are arranged at a predetermined interval in the head longitudinal direction Y, and adjacent actuator blocks 340 and 340 are spaced apart from each other.

The row direction R1 of each of the pressure chamber rows 322A to 322H is parallel to the inclined side H1 of each actuator block 340. Each actuator block 340 covers two pressure chamber rows.

Also in the present embodiment, a pressure chamber at an end of each of the pressure chamber rows 322A to 322H and a pressure chamber at an end of another one of the pressure chamber rows 322A to 322H are located along the same line in the scanning direction X. An ink is discharged alternately from nozzles corresponding to pressure chambers that are located along the same line.

Therefore, Embodiment 13 also provides effects as those of Embodiment 11.

Moreover, in Embodiment 13, the pressure chamber rows 322A to 322H are formed to be parallel to one another, thereby keeping an interval W (see FIG. 30) between the adjacent ones of the pressure chamber rows 322A to 322H, the interval W corresponding to the total width of a number of pressure chambers. Thus, the pressure chamber rows 322A to 322H are arranged at a relatively wide interval W. Herein, the actuator blocks 340 are formed in a parallelogram shape having a side H1 that is parallel to the row direction R1 of each of the pressure chamber rows 322A to 322H. Therefore, it is possible to cover all the pressure chambers 22 of the pressure chamber block 341 by a plurality of actuator blocks 340 without arranging the actuator blocks 340 with no gap therebetween. Thus, due to the wide interval between the pressure chamber rows 322A to 322H, the pressure chambers 22 of the pressure chamber rows 322A to 322H are reliably covered by the actuator block 340 even if some gap is provided between the actuator blocks 340 and 340.

Therefore, it is not necessary to provide two rows of the actuator blocks 340 in the scanning direction, and it is possible to arrange the actuator blocks 340 in a single row for the pressure chamber block 341. Therefore, the length of the ink jet head 305 in the scanning direction X is reduced, and it is possible to downsize the head. Moreover, since the length in the scanning direction is short, the recording medium 9 is less likely to be bent. Therefore, the interval between the ink jet head 5 and the recording medium 9 is stabilized, and a high-quality recording operation can be performed.

<Embodiment 14>

Figure 32:
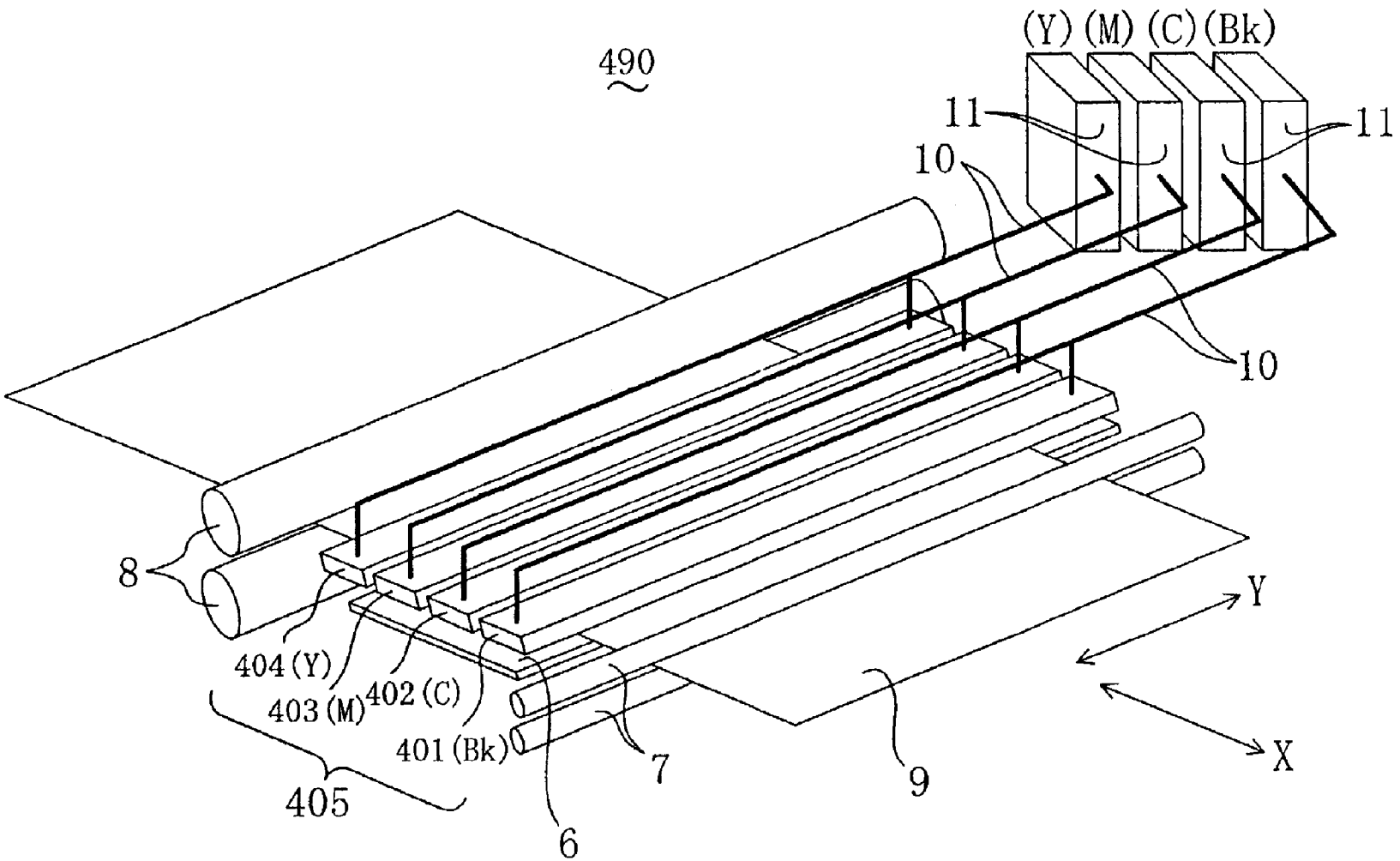
FIG. 32 is a perspective view illustrating an important part of an ink jet recording apparatus according to Embodiment 14.

As illustrated in FIG. 32, an ink jet recording apparatus 490 is a line head type recording apparatus that discharges inks of four colors and includes an ink jet head 405 including four independent line heads 401 to 404. Reference numeral 401 is a first line head for discharging a black ink (Bk), 402 is a second line head for discharging a cyan ink (C), 403 is a third line head for discharging a magenta ink (M), and 404 is a fourth line head for discharging a yellow ink (Y). The ink jet head 405 is obtained by assembling the first to fourth line heads 401 to 404 together so that black, cyan, magenta and yellow inks are discharged in this order. The line heads 401 to 404 extend in the width direction of the recording medium 9, and the head longitudinal direction Y is perpendicular to the scanning direction X. The line heads 401 to 404 are connected to the ink tanks 11 storing the respective color inks via the ink tubes 10.

Figure 33:
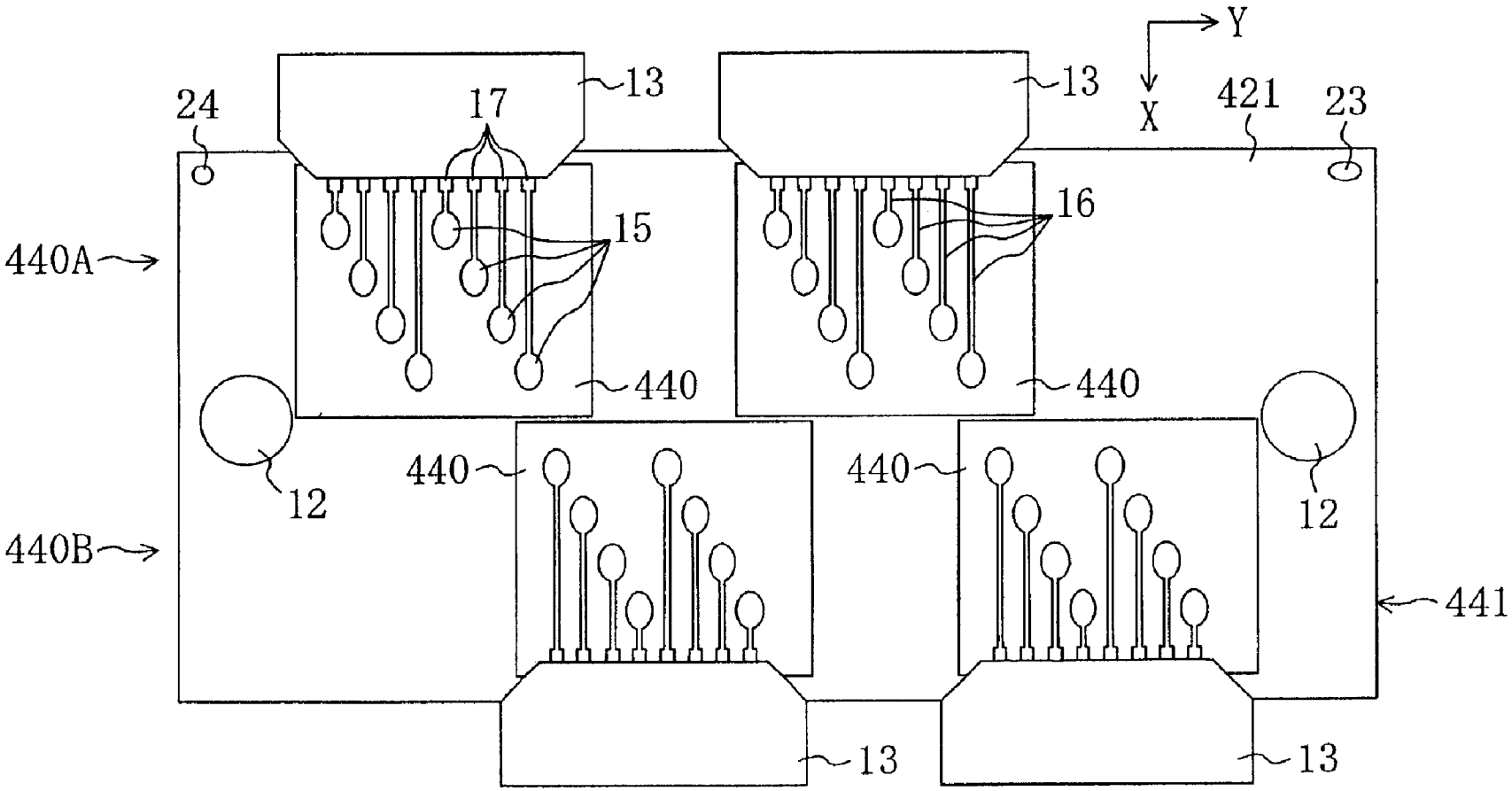
FIG. 33 is a plan view illustrating a line head according to Embodiment 14.
Figure 34:
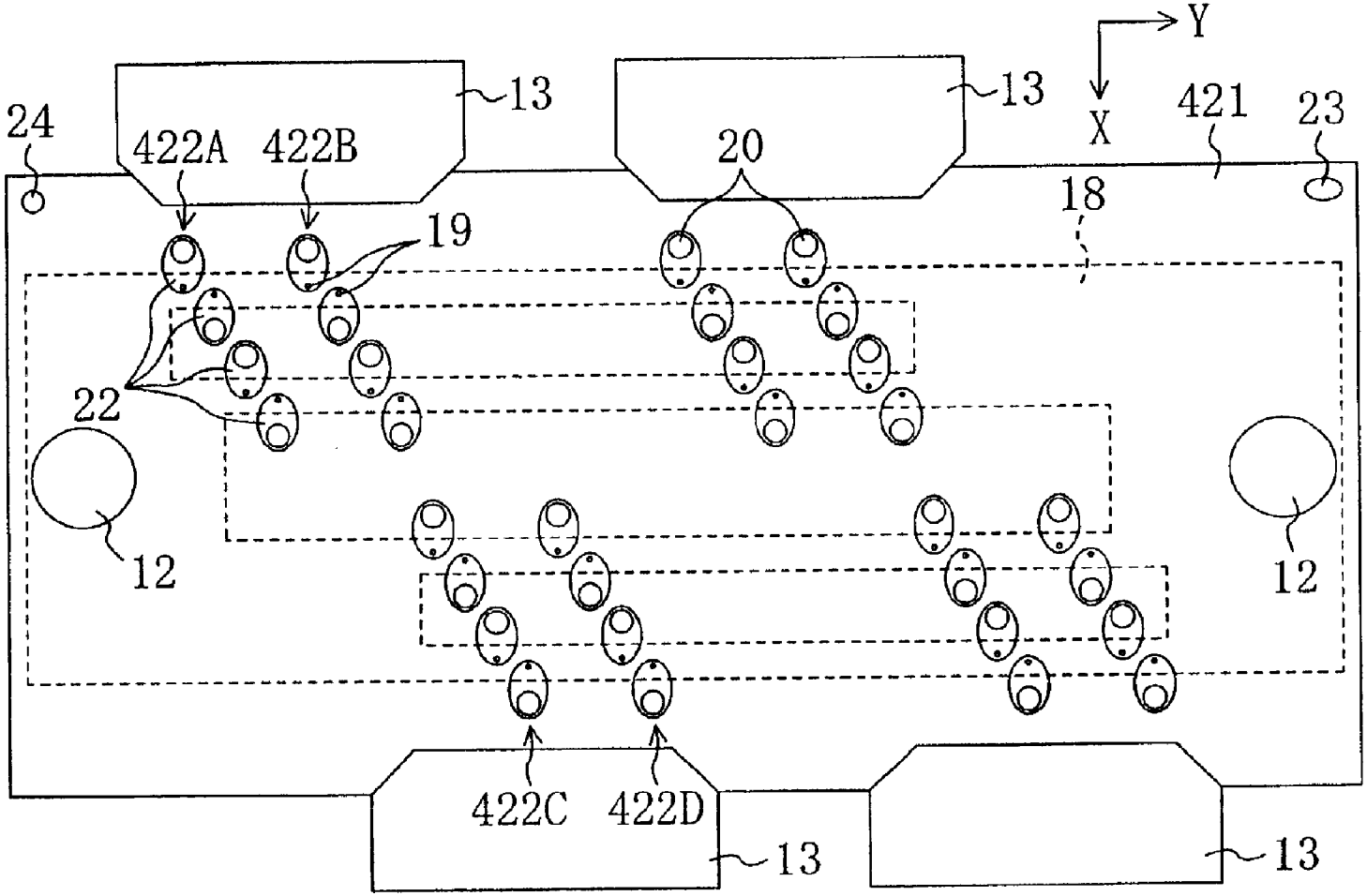
FIG. 34 is a plan view illustrating a pressure chamber block according to Embodiment 14.

Referring to FIG. 33 and FIG. 34, the configuration of the line heads will be described. Note however that since the first to fourth line heads 401 to 404 are heads of the same shape, only the first line head 401 will be described below, and the description of the other line heads 402 to 404 will be omitted.

As illustrated in FIG. 33, the line head 401 includes one pressure chamber block 441, and a plurality of actuator blocks 440 attached to the pressure chamber block 441. Each actuator block 440 is formed in a rectangular shape having a side that is parallel to the longitudinal direction of the actuator block 440, i.e., the head longitudinal direction Y, and another side that is perpendicular to the head longitudinal direction Y. Note however that the shape of the actuator block 440 is not limited to a rectangular shape, but may alternatively be another shape such as a parallelogram shape. The actuator blocks 440, 440, . . . , are arranged in a staggered pattern so that they do not contact with one another but partially overlap with one another with respect to the head longitudinal direction Y.

More specifically, a first block row 440A and a second block row 440B are formed on the pressure chamber block 441. Each of the first block row 440A and the second block row 440B includes a plurality of actuator blocks 440, 440, . . . , arranged at a constant interval in the head longitudinal direction Y. The first block row 440A and the second block row 440B are arranged in the recording medium carrying direction (i.e., the scanning direction X). The actuator blocks 440 and 440 belonging to the same block row are spaced apart from one another in the head longitudinal direction Y. The actuator block 440 belonging to the first block row 440A and the actuator block 440 belonging to the second block row 440B are spaced apart from each other in the scanning direction X. The actuator block 440 of the first block row 440A and the actuator block 440 of the second block row 440B are shifted from each other with respect to the head longitudinal direction Y. For example, the actuator block 440 of the first block row 440A is positioned between the actuator blocks 440 and 440 of the second block row 440B with respect to the head width direction Y.

The configuration of the actuator block 440 is substantially the same as that of the actuator block 40 of Embodiment 1, and therefore only the difference therebetween will be described below. Moreover, the configuration of the pressure chamber block 441 is substantially the same as that of the pressure chamber block 41 of Embodiment 1, and therefore only the difference therebetween will be described below.

As illustrated in FIG. 34, each pressure chamber 22 is formed to have an elliptical shape in plan view, and the pressure chambers 22 are arranged at an interval of 600 dpi (42.3 $\mu$m) in the head longitudinal direction Y. Note however that the pressure chambers 22 are not arranged in a single row in the head longitudinal direction Y, but are appropriately shifted from one another in the scanning direction X in order to increase the head density.

Specifically, a plurality of pressure chamber rows 422A, 422B, 422C and 422D are formed in the pressure chamber plate 421, each pressure chamber row including four pressure chambers 22 arranged in a direction that is inclined with respect to the head longitudinal direction Y. In other words, each of the pressure chamber rows 422A to 422D includes four pressure chambers 22 arranged in an upper left to lower right direction in FIG. 34. The pressure chamber rows 422A and 422C are adjacent to the pressure chamber rows 422B and 422D, respectively, in the head longitudinal direction Y. On the other hand, the pressure chamber row 422B and the pressure chamber row 422C are shifted from each other in the scanning direction X. Next to the four pressure chamber rows 422A to 422D in the head longitudinal direction Y, another set of the pressure chamber rows 422A to 422D is arranged in a similar pattern. Note that although only two sets of pressure chamber rows 422A to 422D are shown in FIG. 33 and FIG. 34 for the sake of simplicity, a large number of pressure chamber rows 422A to 422D are actually formed in the head longitudinal direction Y.

The ink supply port 19 and the ink channel inlet 20 are provided on the bottom surface of each pressure chamber 22. The ink supply port 19 communicates the common liquid chamber 18 and the pressure chamber 22 to each other. The inside of the common liquid chamber 18 is filled with an ink. The common liquid chamber 18, in its central portion thereof, diverges into four liquid chamber rows extending in the head longitudinal direction Y, and the four liquid chamber rows merge together at both ends thereof. The ink tube port 12 is provided in the end portions so that the ink is supplied through the ink tube ports 12 to the common liquid chamber 18.

Actuator Block Inspection Method

Next, inspection on the properties of the actuator block 440 will be described. The property inspection is performed during the manufacturing process of the ink jet head 405.

First, a substrate having a size of 20 mm×25 mm and made of MgO, Si, SUS, etc., is provided. In the present embodiment, an MgO substrate is used.

Figure 35A:
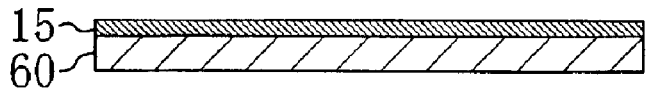
FIG. 35A to FIG. 35C are process diagrams illustrating a method for manufacturing an actuator forming member.

Then, as illustrated in FIG. 35A, the first electrode 15 made of platinum is formed across the entire surface of the substrate 60 by an RF sputtering (radio frequency sputtering) method.

Figure 35B:
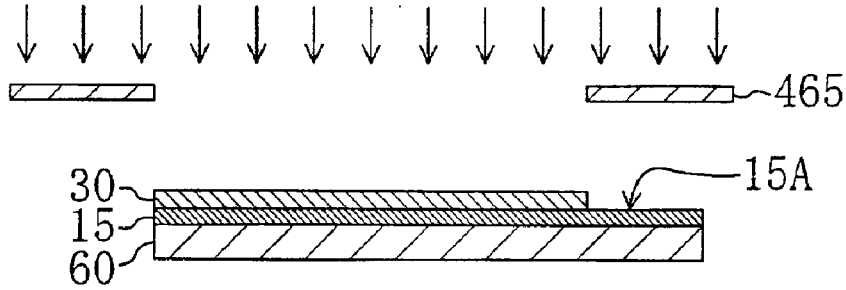

Then, as illustrated in FIG. 35B, a mask 465 made of a metal mask is placed above the first electrode 15, and the piezoelectric element 30 made of a PZT thin film is formed on the first electrode 15 by an RF sputtering method. Herein, the mask 465 is shaped in a pattern such that a portion of the first electrode 15 that is to be an exposed portion 15A is blocked. Therefore, the piezoelectric element 30 is deposited only partially on the first electrode 15. The other portion of the first electrode 15 is to be the exposed portion 15A with the piezoelectric element 30 being not deposited thereon. Particularly, with a single crystal substrate of MgO being used herein as the substrate 60, if the piezoelectric element 30 is produced after the first electrode 15 made of platinum is formed on the (100) plane of the MgO substrate 60, the piezoelectric element 30 has stable properties with a high piezoelectric property.

Figure 35C:
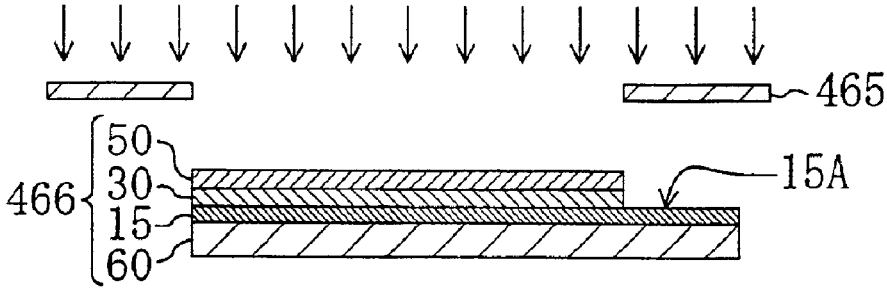

Next, as illustrated in FIG. 35C, the second electrode 50 made of platinum is formed on the piezoelectric element 30 by an RF sputtering method in a manner similar to that described above, with the mask 465 being placed above the piezoelectric element 30. As a result, an actuator forming member 466 is obtained, in which the first electrode 15, the piezoelectric element 30 and the second electrode 50 are deposited in this order on the substrate 60, with a portion of the first electrode 15 being the exposed portion 15A.

Figure 36A:
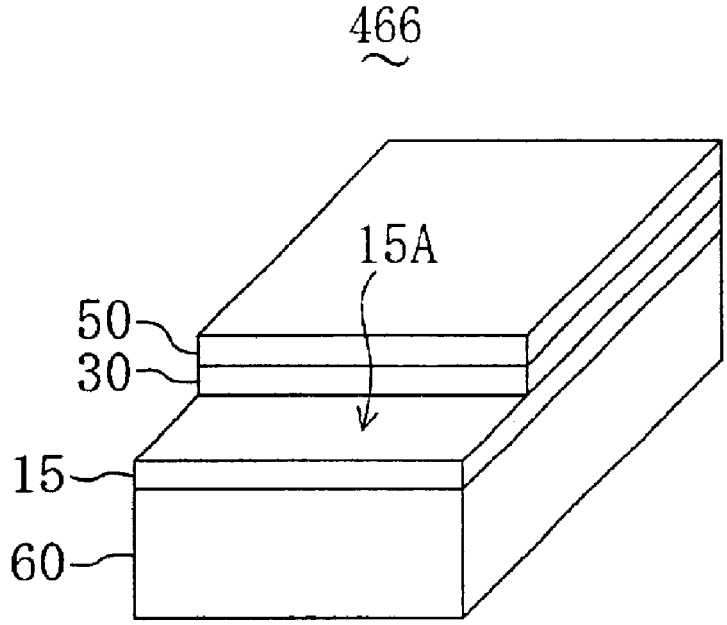
FIG. 36A and FIG. 36B are perspective views illustrating an actuator forming member.
Figure 36B:
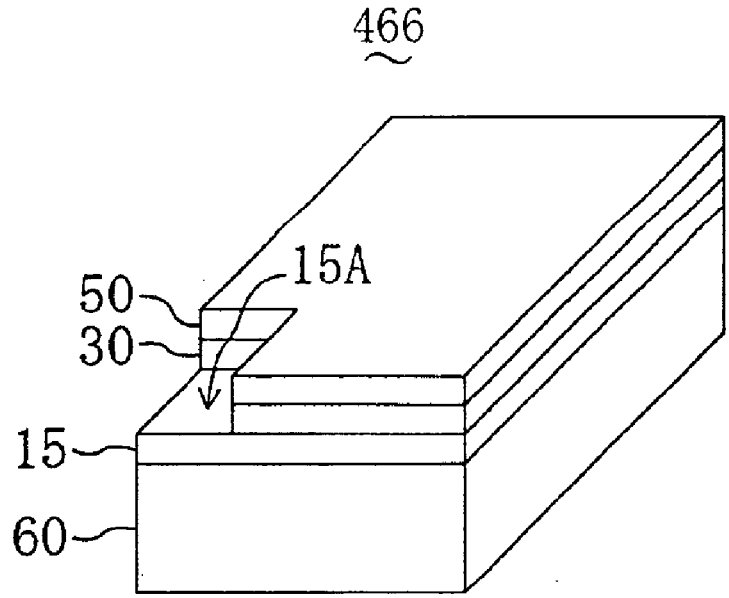

Note that the shape of the exposed portion 15A of the first electrode 15 is not limited to any particular shape. For example, the exposed portion 15A may be formed in an edge portion of the substrate 60 across the entire width thereof as illustrated in FIG. 36A, or may be provided in a corner portion of the substrate 60 as illustrated in FIG. 36B.

Figure 37:
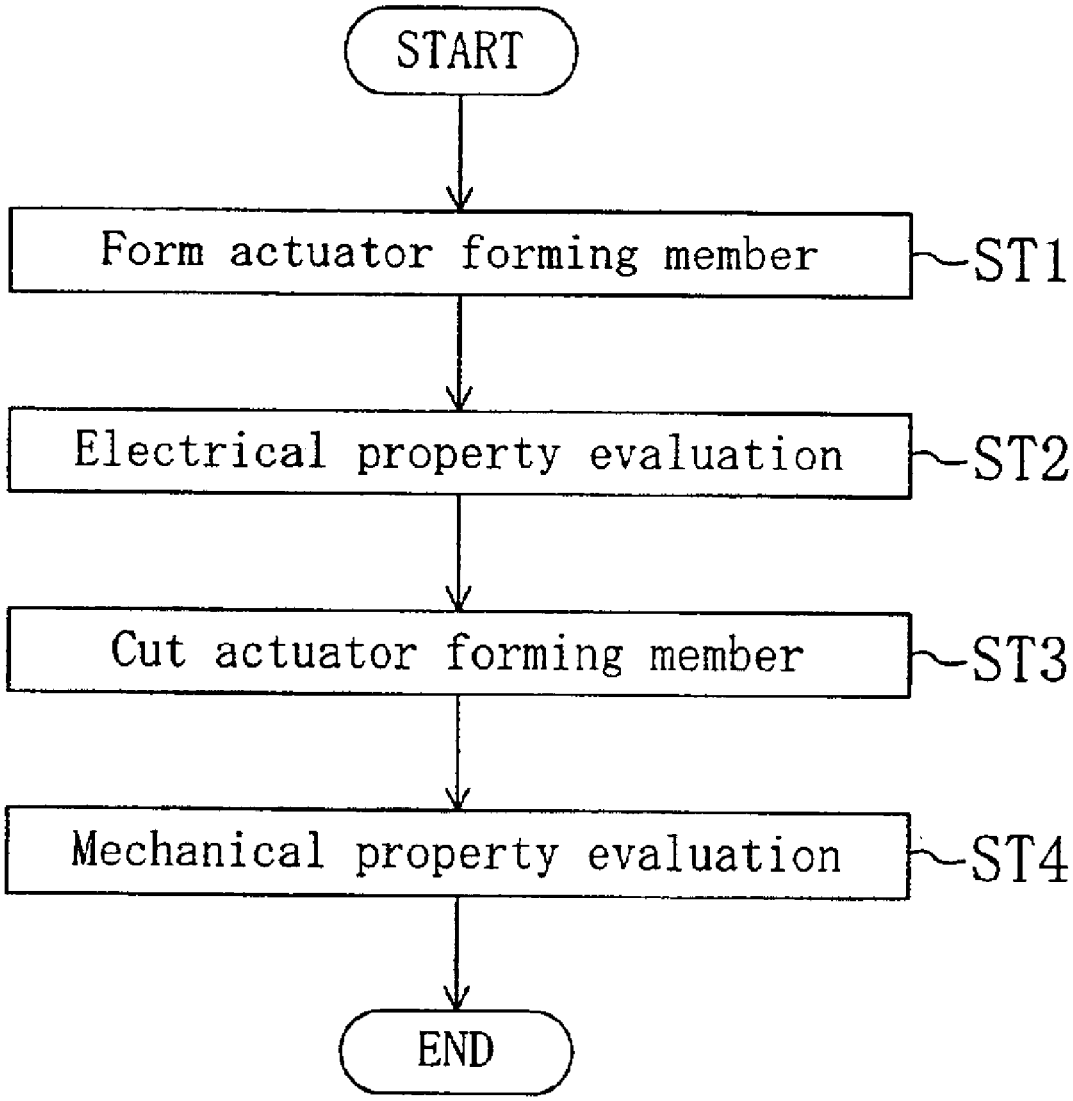
FIG. 37 is a flow chart illustrating an inspection method.

As illustrated in FIG. 37, in the property inspection according to the present embodiment, the actuator forming member 466 as described above is formed (step ST1), after which an electrical property evaluation is performed (step ST2). Then, a portion of the actuator forming member 466 is cut off (step ST3), and a mechanical property evaluation is performed using the cut-off portion of the actuator forming member 466 as a sample (step ST4).

Figure 38:
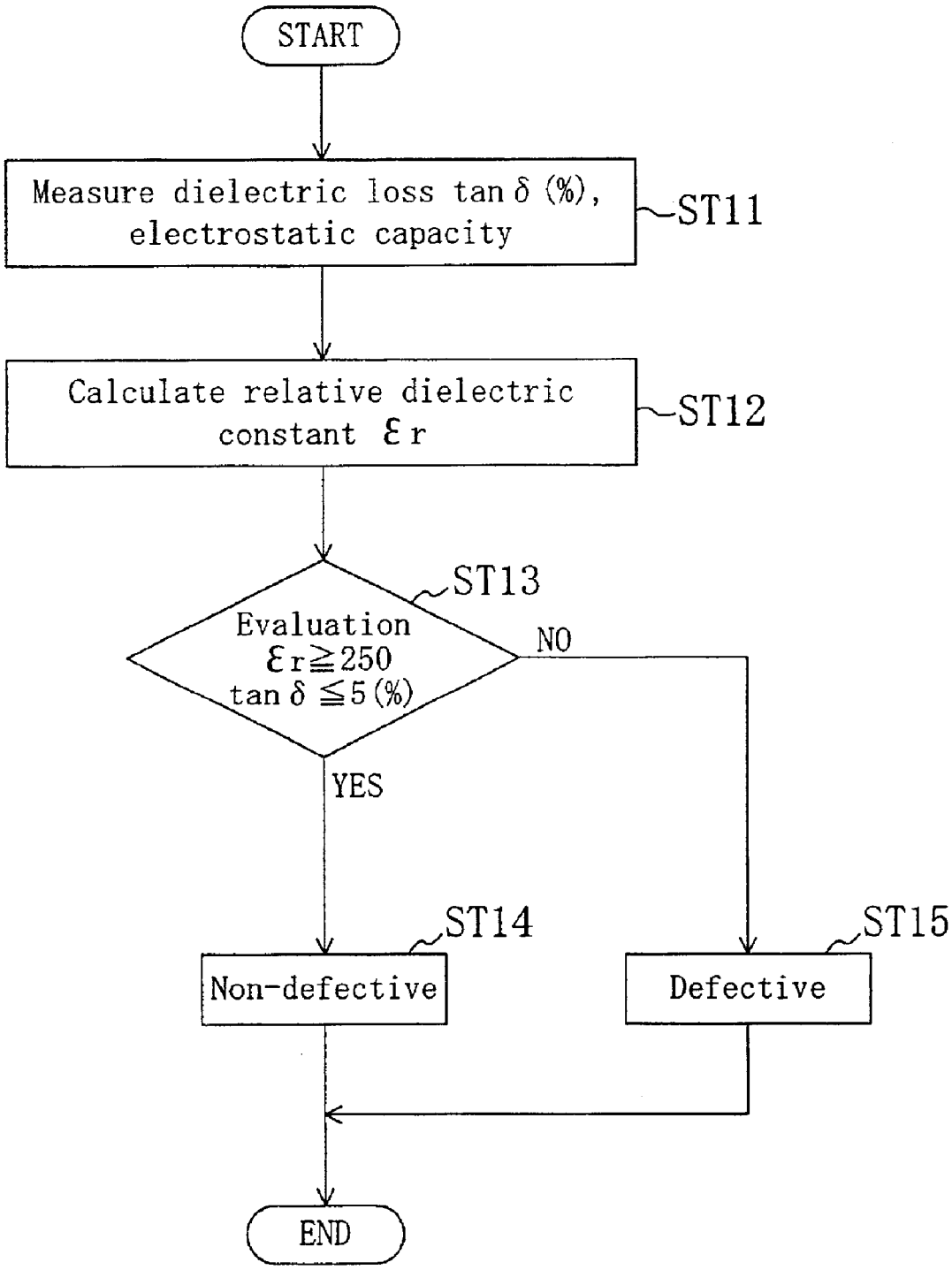
FIG. 38 is a flow chart illustrating an electrical property evaluation.
Figure 39:
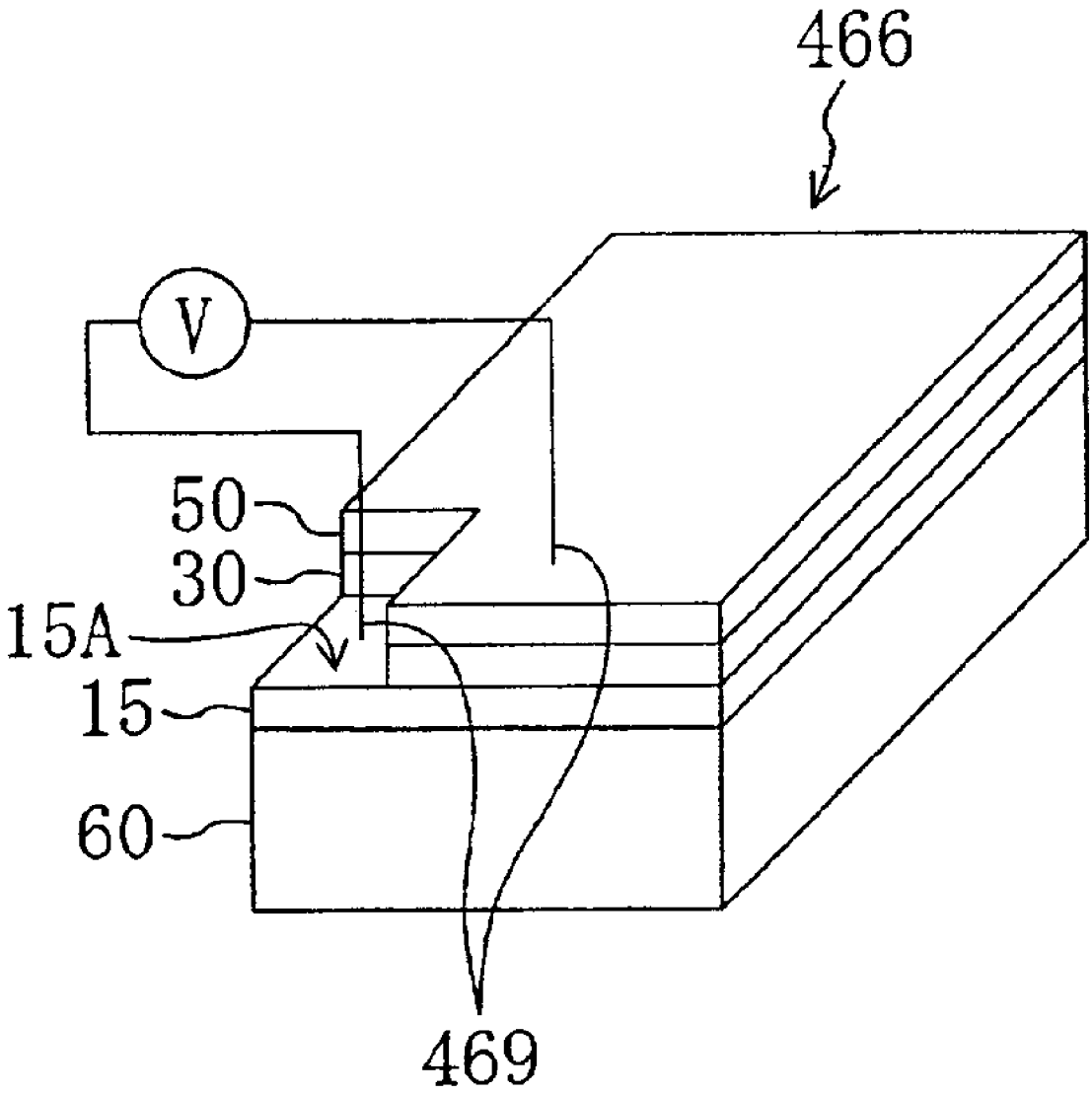
FIG. 39 is a perspective view illustrating an actuator forming member during an electrical property evaluation.

The electrical property evaluation is performed as illustrated in the flow chart of FIG. 38. Specifically, first, inspection probes 469 are pressed against the exposed portion 15A of the first electrode 15 and the second electrode 50 of the actuator forming member 466, as schematically illustrated in FIG. 39, and the dielectric loss tan δ and the electrostatic capacity Cp [F] of the piezoelectric element 30 are measured under predetermined conditions (e.g., a voltage whose measured frequency is 1 kHz and whose voltage value is about a few volts is applied) (step ST11).

Then, the relative dielectric constant $\epsilon_r$ is calculated using the measured value of the electrostatic capacity Cp (step ST12). The relative dielectric constant $\epsilon_r$ is calculated using Expression ① below.

$$\varepsilon_r = \frac{Cp \times d}{S \times \varepsilon_0} \quad ①$$

Cp: Electrostatic capacity Cp [F]

d: Thickness of piezoelectric element (m)

S: Area of probe ($m^2$)

$\epsilon_r$: Relative dielectric constant $\epsilon_0$: Dielectric constant of vacuum=$8.85\times10^{-12}$ (F/m)

Then, it is determined whether the relative dielectric constant $\epsilon_r$ and the dielectric loss tan δ meet their predetermined acceptable levels (step ST13). Specifically, it is determined whether the condition of relative dielectric constant $\epsilon_r \geqq 250$ and dielectric loss tan $\delta \leqq 5[\%]$ is satisfied. If the condition is satisfied, it is determined to be a non-defective (step ST14). If the condition is not satisfied, it is determined to be a defective (step ST15).

After the electrical property evaluation is completed, a mechanical property evaluation is performed. Note however that the mechanical property evaluation is performed by cutting off a portion of the actuator forming member 466 to be a sample 467 (see FIG. 41), and using the sample 467. Therefore, first, a portion of the actuator forming member 466, specifically a portion including the exposed portion 15A of the first electrode 15, is cut off (step ST3) prior to the mechanical property evaluation. For example, a portion of the actuator forming member 466 including the exposed portion 15A is cut off in a strip shape having a size of 20 mm×2 mm, and used as the sample 467.

Figure 40:
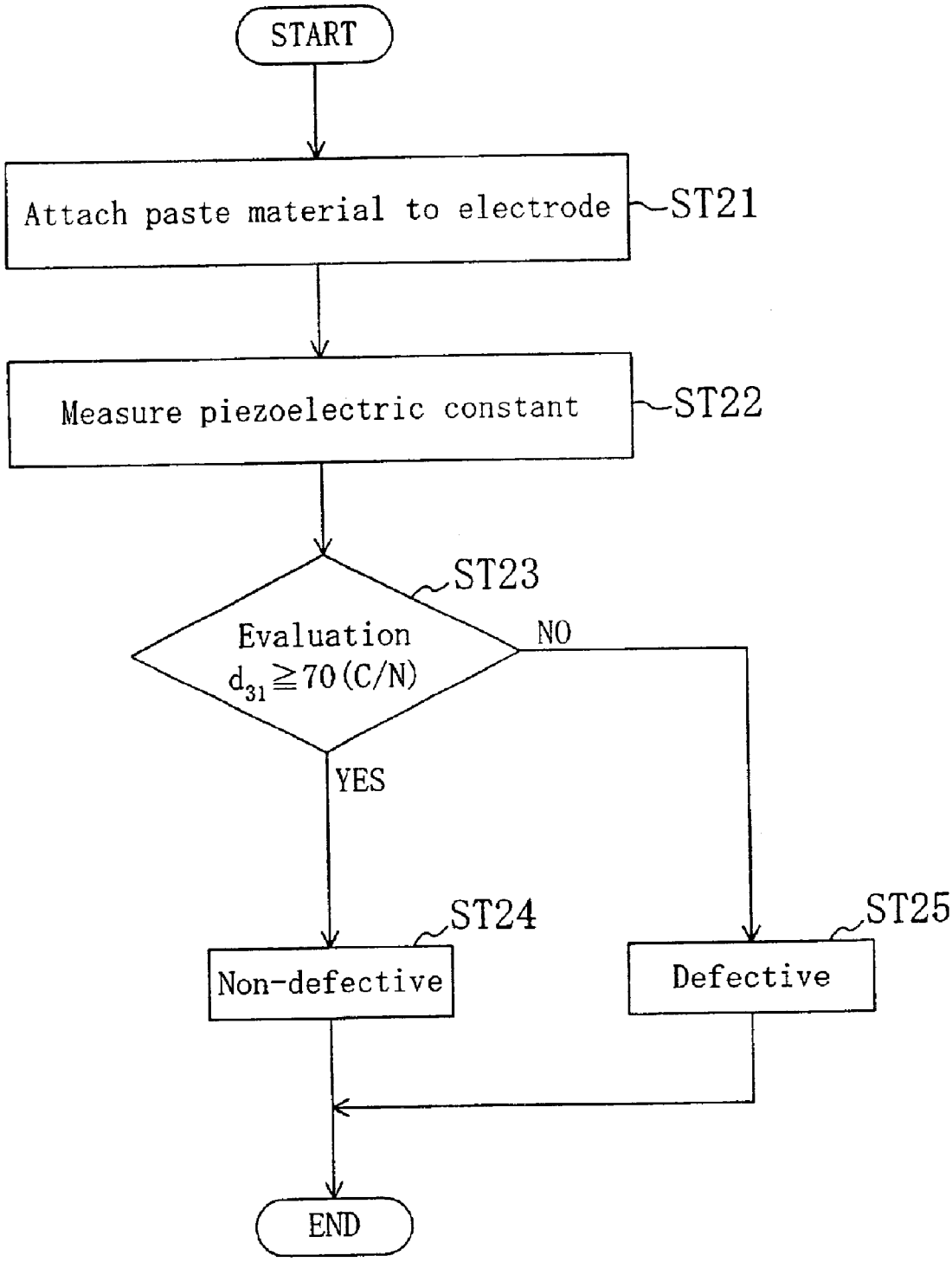
FIG. 40 is a flow chart illustrating a mechanical property evaluation.
Figure 41:
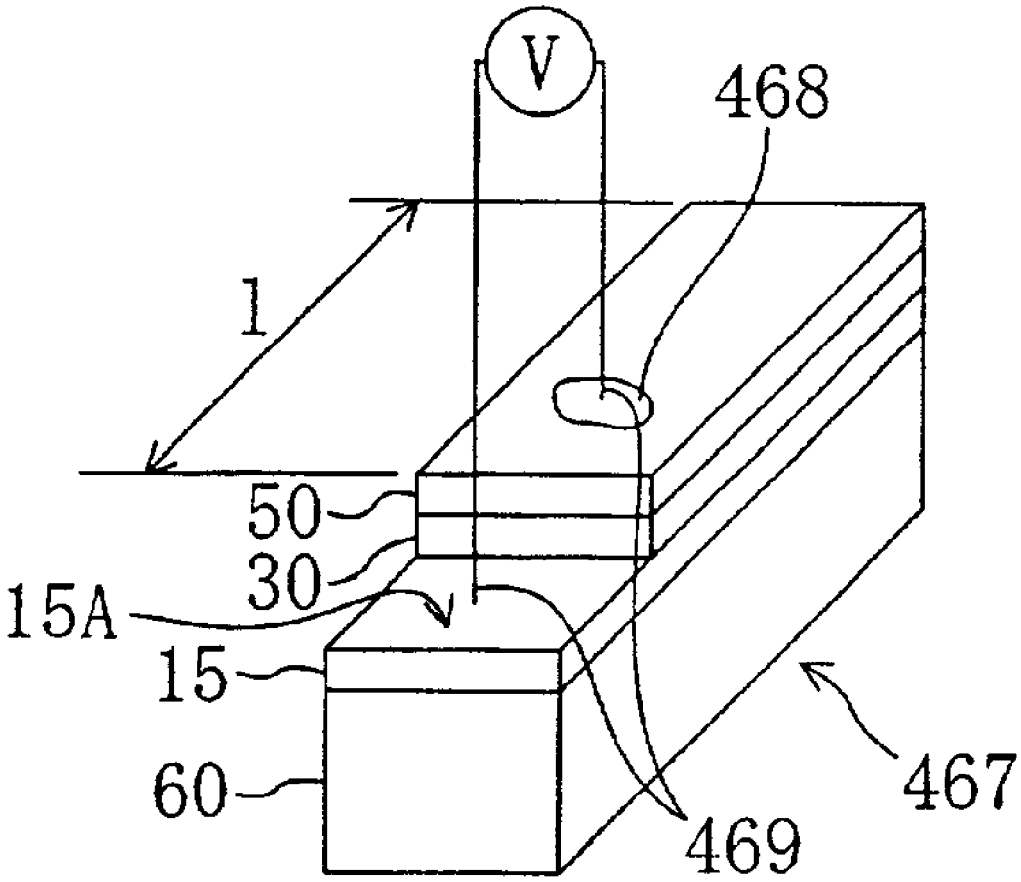
FIG. 41 is a perspective view illustrating an actuator forming member during an electrical property evaluation.
Figure 42A:
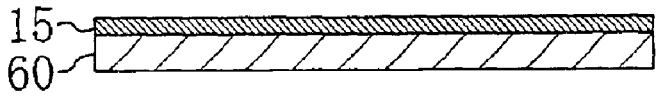
FIG. 42A to FIG. 42E are process diagrams illustrating another method for manufacturing an actuator forming member.
Figure 42B:
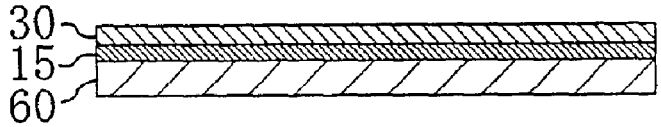
Figure 42C:
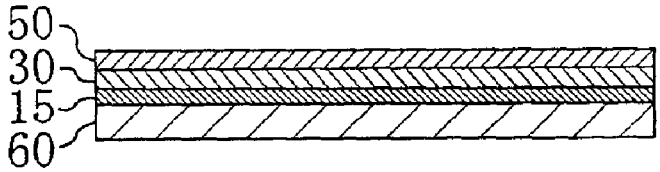
Figure 42D:
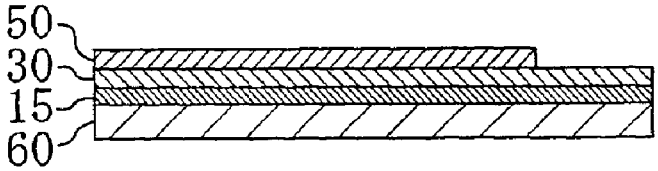
Figure 42E:
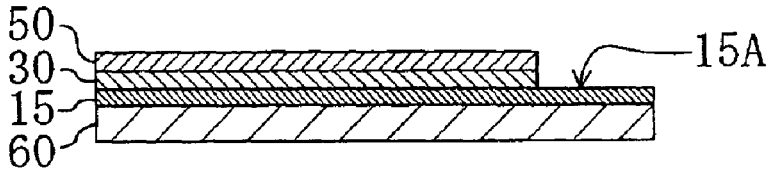
Figure 43A:
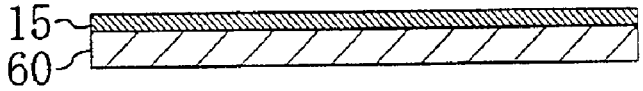
FIG. 43A to FIG. 43D are process diagrams illustrating another method for manufacturing an actuator forming member.
Figure 43B:
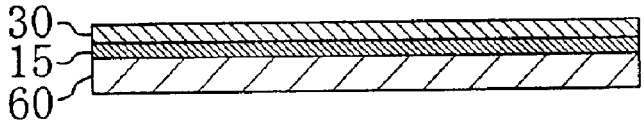
Figure 43C:
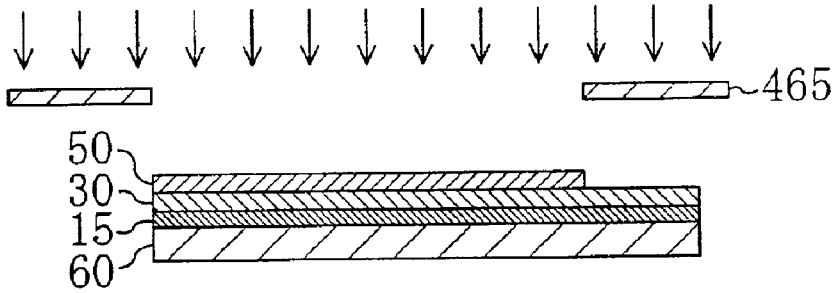
Figure 43D:
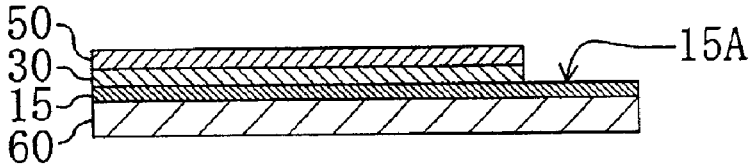
Figure 44:
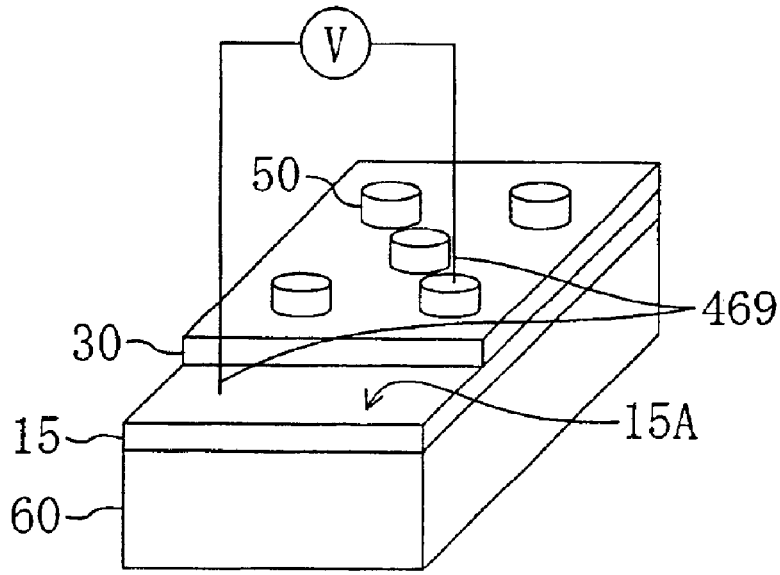
FIG. 44 is a view corresponding to FIG. 39 according to a variation of Embodiment 11.

The mechanical property evaluation is performed as illustrated in FIG. 40. First, as illustrated in FIG. 41, a silver paste 468 as a paste material is attached to the second electrode 50 (step ST21). The silver paste 468 is provided for stabilizing the electrical contact between the inspection probe 469 and the second electrode 50. In this way, the inspection probe 469 can be reliably contacted to the second electrode 50 without pressing the inspection probe 469 against the second electrode 50 of the sample 467 with a strong force. Thus, the load of pushing the inspection probe 469 against the second electrode 50 is reduced. Therefore, an extra load in the measurement is removed, whereby it is possible to more accurately perform the property evaluation.

After the attachment of the silver paste 468, one of the inspection probes 469 is contacted to the second electrode 50 via the silver paste 468 while the other is contacted to the exposed portion 15A of the first electrode 15, and the piezoelectric constant $d_{31}$ of the piezoelectric element 30 is detected under predetermined conditions (e.g., a sine wave whose measured frequency is 500 Hz and whose maximum applied voltage is 30 V or less is applied) (step ST22). The piezoelectric constant $d_{31}$ is calculated using Expression ② below.

$$d_{31} = -\frac{s_1^2 t_2^4 + 4 s_1 s_2 t_1 t_2^3 + 6 s_1 s_2 t_1^2 t_2^2 + 4 s_1 s_2 t_2 t_1^3 + s_1^2 t_1^4}{3 \times [s_1 s_2 t_1 (t_1 + t_2) 1^2] \times V \times \delta} \quad ②$$

$d_{31}$: Piezoelectric constant (C/N)

$t_1$: Thickness of substrate (m)

$t_2$: Thickness of piezoelectric element (m)

$s_1$: Elastic compliance of substrate (physical constant)

$s_2$: Elastic compliance of piezoelectric element (physical constant)

1: Length of sample (m)

Then, it is determined whether the piezoelectric constant $d_{31}$ meets a predetermined acceptable level (step ST23). Specifically, it is determined whether the condition of piezoelectric constant $d_{31} \geqq 70[C/N]$ is satisfied. If the condition is satisfied, it is determined to be a non-defective (step ST24). If the condition is not satisfied, it is determined to be a defective (step ST25).

After the inspection as described above, any actuator forming member 466 that has been determined to be a defective in the electrical property evaluation or in the mechanical property evaluation is removed, and only the actuator forming members 466 that have been determined to be non-defectives both in the electrical property evaluation and in the mechanical property evaluation are used in the ink jet head manufacturing process to be described below.

Method for Manufacturing Ink Jet Head

A method for manufacturing an ink jet head according to the present embodiment is substantially the same as the manufacturing method of Embodiment 1, and the present manufacturing method also uses a so-called "transfer process". Note however that in the ink jet head manufacturing method of the present embodiment, the inspection of actuator forming members 466 as described above is first performed and only the non-defective actuator forming members 466 are used, as described above. Specifically, after the inspection as described above, the vibration plate 14 made of chrome is formed on the second electrode 50 by an RF sputtering method, and thereafter a line head is produced in a manner similar to that of Embodiment 1 (see FIG. 7E to FIG. 7I).

Then, the thus produced four line heads are assembled together to obtain the ink jet head 405 that discharges inks of four colors.

Effects of the Embodiment

As described above, according to the present embodiment, the electrical property and the mechanical property of the actuator blocks 440 are inspected before the actuator blocks 440 are transferred onto the pressure chamber block 441, whereby it is possible to remove defectives having poor properties in advance. Therefore, it is possible to manufacture an ink jet head after removing defectives in advance, whereby it is possible to improve the reliability of the ink jet head. Moreover, it is possible to improve the yield of the ink jet head.

Particularly, in the present embodiment, a plurality of actuator blocks 440 are provided for one pressure chamber block 441, whereby it is possible to downsize each actuator block 440 and to manufacture the line heads 401 to 404 by a transfer process using such actuator blocks. Therefore, many actuator blocks 440 will be used. However, since the inspection as described above is performed, it is possible to remove defective actuator forming members 466 while utilizing the other non-defective actuator forming members 466. In a conventional line head, one actuator block was provided for one pressure chamber block 441, whereby if any of the actuator blocks was defective, it was necessary to waste all the actuator blocks including normal ones. However, according to the present embodiment, only the defectives can be wasted, thereby eliminating the waste of materials.

In the mechanical property evaluation, the silver paste 468 is attached to the second electrode 50, and the inspection probe 469 is contacted to the second electrode 50 via the silver paste 468, whereby it is possible to ensure the electrical contact between the inspection probe 469 and the second electrode 50 by lightly contacting the inspection probe 469 to the second electrode 50. Therefore, the pressing force by the inspection probe 469 is reduced, whereby the influence of the pressing force of the inspection probe 469 can be minimized, and it is thus possible to perform the property evaluation accurately.

Variations

Note that the present embodiment employs a mask deposition method for manufacturing the actuator forming member 466, in which the piezoelectric element 30 and the second electrode 50 are formed using a mask so that a portion of the first electrode 15 becomes the exposed portion 15A. However, the method for producing the actuator forming member 466 is not at all limited to the method described above.

For example, as illustrated in FIG. 42A to FIG. 42E, the exposed portion 15A of the first electrode 15 may alternatively be formed by depositing the first electrode 15, the piezoelectric element 30 and the second electrode 50 in this order across the surface of the substrate 60, and then removing a portion of the second electrode 50 and a portion of the piezoelectric element 30 by etching.

Moreover, as illustrated in FIG. 43A to FIG. 43D, the exposed portion 15A of the first electrode 15 may alternatively be formed by depositing the first electrode 15 and the piezoelectric element 30 in this order across the surface of the substrate 60, depositing the second electrode 50 partially on the piezoelectric element 30 using the mask 465, and then removing the exposed portion of the piezoelectric element 30 by etching.

Figure 45:
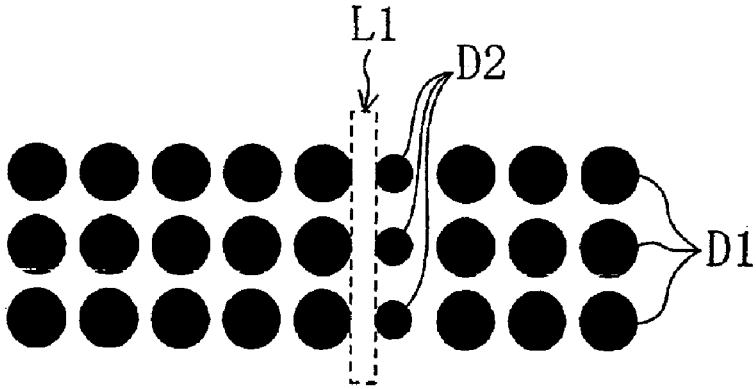
FIG. 45 Prior Art
FIG. 45 is a diagram illustrating a pattern in which ink dots are formed by a conventional ink jet head.

While the first electrode and the second electrode are the separate electrode and the common electrode, respectively, in the embodiments described above, they may be reversed. That is, the first electrode and the second electrode may alternatively be the common electrode and the separate electrode, respectively. Alternatively, the inspection may be performed by pressing the inspection probes 469 against the separate electrode 50 and the first electrode (common electrode) 15 after patterning the second electrode to form the separate electrode 50, as illustrated in FIG. 45.

Also in the electrical property evaluation, the actuator forming member 466 itself may be evaluated by cutting off a portion of the actuator forming member 466 as a sample and evaluating the relative dielectric constant and the dielectric loss of the sample. Moreover, also in the electrical property evaluation, the inspection probe 469 may be contacted to the electrode indirectly via a conductive paste material instead of contacting it directly to the electrode.

The present invention is not limited to the embodiments set forth above, but may be carried out in various other ways without departing from the sprit or main features thereof.

Thus, the embodiments set forth above are merely illustrative in every respect, and should not be taken as limiting. The scope of the present invention is defined by the appended claims, and in no way is limited to the description set forth herein. Moreover, any variations and/or modifications that are equivalent in scope to the claims fall within the scope of the present invention.

What is claimed is:

1. An ink jet head, comprising a plurality of line heads arranged in a scanning direction, wherein:

each line head includes:

a pressure chamber block including a common liquid chamber for storing an ink, a plurality of pressure chambers communicated to the common liquid chamber, and a plurality of nozzles respectively communicated to the pressure chambers; and a plurality of actuator blocks each including a piezoelectric element, a first electrode and a second electrode for applying a voltage across the piezoelectric element, and a vibration plate, the plurality of actuator blocks being arranged on one surface of the pressure chamber block so that more than one of the pressure chambers of the pressure chamber block are covered by the vibration plate; and the actuator blocks of each line head are arranged in a head longitudinal direction with adjacent ones of the actuator blocks being spaced apart from each other, and the actuator blocks of the line head are shifted from the actuator blocks of another line head in the head longitudinal direction while partially overlapping with the actuator blocks of the other line head in the head longitudinal direction.

2. The ink jet head of claim 1, wherein:

the line heads include a plurality of line heads of a same shape; and the line heads of the same shape are shifted from one another in the head longitudinal direction.

3. The ink jet head of claim 2, wherein:

in each of the line heads of the same shape, a plurality of actuator blocks are arranged at a predetermined interval that is shorter than a length of each actuator block in the head longitudinal direction; and the line heads of the same shape are shifted from each other in the head longitudinal direction so that the actuator block of one line head is located between the actuator blocks of the other line head with respect to the head longitudinal direction.

4. The ink jet head of claim 3, wherein the actuator blocks of the plurality of line heads as a whole are arranged in a staggered pattern.

5. The ink jet head of claim 1, wherein:

the line heads include at least a pair of line heads of a same shape; and the pair of line heads are arranged in point symmetry with each other.

6. The ink jet head of claim 5, wherein:

in each of the line heads of the same shape, a plurality of actuator blocks are arranged at a predetermined interval that is shorter than a length of each actuator block in the head longitudinal direction; and the line heads of the same shape are arranged in point symmetry with each other so that the line heads are aligned with each other at both ends in the head longitudinal direction and so that the actuator block of one line head is located between the actuator blocks of the other line heads with respect to the head longitudinal direction.

7. The ink jet head of claim 6, wherein the actuator blocks of the plurality of line heads as a whole are arranged in a staggered pattern.

8. The ink jet head of claim 1, wherein the line heads discharge an ink of a same type.

9. The ink jet head of claim 1, wherein:

the line heads form line head groups each including a plurality of line heads that discharge an ink of a same type;

a plurality of such line head groups are provided in the scanning direction so as to discharge inks of different types.

10. The ink jet head of claim 1, wherein the line heads discharge inks of different types.

11. An ink jet recording apparatus, comprising:

the ink jet head of claim 1; and movement means for relatively moving the ink jet head and a recording medium with respect to each other in a scanning direction.

12. An ink jet head, comprising:

a pressure chamber block including a common liquid chamber for storing an ink, a plurality of pressure chambers communicated to the common liquid chamber, and a plurality of nozzles respectively communicated to the pressure chambers; and a plurality of actuator blocks each including a piezoelectric element, a first electrode and a second electrode for applying a voltage across the piezoelectric element, and a vibration plate, the plurality of actuator blocks being arranged on one surface of the pressure chamber block so that more than one of the pressure chambers of the pressure chamber block are covered by the vibration plate, wherein:

the pressure chambers of the pressure chamber block form a plurality of pressure chamber rows arranged in a head longitudinal direction, each pressure chamber row including more than one of the pressure chambers that are arranged in a direction inclined from the head longitudinal direction;

the pressure chamber rows are arranged parallel to one another;

each of the actuator blocks is formed in a parallelogram shape having a side that is parallel to a row direction of each pressure chamber row; and the actuator blocks are arranged in the head longitudinal direction so as to be spaced apart from one another.

13. The ink jet head of claim 12, wherein:

the pressure chambers of the pressure chamber block are arranged at a predetermined interval with respect to the head longitudinal direction so that a longitudinal direction of each pressure chamber is perpendicular to the head longitudinal direction;

the pressure chambers of each pressure chamber row are arranged at the predetermined interval; and the pressure chamber at one end of a pressure chamber row and the pressure chamber at one end of an adjacent pressure chamber row are arranged at the predetermined interval.

14. The ink jet head of claim 12, wherein:

the pressure chambers of the pressure chamber block are arranged at a predetermined interval with respect to the head longitudinal direction so that a longitudinal direction of each pressure chamber is perpendicular to the head longitudinal direction;

at least two pressure chambers included in each pressure chamber row are arranged at an interval that is a multiple of the predetermined interval; and at least one of the pressure chambers included in each pressure chamber row is provided between two pressure chambers included in an adjacent pressure chamber row with respect to the head longitudinal direction.

15. The ink jet head of claim 12, wherein:

the pressure chambers of the pressure chamber block are arranged at a predetermined interval with respect to the head longitudinal direction so that a longitudinal direction of each pressure chamber is inclined from the head longitudinal direction;

the pressure chambers of each pressure chamber row are arranged at the predetermined interval; and the pressure chamber at one end of a pressure chamber row and the pressure chamber at one end of an adjacent pressure chamber row are arranged at the predetermined interval.

16. The ink jet head of claim 12, wherein:

the pressure chambers of the pressure chamber block are arranged at a predetermined interval with respect to the head longitudinal direction so that a longitudinal direction of each pressure chamber and a row direction of each pressure chamber row are parallel to each other;

at least two pressure chambers included in each pressure chamber row are arranged at an interval that is a multiple of the predetermined interval; and at least one of the pressure chambers included in each pressure chamber row is provided between two pressure chambers included in an adjacent pressure chamber row with respect to the head longitudinal direction.

17. The ink jet head of claim 12, wherein:

the pressure chamber block includes a plurality of sets of the common liquid chamber, the nozzles, the pressure chamber rows and the actuator blocks, the plurality of sets being arranged in a scanning direction.

18. The ink jet head of claim 12, wherein the actuator block includes a conductive vibration plate that functions also as the second electrode, instead of including the second electrode and the vibration plate.

19. An ink jet recording apparatus, comprising:

the ink jet head of claim 12; and movement means for relatively moving the ink jet head and a recording medium with respect to each other in a scanning direction.

20. An ink jet head, comprising:

a pressure chamber block including a common liquid chamber for storing an ink, a plurality of pressure chambers communicated to the common liquid chamber, and a plurality of nozzles respectively communicated to the pressure chambers; and an actuator including a piezoelectric element, a first electrode and a second electrode for applying a voltage across the piezoelectric element, and a vibration plate, the actuator being arranged on the pressure chamber block so that the pressure chambers of the pressure chamber block are covered by the vibration plate, wherein:

the pressure chambers of the pressure chamber block form a plurality of pressure chamber rows arranged in a head longitudinal direction and in a scanning direction, each pressure chamber row including more than one of the pressure chambers arranged in a direction that is inclined from the head longitudinal direction;

at least one pressure chamber of a pressure chamber row is located along a same line in the scanning direction with at least one pressure chamber of another pressure chamber row, and nozzles that correspond to the pressure chambers located along the same line in the scanning direction are also located along a same line in the scanning direction; and the actuator causes an ink of a same type to be discharged, alternately by one shot or by a number of shots, from the nozzles that are located along the same line in the scanning direction.

21. The ink jet head of claim 20, wherein:

the actuator includes a plurality of actuator blocks each having an area that is smaller than the pressure chamber block;

the actuator blocks are arranged in the head longitudinal direction and in the scanning direction; and adjacent ones of the actuator blocks are spaced apart from each other in the scanning direction while partially overlapping with each other with respect to the head longitudinal direction.

22. The ink jet head of claim 20, wherein the actuator blocks are arranged in a staggered pattern.

23. The ink jet head of claim 20, wherein the actuator includes a conductive vibration plate that functions also as the second electrode, instead of including the second electrode and the vibration plate.

24. An ink jet head for discharging inks of different types, comprising a plurality of ink jet heads of claim 20 that are provided respectively for the different types of inks and are arranged in a scanning direction.

25. An ink jet recording apparatus, comprising:

the ink jet head of claim 20; and movement means for relatively moving the ink jet head and a recording medium with respect to each other in a scanning direction.

26. An ink jet head, comprising:

a pressure chamber block including a common liquid chamber for storing an ink, a plurality of pressure chambers communicated to the common liquid chamber, and a plurality of nozzles respectively communicated to the pressure chambers; and an actuator including a piezoelectric element, a first electrode and a second electrode for applying a voltage across the piezoelectric element, and a vibration plate, the actuator being arranged on the pressure chamber block so that the pressure chambers of the pressure chamber block are covered by the vibration plate, wherein:

the pressure chambers of the pressure chamber block form a plurality of pressure chamber rows arranged in a head longitudinal direction, each pressure chamber row including more than one of the pressure chambers arranged in a direction that is inclined from the head longitudinal direction;

at least one pressure chamber of a pressure chamber row is located along a same line in the scanning direction with at least one pressure chamber of another pressure chamber row, and nozzles that correspond to the pressure chambers located along the same line in the scanning direction are also located along a same line in the scanning direction; and the actuator causes an ink of a same type to be discharged, alternately by one shot or by a number of shots, from the nozzles that are located along the same line in the scanning direction.

27. The ink jet head of claim 26, wherein:

the actuator includes a plurality of actuator blocks each in a parallelogram shape having an area that is smaller than the pressure chamber block and having a side that is parallel to a row direction of the pressure chamber rows;

the actuator blocks are arranged in the head longitudinal direction; and adjacent ones of the actuator blocks are spaced apart from each other.

28. The ink jet head of claim 26, wherein the actuator includes a conductive vibration plate that functions also as the second electrode, instead of including the second electrode and the vibration plate.

29. An ink jet head for discharging inks of different types, comprising a plurality of ink jet heads of claim 26 that are provided respectively for the different types of inks and are arranged in a scanning direction.

30. An ink jet recording apparatus, comprising:

the ink jet head of claim 26; and movement means for relatively moving the ink jet head and a recording medium with respect to each other in a scanning direction.

31. An ink jet head, comprising a plurality of line heads arranged in a scanning direction, wherein:

each line head includes:

a pressure chamber block including a common liquid chamber for storing an ink, a plurality of pressure chambers communicated to the common liquid chamber, and a plurality of nozzles respectively communicated to the pressure chambers; and an actuator including a piezoelectric element, a first electrode and a second electrode for applying a voltage across the piezoelectric element, and a vibration plate, the actuator being arranged on the pressure chamber block so that the pressure chambers of the pressure chamber block are covered by the vibration plate, wherein the pressure chambers of the pressure chamber block form a plurality of pressure chamber rows arranged in a head longitudinal direction, each pressure chamber row including more than one of the pressure chambers arranged in a direction that is inclined from the head longitudinal direction;

the line heads are arranged so that one or more pressure chamber of at least one line head is located along a same line in the scanning direction with one or more pressure chamber of another line head, and the nozzles that correspond to the pressure chambers located along the same line in the scanning direction are also located along a same line in the scanning direction; and the actuators of the line heads cause an ink of a same type to be discharged, alternately by one shot or by a number of shots, from the nozzles that are located along the same line in the scanning direction.

32. The ink jet head of claim 31, wherein:

the actuator of each line head includes a plurality of actuator blocks each having an area that is smaller than the pressure chamber block;

the actuator blocks of each line head are arranged in the head longitudinal direction so that adjacent ones of the actuator blocks are spaced apart from each other; and the line heads are arranged so that the actuator block of each line head partially overlaps with the actuator block of another line head with respect to the head longitudinal direction.

33. The ink jet head of claim 31, wherein the actuator blocks are arranged in a staggered pattern.

34. The ink jet head of claim 31, wherein the actuator includes a conductive vibration plate that functions also as the second electrode, instead of including the second electrode and the vibration plate.

35. An ink jet head for discharging inks of different types, comprising a plurality of ink jet heads of claim 31 that are provided respectively for the different types of inks and are arranged in a scanning direction.

36. An inkjet recording apparatus, comprising:

the ink jet head of claim 31; and movement means for relatively moving the ink jet head and a recording medium with respect to each other in a scanning direction.

movement means for relatively moving the ink jet head and a recording medium with respect to each other.

* * * * *

UNITED STATES PATENT AND TRADEMARK OFFICE

CERTIFICATE OF CORRECTION

PATENT NO. : 6,986,564 B2
APPLICATION NO. : 10/057279
DATED : January 17, 2006
INVENTOR(S) : Hiroyuki Matsuo et al.

It is certified that error appears in the above-identified patent and that said Letters Patent is hereby corrected as shown below:

In the Claims:

Column 42

Line 64, Claim 36: delete "movement means for relatively moving the ink jet head and a recording medium with respect to each other."

Signed and Sealed this

Fourteenth Day of November, 2006

JON W. DUDAS
*Director of the United States Patent and Trademark Office*